US009067457B2

(12) United States Patent
To

(10) Patent No.: US 9,067,457 B2
(45) Date of Patent: Jun. 30, 2015

(54) RING BINDER MECHANISM HAVING UNITARY STRUCTURE

(75) Inventor: Chun Yuen To, Hong Kong (CN)

(73) Assignee: Cooper Technologies Company, Houston, TX (US)

( * ) Notice: Subject to any disclaimer, the term of this patent is extended or adjusted under 35 U.S.C. 154(b) by 736 days.

(21) Appl. No.: 13/156,781

(22) Filed: Jun. 9, 2011

(65) Prior Publication Data

US 2011/0305500 A1 Dec. 15, 2011

(30) Foreign Application Priority Data

Jun. 9, 2010 (CN) ..... 2010 1 0201171
Apr. 8, 2011 (CN) ..... 2011 1 0088374

(51) Int. Cl.

| | |
|---|---|
| ***B42F 3/04*** | (2006.01) |
| ***B42F 13/26*** | (2006.01) |
| *B42F 13/00* | (2006.01) |
| *B42F 13/24* | (2006.01) |

(52) U.S. Cl.

CPC ..... *B42F 3/04* (2013.01); *B42F 13/0066* (2013.01); *B42F 13/24* (2013.01); *B42F 13/26* (2013.01); *B42P 2241/28* (2013.01); *B42P 2261/00* (2013.01)

(58) Field of Classification Search

CPC ..... B42F 3/04; B42F 13/16; B42F 13/20; B42F 13/22; B42F 13/24; B42F 13/26
USPC ..... 402/20, 36, 61, 63, 31, 80 P, 19, 37, 39, 402/42, 43, 44; 411/508, 913
See application file for complete search history.

(56) References Cited

U.S. PATENT DOCUMENTS

| | | | |
|---|---|---|---|
| 470,050 | A | 3/1892 | Jewell |
| 683,019 | A | 9/1901 | Buchanan |
| 692,584 | A | 2/1902 | Adams et al. |
| 724,849 | A | 4/1903 | Gresham |
| 763,176 | A | 6/1904 | Gresham et al. |
| 778,992 | A | 1/1905 | Nelson |
| 792,389 | A | 6/1905 | Boehner |

(Continued)

FOREIGN PATENT DOCUMENTS

| | | | |
|---|---|---|---|
| BE | 867999 | A1 | 12/1978 |
| CN | 2254407 | Y | 5/1997 |

(Continued)

OTHER PUBLICATIONS (6) Photos taken Apr. 12, 2011 of admitted prior art device (blue single ring).

(Continued)

*Primary Examiner* — Shelley Self
*Assistant Examiner* — Matthew G Katcoff
(74) *Attorney, Agent, or Firm* — Senniger Powers LLP

(57) ABSTRACT

A ring binder has an elongate body and rings. Each ring includes ring members moveable between open and closed positions. The body and rings are made of one or more moldable polymeric materials. The binder suitably includes a retaining system operable to selectively and releasably hold the ring members in the closed position. The ring members and body can suitably formed together as one piece from a moldable polymeric material. Alternatively, the ring members can be made separately from the body and snapped into the body to form the ring binder.

21 Claims, 81 Drawing Sheets

(56) References Cited

U.S. PATENT DOCUMENTS

| | | | | |
|---|---|---|---|---|
| 812,397 | A | | 2/1906 | Boehner |
| 840,949 | A | | 1/1907 | Mendenhall |
| 842,851 | A | | 2/1907 | Boden |
| 857,377 | A | | 6/1907 | Baker |
| 901,076 | A | | 10/1908 | Dawson |
| 904,618 | A | | 11/1908 | Kellner, Jr. |
| 936,448 | A | | 10/1909 | Hamacher |
| 959,182 | A | | 5/1910 | Trussell |
| 968,657 | A | | 8/1910 | Hamacher et al. |
| 974,831 | A | | 11/1910 | Scherzinger |
| 1,020,561 | A | | 3/1912 | Krumming |
| 1,025,170 | A | | 5/1912 | Trussell |
| 1,105,196 | A | | 7/1914 | Hanke |
| 1,163,179 | A | | 12/1915 | Schade, Jr. |
| 1,165,766 | A | | 12/1915 | Elder |
| 1,231,816 | A | | 7/1917 | Vesterling |
| 1,331,226 | A | | 2/1920 | Adams |
| 1,398,034 | A | | 11/1921 | Mero |
| 1,398,388 | A | | 11/1921 | Murphy |
| 1,398,540 | A | | 11/1921 | Day |
| 1,402,018 | A | | 1/1922 | Schade |
| 1,473,354 | A | | 11/1923 | Nachtrieb |
| 1,548,748 | A | | 8/1925 | Riley |
| 1,610,985 | A | | 12/1926 | Vea |
| 1,733,548 | A | | 10/1929 | Martin |
| 1,733,894 | A | | 10/1929 | Martin |
| 1,765,353 | A | | 6/1930 | Myers |
| 1,787,957 | A | | 1/1931 | Schade |
| 1,797,447 | A | | 3/1931 | Savidge |
| 1,816,021 | A | | 7/1931 | Meyerson |
| 1,919,784 | A | | 7/1933 | Freiberg |
| 1,932,874 | A | | 10/1933 | Adams et al. |
| 1,991,362 | A | | 2/1935 | Krag |
| 1,996,463 | A | | 4/1935 | Dawson et al. |
| 2,013,416 | A | | 9/1935 | McClure |
| 2,020,129 | A | | 11/1935 | Wedge |
| 2,024,461 | A | | 12/1935 | Lotter |
| 2,030,473 | A | | 2/1936 | Schade |
| 2,075,766 | A | | 3/1937 | Rand |
| 2,077,677 | A | | 4/1937 | Dawson et al. |
| 2,088,431 | A | | 7/1937 | Newman |
| 2,089,211 | A | | 8/1937 | Krag |
| 2,096,944 | A | | 10/1937 | Unger et al. |
| 2,104,046 | A | | 1/1938 | Krag |
| 2,105,235 | A | | 1/1938 | Schade |
| 2,119,639 | A | | 6/1938 | Lotter |
| 2,158,056 | A | | 5/1939 | Cruzan |
| 2,179,627 | A | | 11/1939 | Handler |
| 2,204,918 | A | | 6/1940 | Trussell |
| 2,218,105 | A | | 10/1940 | Griffin |
| 2,236,321 | A | | 3/1941 | Ostrander |
| 2,239,121 | A | | 4/1941 | St. Louis et al. |
| 2,252,422 | A | | 8/1941 | Unger |
| 2,260,929 | A | | 10/1941 | Bloore |
| 2,268,431 | A | | 12/1941 | Slonneger |
| 2,288,189 | A | | 6/1942 | Guinane |
| 2,304,716 | A | | 12/1942 | Supin |
| 2,311,492 | A | | 2/1943 | Unger |
| 2,311,620 | A | | 2/1943 | Murphy |
| 2,322,595 | A | | 6/1943 | Schade |
| 2,363,848 | A | | 11/1944 | Emmer |
| 2,389,115 | A | | 11/1945 | Anderson |
| 2,421,799 | A | | 6/1947 | Martin |
| 2,460,718 | A | | 2/1949 | Stevens |
| 2,528,866 | A | | 11/1950 | Dawson, Jr. |
| 2,543,866 | A | | 3/1951 | Panfil, Sr. |
| 2,548,618 | A | | 4/1951 | Purvis |
| 2,612,169 | A | | 9/1952 | Segal |
| 2,645,227 | A | | 7/1953 | Segal |
| 2,664,897 | A | | 1/1954 | Derringer |
| 2,711,555 | A | | 6/1955 | Hanson |
| 2,715,906 | A | | 8/1955 | Lucchesi |
| 2,865,377 | A | | 12/1958 | Schroer et al. |
| 2,871,711 | A | | 2/1959 | Stark |
| 2,891,553 | A | | 6/1959 | Acton |
| 3,077,888 | A | | 2/1963 | Thieme |
| 3,098,489 | A | | 7/1963 | Vernon |
| 3,098,490 | A | | 7/1963 | Wance |
| 3,104,667 | A | | 9/1963 | Mintz |
| 3,105,494 | A | | 10/1963 | Duncan |
| 3,135,266 | A | | 6/1964 | Bouhier |
| 3,149,636 | A | | 9/1964 | Rankin |
| 3,190,293 | A | | 6/1965 | Schneider et al. |
| 3,205,894 | A | | 9/1965 | Rankin |
| 3,205,895 | A | | 9/1965 | Johnson |
| 3,246,653 | A | | 4/1966 | Sexton |
| 3,253,842 | A | | 5/1966 | Rabe |
| 3,255,759 | A | | 6/1966 | Dennis |
| 3,270,749 | A | | 9/1966 | O'Connell |
| 3,275,005 | A | | 9/1966 | Cott |
| 3,313,304 | A | | 4/1967 | Beyer |
| 3,331,373 | A | | 7/1967 | Lohmeier |
| 3,348,550 | A | | 10/1967 | Wolf et al. |
| 3,718,402 | A | | 2/1973 | Schade |
| 3,728,036 | A | | 4/1973 | Cott |
| 3,748,051 | A | | 7/1973 | Frank |
| 3,827,111 | A | | 8/1974 | O'Connell |
| 3,833,308 | A | | 9/1974 | Seaborn |
| 3,884,586 | A | | 5/1975 | Michaelis et al. |
| 3,954,343 | A | | 5/1976 | Thomsen |
| 3,993,374 | A | | 11/1976 | Schudy et al. |
| 3,995,961 | A | | 12/1976 | Dorfman et al. |
| 4,127,340 | A | | 11/1978 | Almgren |
| 4,130,368 | A | | 12/1978 | Jacoby et al. |
| 4,308,637 | A | | 1/1982 | Kucera |
| 4,352,582 | A | | 10/1982 | Eliasson |
| 4,415,290 | A | | 11/1983 | Ohminato |
| 4,486,112 | A | | 12/1984 | Cummins |
| 4,522,526 | A | | 6/1985 | Lozfau et al. |
| 4,551,118 | A | | 11/1985 | Spisz |
| 4,566,817 | A | | 1/1986 | Barrett, Jr. |
| 4,571,108 | A | | 2/1986 | Vogl |
| 4,577,985 | A | | 3/1986 | Beyer |
| 4,607,970 | A | * | 8/1986 | Heusinkveld ..... 402/20 |
| 4,624,595 | A | | 11/1986 | Ohminato |
| 4,678,357 | A | | 7/1987 | Kissel et al. |
| 4,690,580 | A | | 9/1987 | Kissel |
| 4,693,624 | A | * | 9/1987 | Moosmuller ..... 402/22 |
| 4,696,595 | A | | 9/1987 | Pinkney |
| 4,798,491 | A | | 1/1989 | Lassle |
| 4,813,803 | A | | 3/1989 | Gross |
| 4,815,882 | A | | 3/1989 | Ohminato |
| 4,886,390 | A | | 12/1989 | Silence et al. |
| 4,904,103 | A | | 2/1990 | Im |
| 4,919,557 | A | | 4/1990 | Podosek |
| D317,177 | S | | 5/1991 | Wandemberg-Boschetti |
| 5,018,896 | A | | 5/1991 | Vanni |
| 5,116,157 | A | | 5/1992 | Gillum et al. |
| 5,180,247 | A | | 1/1993 | Yu |
| 5,201,101 | A | | 4/1993 | Rouser et al. |
| 5,255,991 | A | | 10/1993 | Sparkes |
| 5,286,128 | A | | 2/1994 | Gillum |
| 5,354,142 | A | | 10/1994 | Yu |
| 5,368,407 | A | | 11/1994 | Law |
| 5,392,848 | A | | 2/1995 | Bottcher et al. |
| 5,393,156 | A | | 2/1995 | Mullin et al. |
| 5,476,335 | A | | 12/1995 | Whaley |
| 5,618,122 | A | | 4/1997 | Constantine |
| 5,642,954 | A | | 7/1997 | Hudspith |
| 5,660,490 | A | | 8/1997 | Warrington |
| 5,692,847 | A | | 12/1997 | Zane et al. |
| 5,692,848 | A | | 12/1997 | Wada |
| 5,697,722 | A | | 12/1997 | Hladik et al. |
| 5,706,559 | A | * | 1/1998 | Oliver et al. ..... 267/49 |
| 5,718,529 | A | | 2/1998 | Chan |
| 5,765,956 | A | | 6/1998 | Lanzarin |
| 5,782,569 | A | | 7/1998 | Mullin et al. |
| 5,807,006 | A | | 9/1998 | Cheung |
| 5,810,499 | A | | 9/1998 | Law |
| 5,816,729 | A | | 10/1998 | Whaley |
| 5,827,004 | A | | 10/1998 | Kim |
| 5,868,513 | A | | 2/1999 | Law |
| 5,895,164 | A | | 4/1999 | Wu |
| 5,938,365 | A | | 8/1999 | Grewe et al. |

(56) References Cited

U.S. PATENT DOCUMENTS

| | | | | |
|---|---|---|---|---|
| 5,975,784 | A | 11/1999 | Whaley | |
| 5,975,785 | A | 11/1999 | Chan | |
| 6,036,394 | A | 3/2000 | Cheng | |
| D430,204 | S | 8/2000 | Berracasa | |
| 6,109,813 | A | 8/2000 | To et al. | |
| 6,155,737 | A | 12/2000 | Whaley | |
| 6,179,507 | B1 | 1/2001 | Lam | |
| 6,179,508 | B1 | 1/2001 | Coerver | |
| 6,203,229 | B1 * | 3/2001 | Coerver | 402/38 |
| 6,206,601 | B1 | 3/2001 | Ko | |
| 6,217,247 | B1 | 4/2001 | Ng | |
| 6,270,279 | B1 | 8/2001 | Whaley | |
| 6,270,280 | B1 | 8/2001 | Baumann | |
| 6,276,862 | B1 | 8/2001 | Snyder et al. | |
| 6,293,722 | B1 | 9/2001 | Holbrook et al. | |
| 6,328,497 | B1 | 12/2001 | To | |
| 6,364,558 | B1 | 4/2002 | To | |
| 6,467,984 | B1 | 10/2002 | To | |
| 6,514,000 | B2 * | 2/2003 | Youngs et al. | 402/60 |
| 6,749,357 | B2 | 6/2004 | Cheng | |
| 6,761,497 | B2 | 7/2004 | Kaneda | |
| 6,840,695 | B2 | 1/2005 | Horn | |
| D533,588 | S | 12/2006 | Cheng | |
| 7,223,040 | B2 | 5/2007 | Koike et al. | |
| 7,275,886 | B2 | 10/2007 | Cheng | |
| 7,293,932 | B2 | 11/2007 | Wong | |
| 7,296,946 | B2 | 11/2007 | Cheng et al. | |
| 7,360,962 | B2 | 4/2008 | To | |
| 7,478,963 | B2 | 1/2009 | Tanaka et al. | |
| 7,549,817 | B2 | 6/2009 | Cheng et al. | |
| 7,600,939 | B2 | 10/2009 | Liu et al. | |
| 8,002,488 | B2 | 8/2011 | Cheng | |
| 2003/0044221 | A1 | 3/2003 | To et al. | |
| 2004/0086323 | A1 | 5/2004 | Tanaka et al. | |
| 2005/0207826 | A1 | 9/2005 | Cheng et al. | |
| 2005/0271459 | A1 | 12/2005 | To et al. | |
| 2008/0080925 | A1 | 4/2008 | Cheng | |
| 2009/0110470 | A1 | 4/2009 | To et al. | |
| 2010/0003070 | A1 | 1/2010 | Cheng | |

FOREIGN PATENT DOCUMENTS

| | | | |
|---|---|---|---|
| CN | 201110088374 | | 4/2001 |
| CN | 102275410 | | 12/2001 |
| CN | 2790771 | Y | 6/2006 |
| CN | 201613729 | U | 10/2010 |
| EP | 1681157 | A2 | 7/2006 |
| EP | 2002990 | A1 | 12/2008 |
| FR | 1336765 | | 9/1963 |
| FR | 1346864 | | 12/1963 |
| FR | 2221924 | | 10/1974 |
| FR | 2238332 | | 2/1975 |
| GB | 868724 | | 5/1961 |
| GB | 906279 | | 9/1962 |
| GB | 952536 | | 3/1964 |
| GB | 1101760 | | 1/1968 |
| GB | 2292343 | A | 2/1996 |
| GB | 2387815 | A | 10/2003 |
| JP | 5979379 | U | 5/1984 |
| JP | 6118880 | U | 2/1986 |
| JP | 1299095 | A | 12/1989 |
| JP | 4120085 | U | 10/1992 |
| WO | 2005035265 | | 4/2005 |

OTHER PUBLICATIONS

PCT International Search Report for PCT/CN2011/075538 dated Sep. 15, 2011, 9 pages.

Written Opinion of the International Searching Authority regarding PCT/CN2011/075538 dated Sep. 15, 2011, 10 pages.

Office Action issued Feb. 24, 2014 related to U.S. Appl. No. 13/218,086, 9 pages.

European Search Report for EP 11 16 9376 issued Jun. 11, 2013, 5 pgs.

Office Action issued May 22, 2013 regarding U.S. Appl. No. 13/218,086, 8 pages.

Office Action issued Oct. 4, 2013 regarding U.S. Appl. No. 13/218,091, 8 pages.

Office Action issued Jan. 22, 2014 regarding U.S. Appl. No. 13/218,245, 8 pages.

Office Action for U.S. Appl. No. 13/218,091, dated Apr. 30, 2014, 7 pages, Alexandria, Virginia.

* cited by examiner

RING BINDER MECHANISM HAVING UNITARY STRUCTURE

CROSS-REFERENCE TO RELATED APPLICATION

This application claims priority from Chinese Patent Application No. 201110088374.X, filed Apr. 8, 2011 and Chinese Patent Application No.: 201010201171.2, filed Jun. 9, 2010, which are incorporated herein by reference.

FIELD OF INVENTION

The present invention relates generally to a ring binder mechanism for retaining loose-leaf pages, and more particularly to a ring binder mechanism made from a moldable polymeric material.

BACKGROUND

Ring binder mechanisms having rings for selectively retaining loose-leaf pages are well known. These mechanisms are commonly fastened to other structures such as notebook covers, files, clipboards, and the like to enable these structures to retain loose-leaf pages. Many conventional ring binder mechanisms have a metal housing containing pivoting hinge plates supporting ring segments that can be moved between and open position for adding and/or removing loose-leaf pages and a closed position for retaining loose-leaf pages. These metal ring mechanisms are suitable for many purposes, but manufacturing them can require relatively complicated assembly of multiple components to produce a completed ring mechanism. Some of the chemicals that are commonly used in production of conventional metal ring mechanisms (e.g., to apply a corrosion resistant nickel plating to a metal housing) are also difficult to handle and suitable precautions are required to protect people and the environment from these chemicals.

SUMMARY

One aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a retaining system operable to selectively and releasably hold the first and second ring members in the closed position. The rings and body are formed together as a one-piece unitary structure made of a moldable polymeric material. The first and second ring members are in an undeformed state in the open position and moveable from the open position to the closed position by resiliently deforming the first and second ring members. The first and second ring members are biased by internal elastic restoration forces when they are in the closed position to move toward the open position. Straight line projections of the ends of the first and second ring members intersect at an angle of at least about 75 degrees in the undeformed position.

Another aspect of the invention is a ring binder for use in holding loose-leaf pages. The ring binder has an elongate body having a longitudinal axis and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a retaining system operable to selectively and releasably hold the first and second ring members in the closed position. The retaining system comprising first and second interlocking formations adjacent ends of the first and second ring members, respectively. The first and second interlocking formations are selectively moveable by movement of the first locking formation axially of the body relative to the second locking formation between a retaining position in which the retaining system holds the first and second ring members in the closed position and a non-retaining position in which the retaining system does not hold the first and second ring members in the closed position.

Yet another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a retaining system operable to selectively and releasably hold the first and second ring members in the closed position. The rings and body are formed together as a one-piece unitary structure made of a moldable polymeric material. The first and second ring members are in an undeformed state in the open position and moveable from the open position to the closed position by resiliently deforming the first and second ring members. The first and second ring members having free ends in the open position that are spaced from one another a distance in the range of about 10 mm to about 45 mm.

Another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The rings and body are formed together as a one-piece unitary structure made of a moldable polymeric material. At least a portion of each of the first and second ring members has a substantially circular cross sectional shape. The first and second ring members are moveable from the open position to the closed position by resiliently deforming at least one of the first and second ring members.

In another respect, the invention includes a ring binder for use in holding loose-leaf pages. The ring binder has an elongate body and rings for retaining loose-leaf pages. Each ring including first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a mounting plate adapted to be secured to a substrate. The body is hingedly attached to the mounting plate so the body can be pivoted relative to the substrate when the mounting plate is secured to the substrate. The rings, body, and mounting plate are formed together as a one-piece unitary structure made of a moldable polymeric material.

One aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a retaining system operable to selectively and releasably hold the first and second ring members in the closed position. The rings and body are formed together as a one-piece unitary structure made of a moldable polymeric material. The first and second ring members are in an undeformed state in the open position and moveable from the open position to the closed position by resiliently deforming the first and second ring members. The first and second ring members are biased by internal elastic restoration forces when they are in the closed position to move toward the open position. Straight line projections of the ends of the first and second ring members intersect at an angle of at least about 75 degrees in the undeformed position.

Another aspect of the invention is a ring binder for use in holding loose-leaf pages. The ring binder has an elongate body having a longitudinal axis and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a retaining system operable to selectively and releasably hold the first and second ring members in the closed position. The retaining system comprising first and second interlocking formations adjacent ends of the first and second ring members, respectively. The first and second interlocking formations are selectively moveable by movement of the first locking formation axially of the body relative to the second locking formation between a retaining position in which the retaining system holds the first and second ring members in the closed position and a non-retaining position in which the retaining system does not hold the first and second ring members in the closed position.

Yet another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a retaining system operable to selectively and releasably hold the first and second ring members in the closed position. The rings and body are formed together as a one-piece unitary structure made of a moldable polymeric material. The first and second ring members are in an undeformed state in the open position and moveable from the open position to the closed position by resiliently deforming the first and second ring members. The first and second ring members having free ends in the open position that are spaced from one another a distance in the range of about 10 mm to about 45 mm.

Another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The rings and body are formed together as a one-piece unitary structure made of a moldable polymeric material. At least a portion of each of the first and second ring members has a substantially circular cross sectional shape. The first and second ring members are moveable from the open position to the closed position by resiliently deforming at least one of the first and second ring members.

In another respect, the invention includes a ring binder for use in holding loose-leaf pages. The ring binder has an elongate body and rings for retaining loose-leaf pages. Each ring including first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. The ring binder has a mounting plate adapted to be secured to a substrate. The body is hingedly attached to the mounting plate so the body can be pivoted relative to the substrate when the mounting plate is secured to the substrate. The rings, body, and mounting plate are formed together as a one-piece unitary structure made of a moldable polymeric material.

Another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. A retaining system is operable to selectively and releasably hold the first and second ring members in the closed position. The retaining system has first and second interlocking formations adjacent ends of the first and second ring members, respectively. The first and second interlocking formations are selectively moveable relative to one another between a retaining position in which the retaining system holds the first and second ring members in the closed position and a non-retaining position in which the retaining system does not hold the first and second ring members in the closed position. The interlocking formation of the first ring member includes at least one projection having a free end. The free end of the projection has at least one void and is adapted to be resiliently compressed by the interlocking formation of the second ring as the interlocking formations are moved from the non-retaining position to the retaining position.

Yet another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. A retaining system is operable to selectively and releasably hold the first and second ring members in the closed position. The retaining system has first and second interlocking formations adjacent ends of the first and second ring members, respectively. The first and second interlocking formations are selectively moveable relative to one another between a retaining position in which the retaining system holds the first and second ring members in the closed position and a non-retaining position in which the retaining system does not hold the first and second ring members in the closed position. The interlocking formation of the second ring member comprises an opening having an axis. The first interlocking formation is adapted to exert forces on the second interlocking formation at the opening extending radially outward from the axis in multiple directions as the interlocking formations are moved from the non-retaining position to the retaining position.

Another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. A retaining system is operable to selectively and releasably hold the first and second ring members in the closed position. The retaining system has first and second interlocking formations adjacent ends of the first and second ring members, respectively. The first and second interlocking formations are selectively moveable between a retaining position in which the retaining system holds the first and second ring members in the closed position and a non-retaining position in which the retaining system does not hold the first and second ring members in the closed position. The interlocking formation of the first ring member includes a post extending from a relatively wider base to a relatively narrower free end, and the interlocking formation on the second ring member comprises an opening for receiving the post. The rings and the body are formed together as a one-piece unitary structure made of a moldable polymeric material.

Yet another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. A retaining system is operable to selectively and releasably hold the first and second ring members in the closed position. The retaining system has first and second interlocking formations adjacent ends of the first and second ring members, respectively. The first and second interlocking formations are selectively moveable between a retaining position in which the retaining system holds the first and second ring members in the closed position and a non-retaining position in which the retaining system does not hold the first and second ring members in the closed position. The rings and the body are formed together as a one-piece unitary structure made of a moldable polymeric material. The one piece unitary structure includes a living hinge extending along a side of the elongate body between adjacent one of the rings. The living hinge supports more than one ring member for pivoting movement of the ring member relative to the elongate body.

In another respect the invention includes a ring mechanism for holding loose-leaf pages. The mechanism has an elongate body made of a moldable polymeric material and rings for holding the loose-leaf pages. Each ring includes a first ring member and a second ring member. The first ring members are movable relative to the housing and the second ring members between a closed position and an open position. In the closed position the first and second ring members form a substantially continuous, closed loop for allowing loose-leaf pages retained by the rings to be moved along the rings from one ring member to the other. In the open position the first and second ring members form a discontinuous, open loop for adding or removing loose-leaf pages from the rings. Each ring member has a ring portion and an anchor connected to the ring portion. Each ring member is formed separately from the other ring members. The anchors are secured to the body for pivoting movement relative to the body.

Still another aspect of the invention is a ring binder for use in holding loose-leaf pages. The ring binder has an elongate body and rings for retaining loose-leaf pages. Each ring includes first and second ring members extending from and supported by the elongate body. The first and second ring members are moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring. A retaining system is operable to selectively and releasably hold the first and second ring members in the closed position. The rings and body are formed together as a one-piece unitary structure made of a moldable polymeric material. The first ring member of each ring is substantially fixed relative to the body and extends generally up from a top of the body. The second ring member of each ring is secured to a side of the body by a living hinge for pivoting movement of the second ring member relative to the body between the open and closed positions.

Other objects and features will in part be apparent and in part pointed out hereinafter.

DETAILED DESCRIPTION

Referring to FIGS. 1-9, one embodiment of a ring binder of the present invention, generally designated 101, is illustrated as a three-ring notebook. The notebook 101 includes a cover 103 (broadly a "substrate") and a ring mechanism 105 secured to the cover and operable to selectively retain and release loose-leaf pages (not shown in FIG. 1) or other items capable of being stored on a ring.

Figure 1:
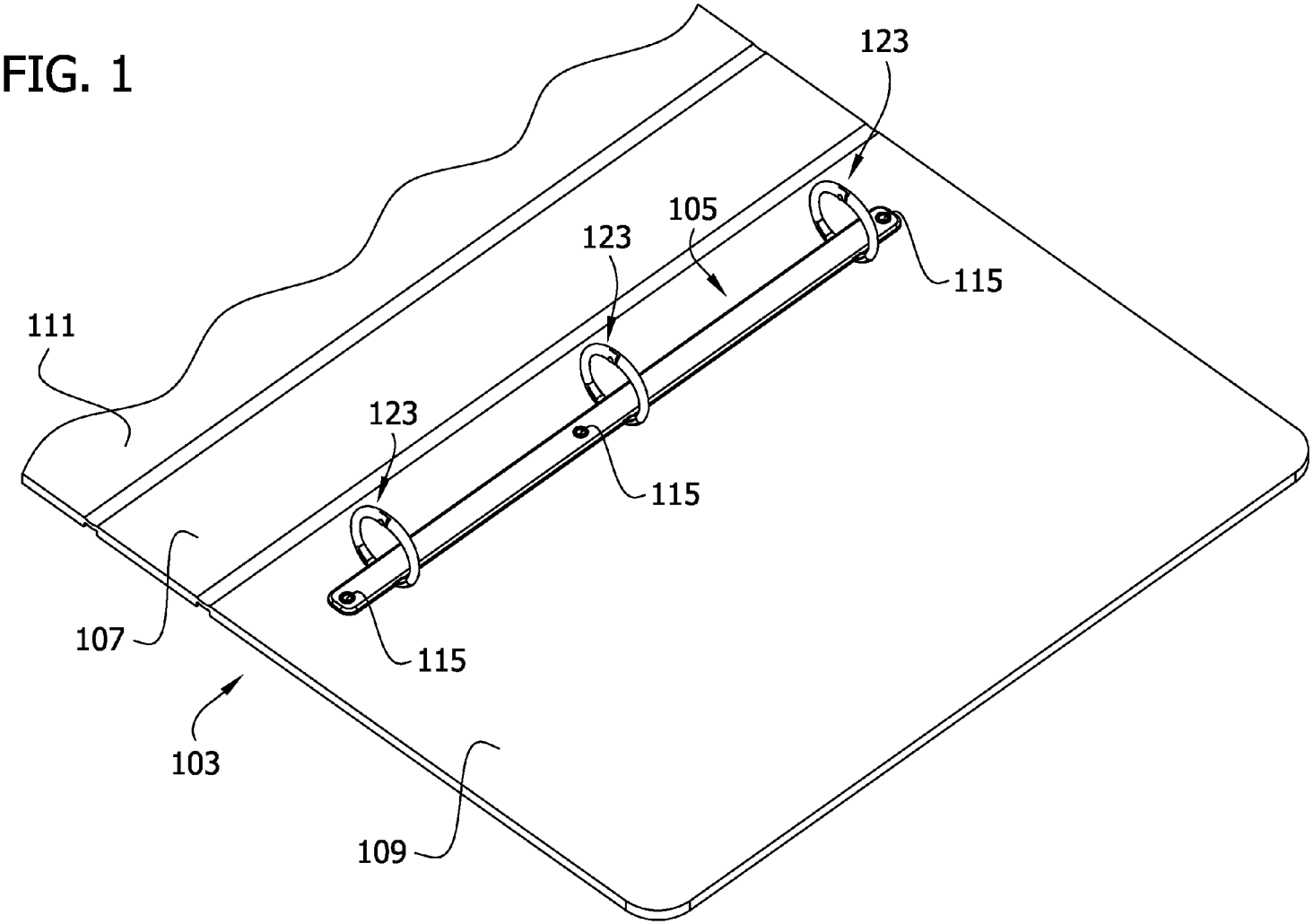
FIG. 1 is a perspective of one embodiment of a ring binder of the present invention.
Figure 1A:
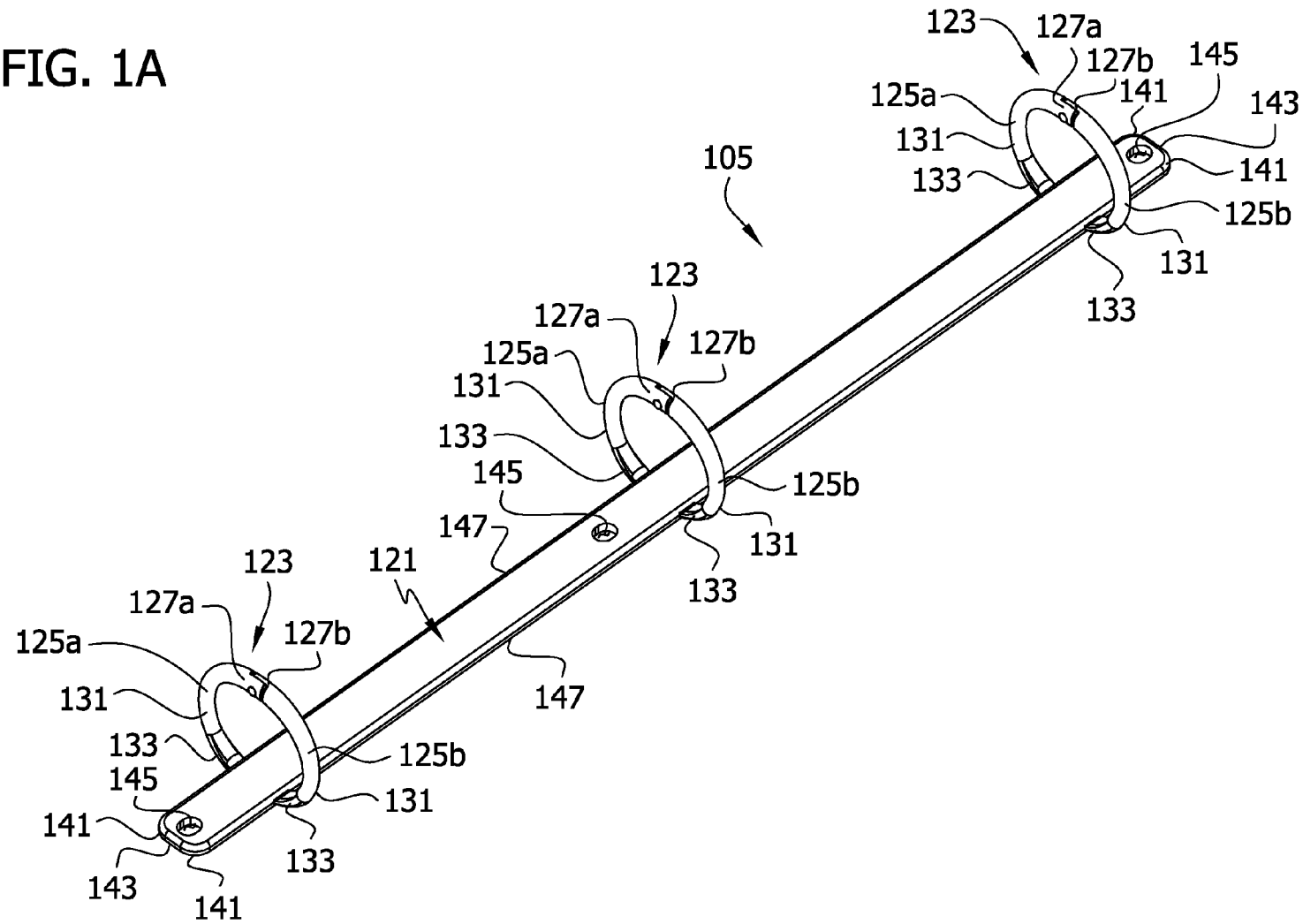
FIG. 1A is an enlarged perspective of the ring mechanism of the binder illustrated in FIG. 1.
Figure 2:
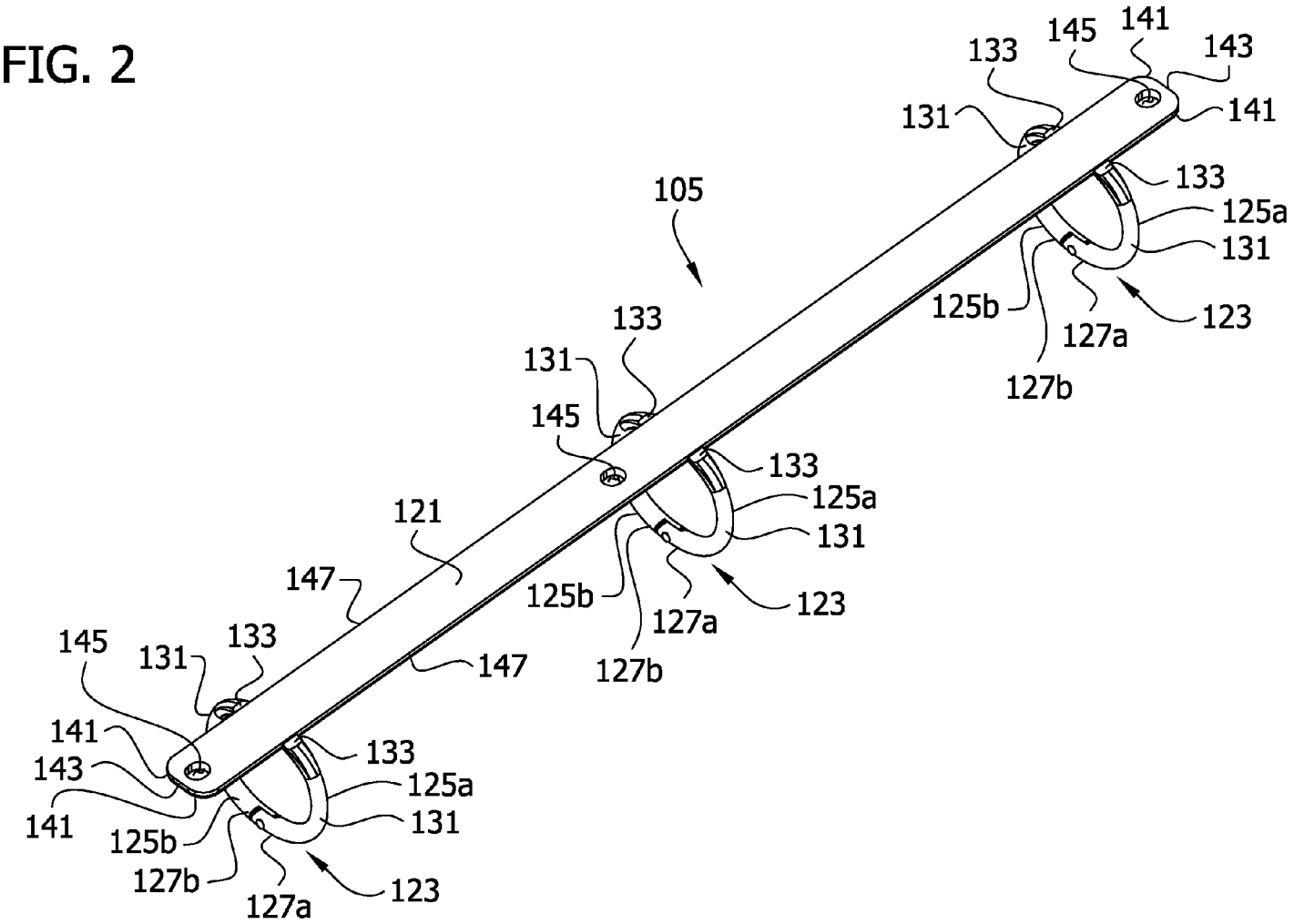
FIG. 2 is another perspective of the ring mechanism from the ring binder illustrated in FIG. 1 from a vantage point in which a bottom of the ring mechanism is visible.
Figure 3:
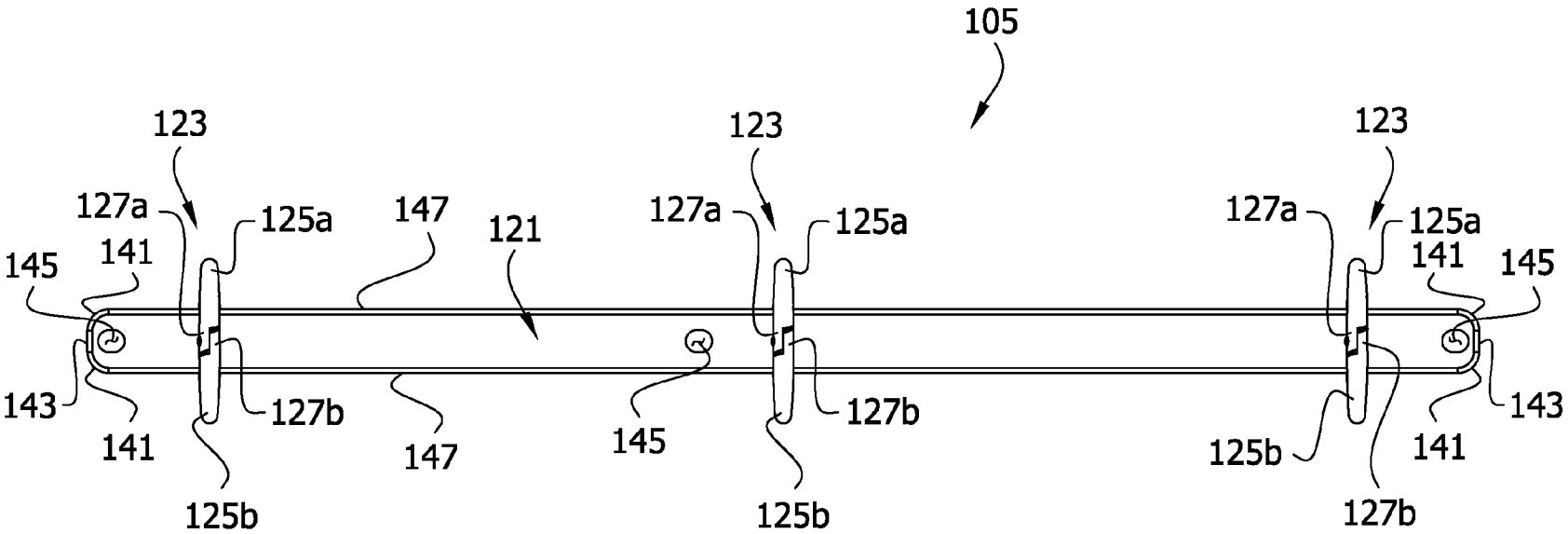
FIG. 3 is a top plan of the ring mechanism.

As illustrated in FIG. 1, the notebook cover 103 has a spine 107. Front and back panels 109, 111 of the cover 103 are hingedly attached to the spine 107 along opposite sides of the spine. The panels 109, 111 of the cover 103 are moveable relative to the spine 107 to selectively expose and cover loose-leaf pages retained by the ring mechanism 105 in a manner known to those skilled in the art. In the illustrated embodiment, the ring mechanism 105 is secured to the back panel 111 adjacent the spine 107. However, the ring mechanism 105 can be secured to a different part of the notebook cover 103 if desired. Although the embodiment illustrated in FIG. 1 is a notebook, it is understood that other ring binders (i.e., ring binders that are not notebooks) are also within the scope of the invention. For example, instead of a notebook cover, the ring mechanism 105 can be secured to a structure associated with a file, clip board, planner, brief case, etc.

The ring mechanism 105 includes an elongate body 121 supporting a plurality of rings 123 (e.g., three rings as illustrated in FIG. 1) for retaining loose-leaf pages. The rings 123 and body 121 are formed together as a one-piece unitary structure made of a moldable polymeric material. For example, the polymeric material can suitably be polyoxymethylene (POM) (e.g., Delrin®), polyamide (Nylon), polypropylene (PP) or the like. The rings 123 and body 121 are suitably manufactured together as one piece in the mold of an injection molding apparatus. Those skilled in the art of injection molding will recognize there are several internal molecular and structural differences between a one-piece construction of the rings 123 and body 121 as described herein and other constructions in which the rings and body are made separately and later joined or assembled together. These differences can include the absence of seams, weld/knit lines and other internal discontinuities in the one-piece structure at the molecular level.

Figure 4:
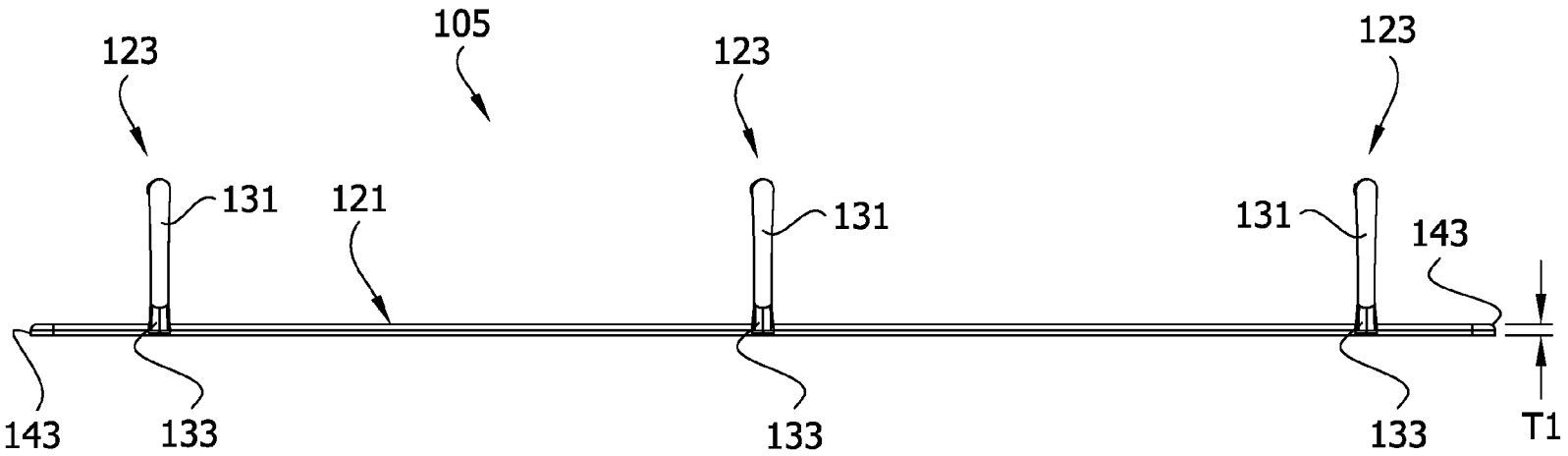
FIG. 4 is a side elevation of the ring mechanism.

The elongate body 121 is suitably a solid body having a generally rectangular cross sectional shape and rounded corners 141 at opposite ends 143 (or rounded ends). The side edges 147 of the body 121 are also suitably chamfered or otherwise rounded/smoothed so the body 121 has no sharp features that could catch on clothing or injure people. The body 121 illustrated in the drawings has a substantially uniform thickness T1 (FIG. 4). Holes 145 are provided at various positions along the longitudinal axis of the body 121 between its ends 143 for receiving prong fasteners 115 (as illustrated), rivets, or other suitable fasteners for securing the ring mechanism 105 to the notebook cover 103 or other substrate. For example, the embodiment illustrated in FIG. 1 has a hole 145 adjacent each end 143 of the body 121 and a third hole between two of the rings 123. The holes 145 are suitably spaced longitudinally from the rings 123.

Figure 7:
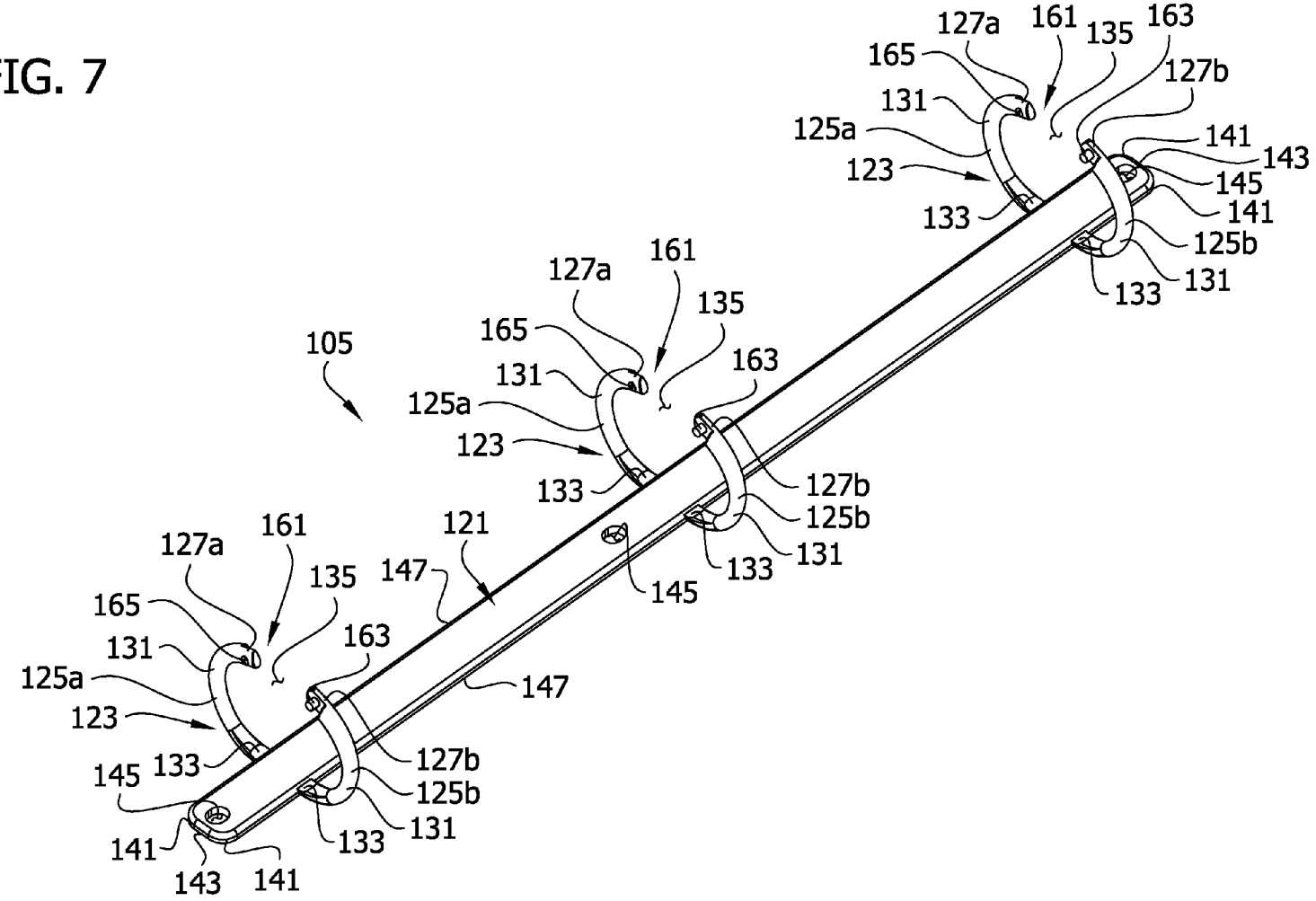
FIG. 7 is a perspective of the ring mechanism similar to FIG. 1 except that the rings are open.
Figure 8:
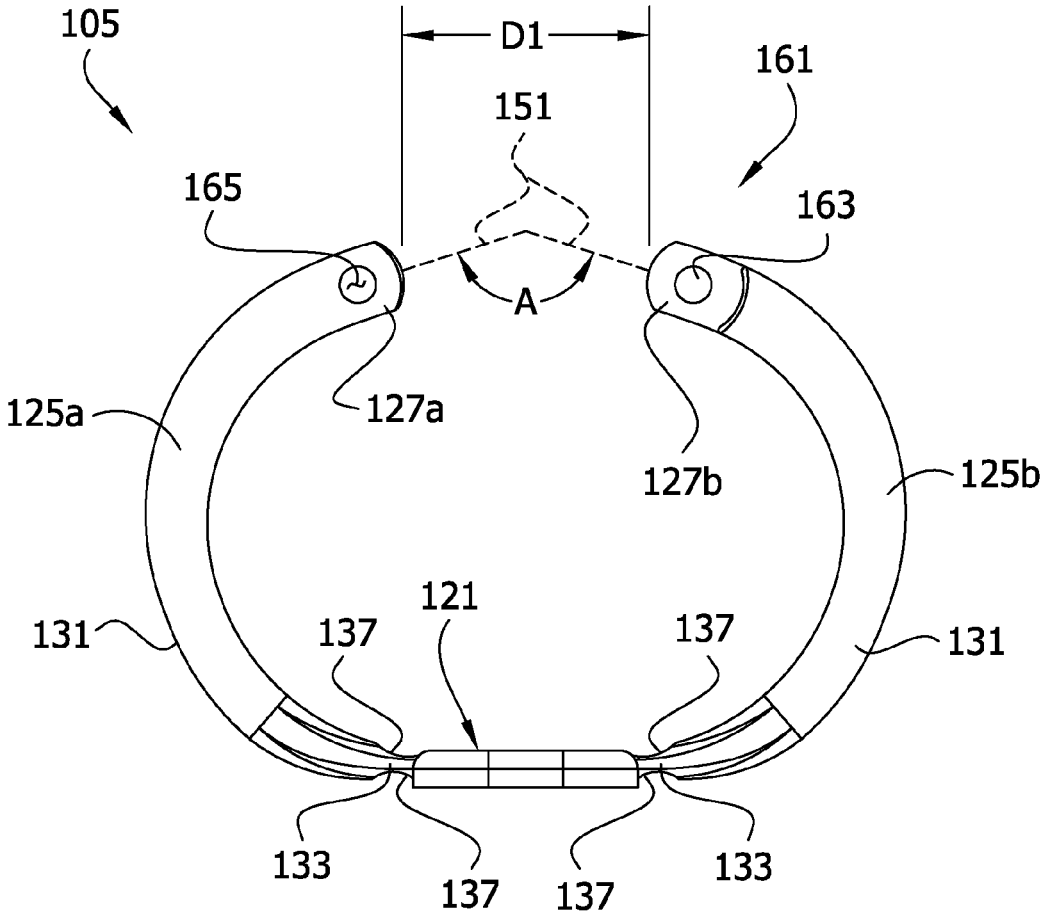
FIG. 8 is a front end elevation of the ring mechanism similar to FIG. 5 except that the rings are open.
Figure 9A:
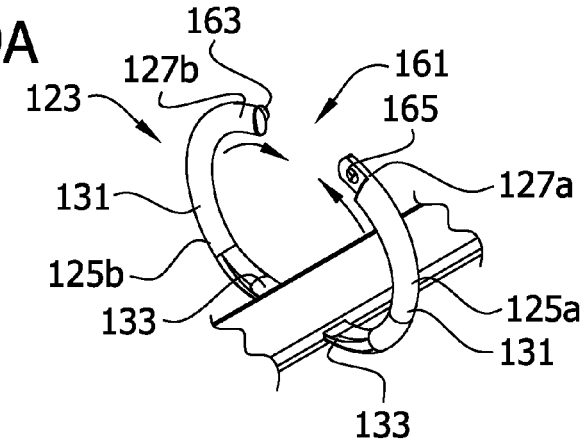
FIGS. 9A-9D illustrate a sequence in which the rings of the ring mechanism are closed and then opened.
Figure 9B:
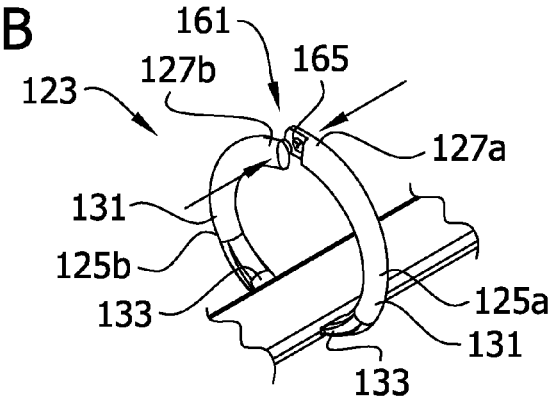
Figure 9C:
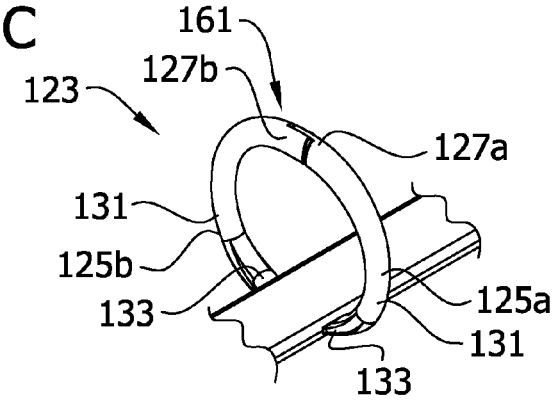
Figure 9D:
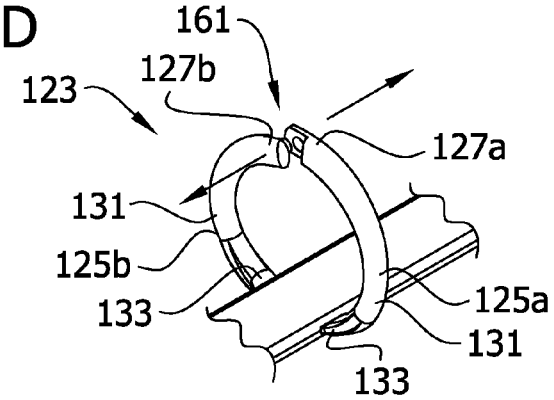
Figure 10:
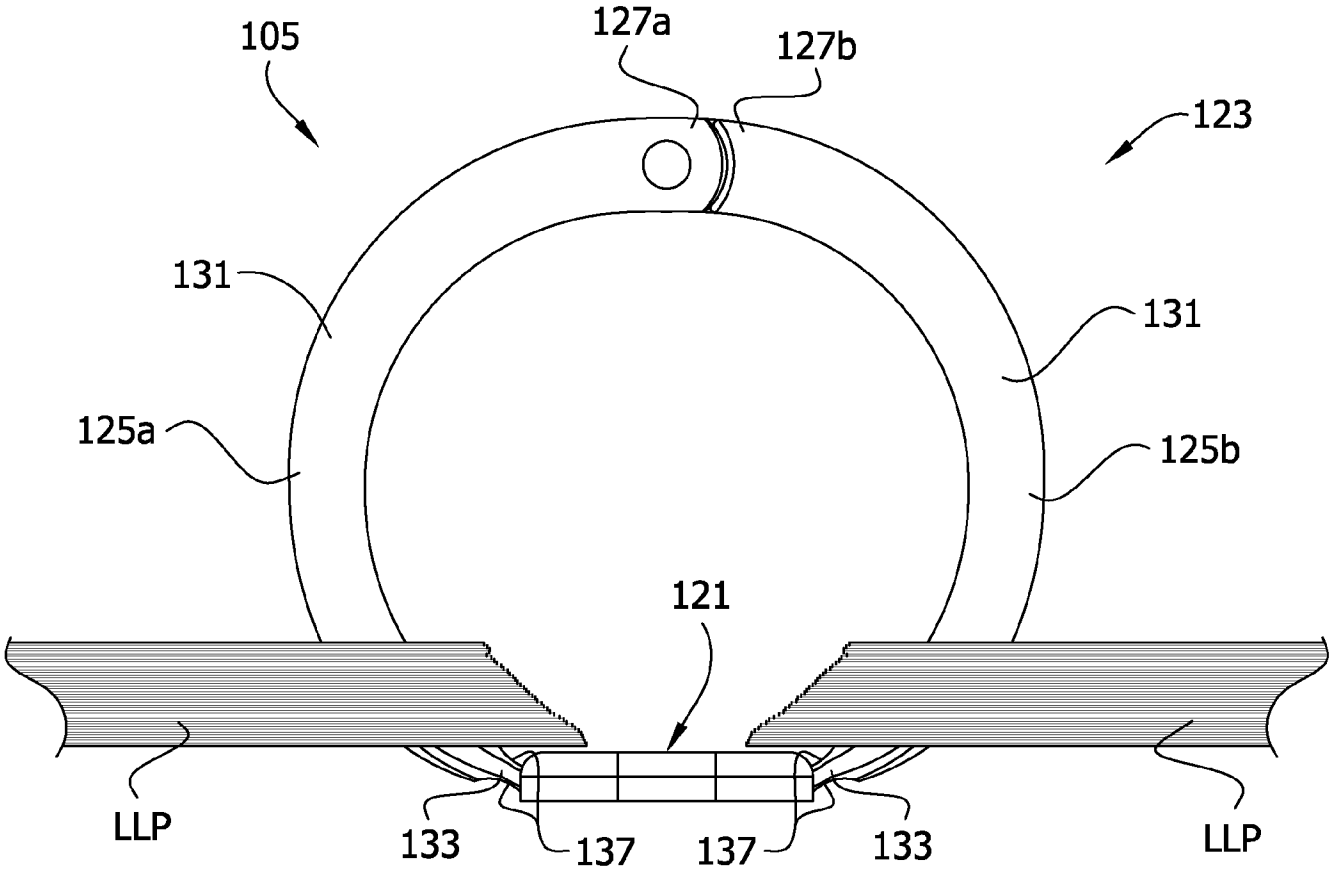
FIG. 10 is a front end elevation of the ring mechanism similar to FIGS. 5 and 7 with the rings closed and a stack of loose-leaf pages retained by the rings.
Figure 11:
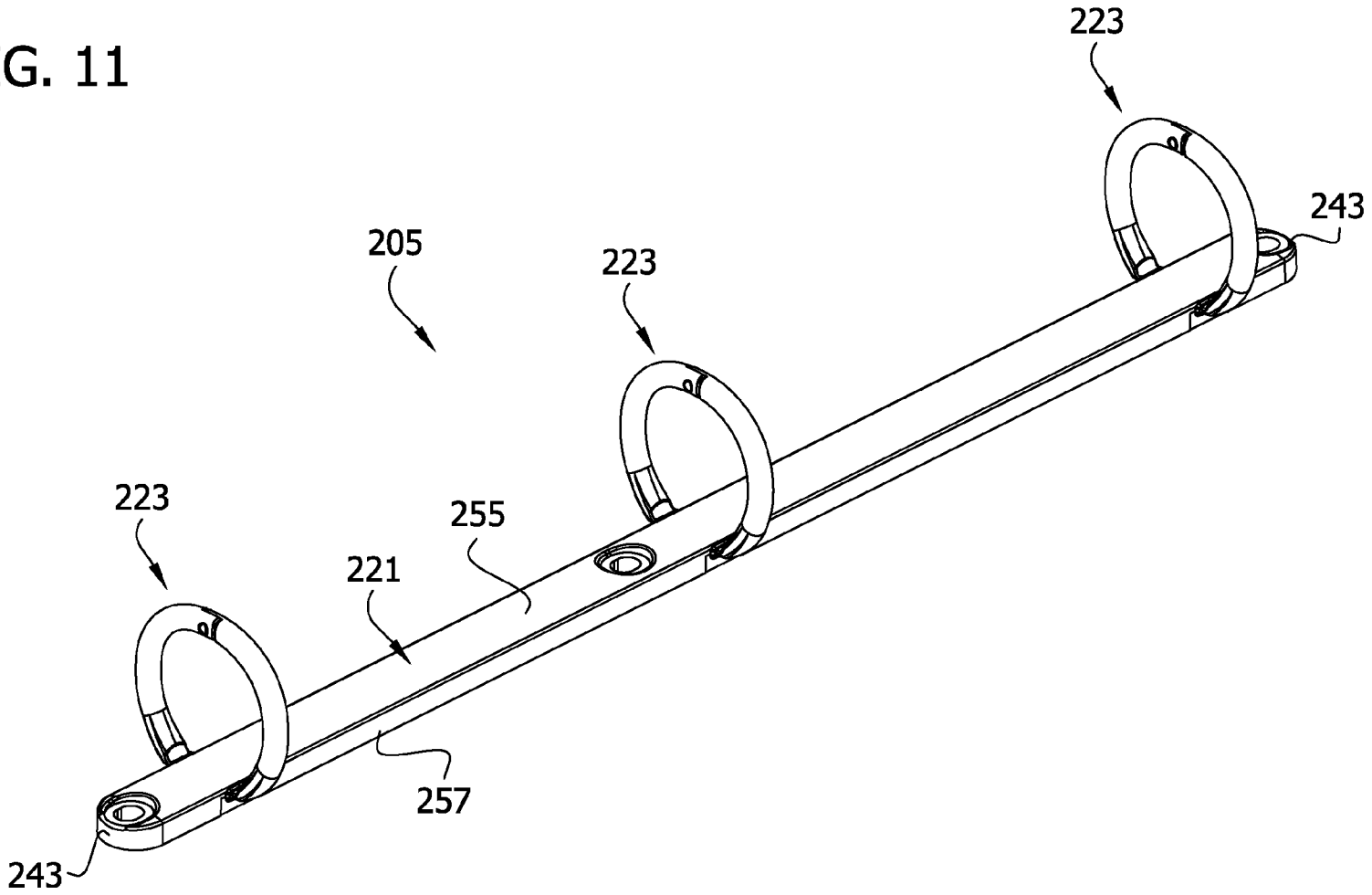
FIG. 11 is a perspective of a second embodiment of a ring mechanism.

Each ring 123 includes first and second ring members 125 extending from and supported by the elongate body 121. (References numbers for the ring members and other paired structures may include the suffixes "a" and "b" to indicate reference to a particular one of the paired structures, but the suffixes will be omitted when they do not add to the clarity of the description.) For example, the ring members 125 of each ring 123 suitably extend from opposite sides of the body 121, as illustrated in FIG. 1. At least the end portions 127 of the ring members 125 are moveable relative to one another between a closed position (FIG. 1) and an open position (FIG. 7). In the closed position, the ring members 125 together form a substantially continuous, closed loop for allowing loose leaf pages LLP (FIG. 10) retained by the rings 123 to be moved along the rings from one ring member 125*a* to the other 125*b*. In the open position (FIG. 7) the ring members 125 form a discontinuous, open loop for adding or removing loose-leaf pages from the ring 123.

The ring mechanism 105, including the body 121 and the ring members 125, is in an undeformed state when the ring members are in the open position (FIG. 7). Moreover, in the open position, the ring members 125 are positioned in generally the same way as the ring members of a conventional metal ring mechanism are in the open position. For example, in the open position, the ends 127 of the ring members 125 are suitably generally above the body 121. The ends 127 of the ring members 125 also extend generally inward toward one another when in the undeformed open position. Imaginary straight line projections 151 of the ends 127 of the ring members 125 intersect one another at an angle A (FIG. 8) in the open undeformed position that is greater than about 75 degrees, more suitably greater than about 85 degrees, more suitably greater than about 90 degrees, more suitably greater than about 120 degrees, and still more suitably at least about 150 degrees. The relatively large angle A facilitates transfer of loose-leaf pages from one ring member to the other when the rings are in the open position because the pages do not need to be reoriented much to transfer them between the ring members 125.

In the undeformed open position, the ends 127 are also spaced from one another a distance D1 (FIG. 8) that is sufficient to allow one or more loose-leaf pages (e.g., multiple pages stacked together) to be added and/or removed from the rings. As illustrated in FIG. 7, for example, there is suitably a substantially straight gap 135 extending longitudinally between the opposite ends 143 of the body 121 and between the ends 127 of the ring members 125 above the body when the rings are in the open undeformed position. In the illustrated embodiment, the width of the gap 135 is the same as the distance D1 between the ends 127 of the open undeformed ring members 125. In the open position, the gap 135 is void of any structure of the ring mechanism such that loose-leaf pages can be inserted edgewise into the gap between the ends 127 of the ring members 125 without deforming the ring members or bending the pages.

It is also desirable that the distance D1 between the ends 127 of the ring members 125 be small enough so a user can readily move loose-leaf pages across the gap 135 from one ring member to the other. The distance D1 between the ends 127 of the ring members in the undeformed open position can vary depending on the size of the rings 123. In general, the gap 135 between the ends 127 of the ring members is larger for larger rings and smaller for smaller rings. The distance D1 is generally between about 10 mm and about 45 mm. For example, the distance D1 between the ends 127 of the open ring members 125 is suitably selected from the group consisting of: (1) between about 10 mm and about 30 mm in the case of ring members having diameters of no more than about 1 inch (or having equivalent loose-leaf retaining capacity in the case of non-circular rings); (2) between about 13 mm and about 35 mm in the case of rings having diameters ranging from about 1.0 inch to about 1.5 inches (or having equivalent loose-leaf retaining capacity in the case of non-circular rings); (3) between about 16 mm and about 40 mm in the case of rings having diameters ranging from about 1.5 inches to about 2.0 inches (or having equivalent loose-leaf retaining capacity in the case of non-circular rings); and (4) between about 20 mm and about 45 mm in the case of rings having diameters greater than about 2 inches.

At least one of the ring members 125 of each ring 123 is resiliently deformable to move the rings from the open position (FIG. 7) to the closed position (FIG. 1). As illustrated each ring member 125 for each ring 123 is deformable and moves relative to the body 121 to move the rings between the open and closed positions. For example, each of the ring members 125 is suitably constructed so it has a relatively flexible segment 133 adjacent the body 121 supporting a relatively less flexible segment 131 extending to the end 127 of the ring member. In the illustrated embodiment, the flexible segment 133 is a relatively thin flat segment of the ring member 125 extending from a side 147 of the body 121 and forming a hinge connection (e.g., a "living hinge") between the body 121 and the relatively stiffer segment 131.

Figure 6:
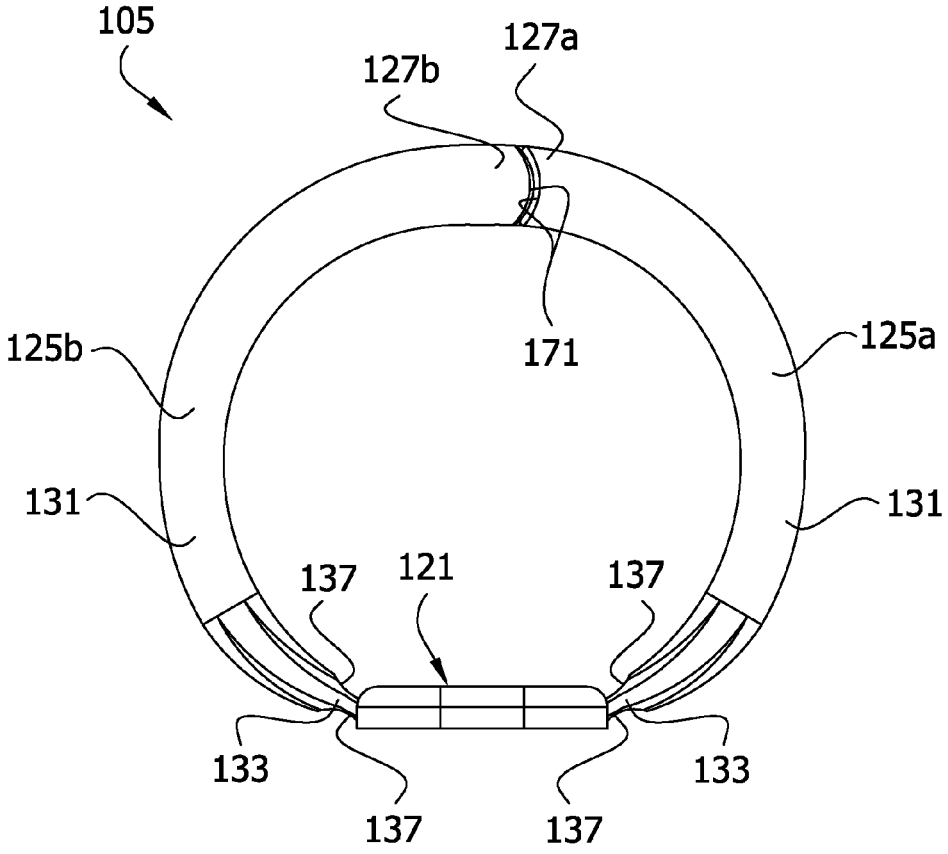
FIG. 6 is a rear end elevation of the ring mechanism.

The flexibility of the segments 131, 133 of the ring members can be controlled by varying the size and shape of the ring members 125 in cross section as they extend between the body 121 and ends 127. As illustrated, the flexible segments 133 of the ring members 125 include a thinned section having a thickness T2 (FIG. 5) at its thinnest location that is less than the thickness T1 of the body 121. As illustrated in FIG. 6, the flexible segments are associated with arcuate notches 137 that produce a more rapid rate of thinning adjacent the stiffer segments 131 and a reduced rate of thinning adjacent the part of the flexible segment having the minimum thickness.

Figure 6A:
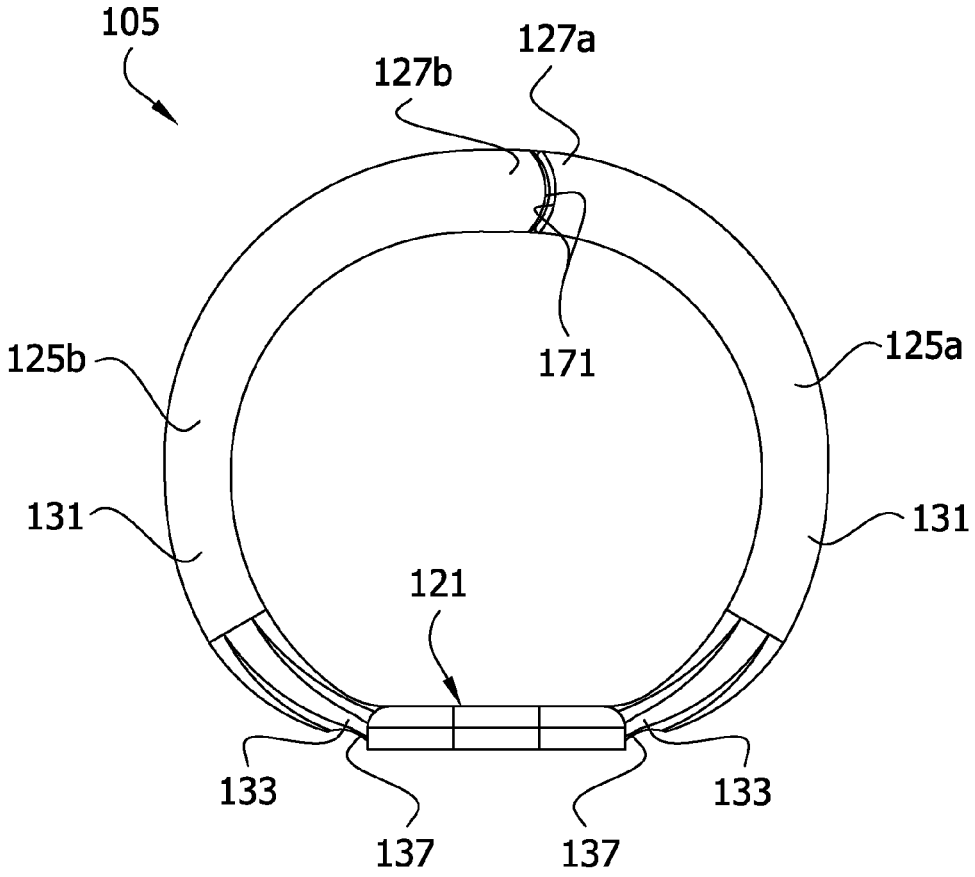
FIG. 6A is a rear end elevation of the ring mechanism similar to FIG. 6, but showing one embodiment of an alternate construction of the ring members adjacent the body of the ring mechanism.

Each thinned section can be associated with arcuate notches 137 above and below the thinned section, as illustrated in FIG. 6. The thinned section can also be associated with a single arcuate notch. For example, the flexible segments 133 can have a single arcuate notch 137 below the thinned section so the upper portion of the thinned section is flush with the upper surface of the body 121, as illustrated in FIG. 6A. It may be desirable to make the upper surface of the flexible segment 133 flush with the upper surface of the body 121 to reduce the risk that loose-leaf pages may get caught or torn as they slide along the inner surface of the rings 123. It is understood that the arcuate notches described and illustrated herein are one way to obtain a relatively flexible thinned ring section and that there are other ways to make a flexible ring member portion within the scope of the invention. It is also understood that arcuate notches 137 are not required to produce a flexible portion of the ring members.

Figure 5:
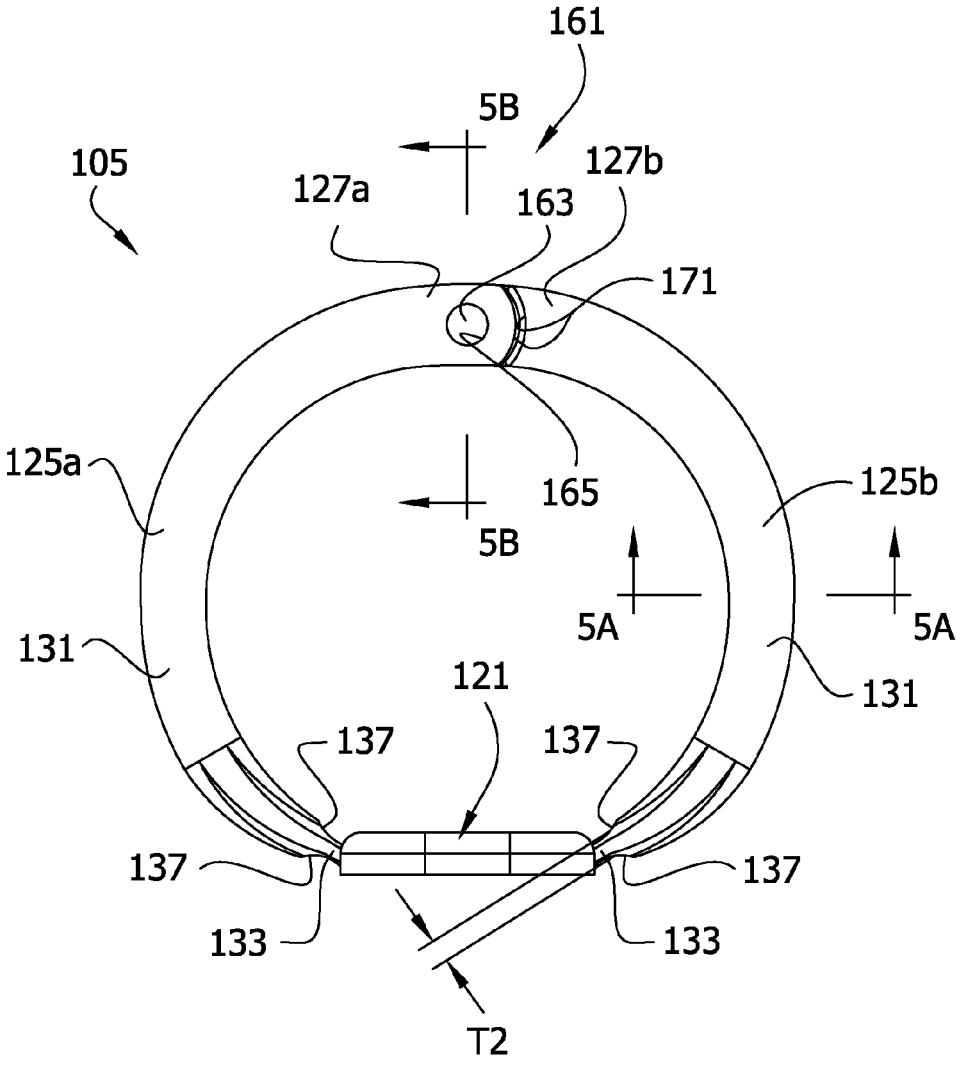
FIG. 5 is a front end elevation of the ring mechanism.
Figure 5A:
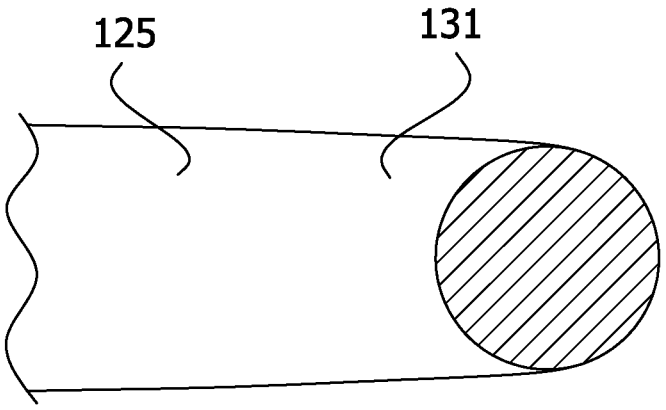
FIG. 5A is a cross section of one of the ring members of the ring mechanism taken in a plane including line 5A-5A on FIG. 5 showing a cross sectional shape of the ring member.

The cross sectional shape of each ring member 125 is substantially constant along the length of at least a majority of the relatively stiffer segment 131. In particular, each ring member 125 has a segment having a substantially constant cross sectional shape that has a continuously smoothed perimeter (e.g., substantially circular, elliptical, or oval), as illustrated in FIG. 5A, along an arc length of at least about 25 mm for a 1 inch ring, at least about 35 mm for a 1.5 inch ring, at least about 48 mm for a 2 inch ring, and at least about 74 mm for a 3 inch ring. The inventors have determined that using a substantially circular cross sectional shape for a relatively long segment of each ring member 125 is desirable because this shape minimizes surface area and limits loss of heat and pressure during the molding process. This facilitates production of high quality parts while allowing the time required per cycle of the injection molding apparatus to be reduced. Also, because the cross sectional shape is continuously smoothed around its perimeter (e.g., substantially circular), the cross sectional shape lacks edges or corners that could increase wear or otherwise damage loose-leaf pages as they are moved along the rings 123 and allows papers to move more smoothly along the rings. The portion of the relatively stiff segment 131 adjacent the flexible portion 133 transitions gradually and smoothly from the substantially circular cross sectional shape to the shape of the flexible portion of the ring segment.

To move the ring members 125 to the closed position, the ring members are resiliently deformed as illustrated in FIG. 9 to form a closed ring (e.g., by bending the ends 127 in toward one another (FIG. 9(*a*)) until the ends meet or overlap (FIG. 9(*b*)). As evident by comparison of the ring members 125 in FIG. 8 (open position) to FIG. 5 (closed position), it will be noted the bending of the ring members 125 is concentrated at the relatively thin portion of the flexible segment 133 of the ring members 125. When in the closed position (FIG. 9(*c*)), the ring members 125 are biased by internal elastic restoration forces therein to move toward the open position.

A retaining system 161 (FIGS. 5 and 7-9) is operable to selectively and releaseably hold the ring members 125 in the closed position against the bias of the elastic restoration forces in the ring members. In the illustrated embodiment, the retaining system 161 includes a formation 163 on the end 127*b* of one ring member 125*b* operable to engage a formation 165 on the end 127*a* of the other ring member 125*a* such that the formations 163, 165 limit relative movement between the ends 127 of the ring members 125 away from the closed position. As illustrated, for example, the first formation 163 is suitably includes a post extending from the end 127*b* in a direction generally parallel to the longitudinal axis of the body 121 and the second formation 165 includes an opening extending through the end 127*a* in a direction extending generally parallel to the longitudinal axis of the body and operable to releasably capture the post when the post is inserted into the opening.

To move the rings to the closed position, the ring members are deformed to bring the ends 127 of the opposing ring members into overlapping position with one another so the post 163 on the first end 127*b* is aligned with the opening 165 in the other end 127*a*, as illustrated in FIG. 9(*b*). Then the ends 127 of the ring members are moved to insert the post 163 into the opening 165 in a direction generally parallel to the longitudinal axis of the body 121. The post 163 and opening 165 are suitably sized and shaped so friction between the post and opening resists withdrawal of the post from the opening. For example, the opening 165 and post 163 can be dimensioned and tolerance to result in an interference fit. The engagement between the post 163 and the edge of the opening 165 obstructs movement of the ring members to separate the ends 127 of the ring members as long as the post remains in the opening.

Figure 5B:
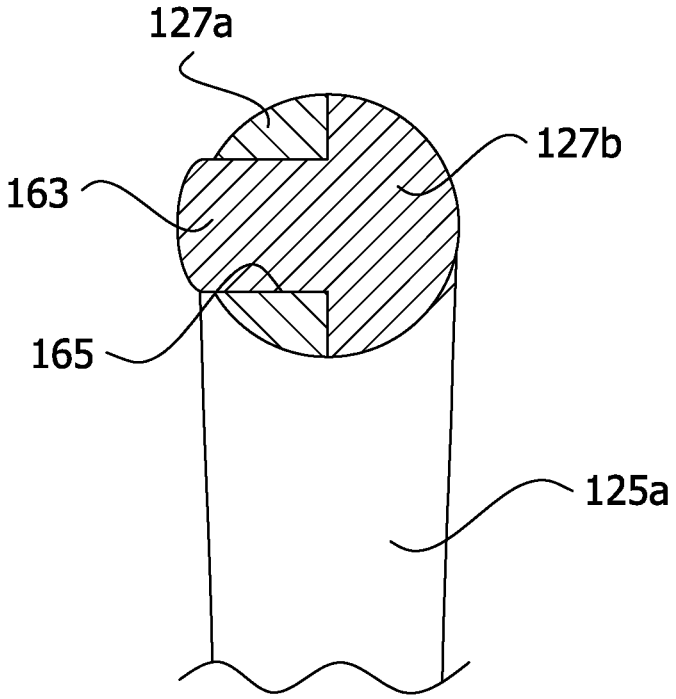
FIG. 5B is a cross section of one of the rings of the ring mechanism taken in a plane including line 5B-5B on FIG. 5 showing a cross sectional shape of the ends of the ring members when the rings are closed.

The ends 127 of the ring members 125 are also shaped so the facing surfaces 171 of the opposite ends are substantially flush with one another and any gaps between the facing surfaces of the ring members are minimal to limit the opportunity for loose leaf pages to catch on the retaining system as the pages are moved from one ring member to the other. Also, the cross sectional shape of the overlapping portions of the ends 127 of the ring members 125 (FIG. 5B) in the closed position is continuously smoothed along its perimeter (e.g., substantially circular) except for the minimal gaps between the ring members. Further, the cross sectional shape of the collective ends 127 of the ring members 125 in the closed position (FIG. 5B) is similar to the cross sectional shape (FIG. 5A) of each ring member along the segment having the constant cross sectional shape. The overall cross sectional shape of the closed rings in the illustrated embodiment is substantially constant from the relatively stiffer segment 131*a* of one ring member 125*a*, over the overlapping ends 127 and retaining system 161, all the way to the relatively stiffer segment 131*b* of the opposing ring member 125*b*.

To open the rings, the ends 127 of the ring members 125 are moved away from one another generally parallel to the longitudinal axis of the body 121 (FIG. 9(*d*)) to withdraw the post 163 from the opening 165 and disconnect the ends 127 of the ring members from one another. Once the ends 127 of the ring members 125 are disconnected, the elastic restoration forces within the ring members and/or a force exerted by a user move the ring members back to their open position. Because forces acting generally parallel to the longitudinal axis of the body 121 are required to disconnect the ends 127 of the ring members 125 from one another, the retaining system 161 is resistant to unintentional opening of the rings 123 due to forces exerted by loose-leaf pages retained by the rings. The weight of loose-leaf pages retained by the rings 123 sometimes exerts a force on the rings pulling one or more of the ring members 125 radially outward toward the open position. The inventors have recognized it is much less likely during ordinary use of the ring mechanism 105 that the weight of loose-leaf pages retained by the rings 123 will exert a force on the rings tending to pull the ends 127 of the ring members apart in a direction generally parallel to the longitudinal axis of the body 121 of the ring mechanism. For example, it is unlikely the weight of loose-leaf pages could be applied to the end 127 of one of the ring members 125 pulling this end in one longitudinal direction while the end of the other ring members is held or pulled in the opposite longitudinal direction. Instead, it is likely that any longitudinal force applied to the end 127 of one ring member 125 by the weight of loose-leaf pages will also be applied to the end of the other ring member, tending to move the ends of the ring members conjointly so they remain connected rather than become separated. Accordingly, the retaining system 161 can advantageously be designed to allow a user who intends to open the rings 123 to do so with relatively little effort, while at the same time providing substantial resistance to unintentional opening of the rings by the weight of loose-leaf pages retained by the rings.

Figure 12:
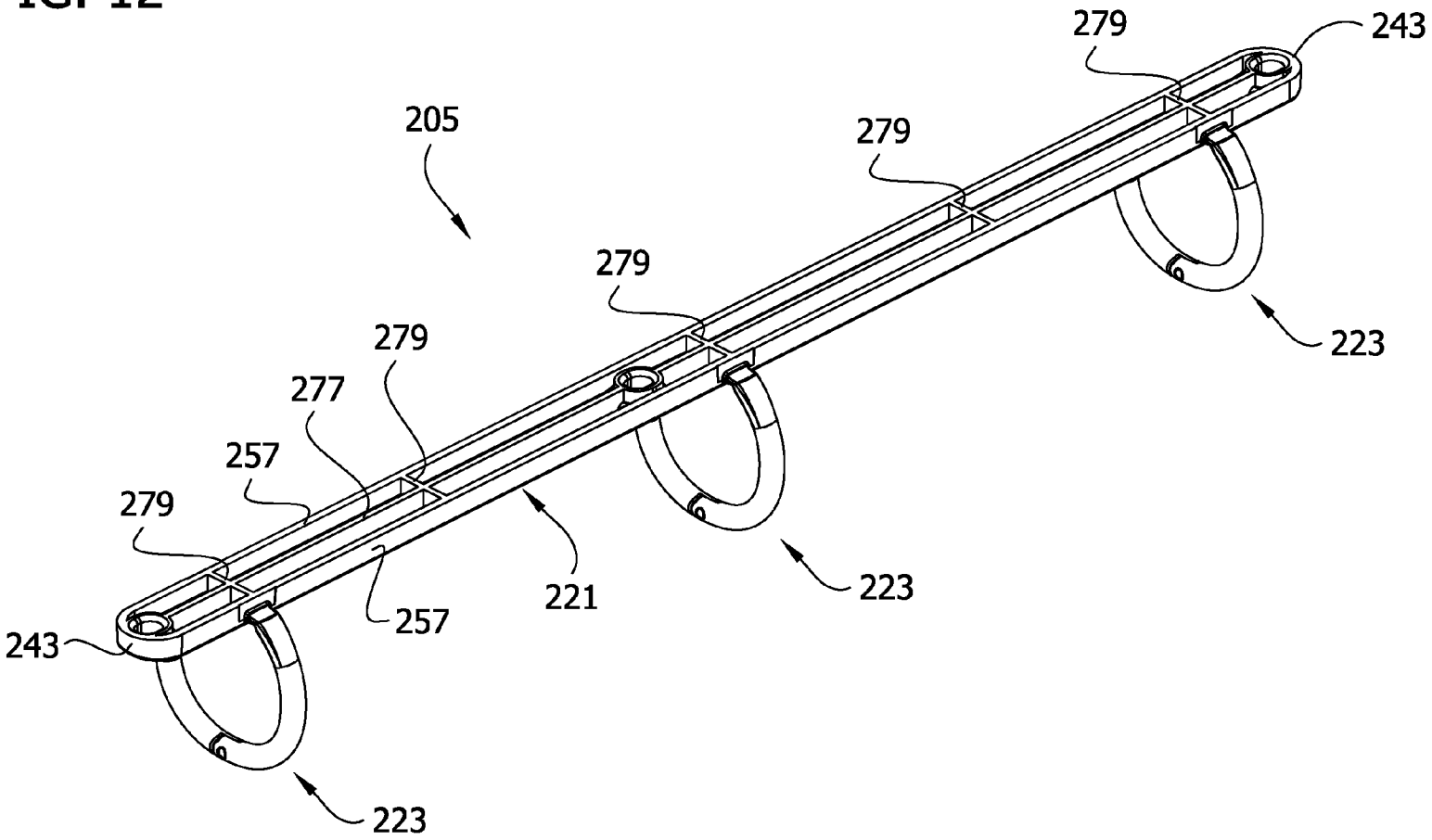
FIG. 12 is another perspective of the ring mechanism of FIG. 11 from a vantage point in which a bottom of the ring mechanism is visible.
Figure 13:
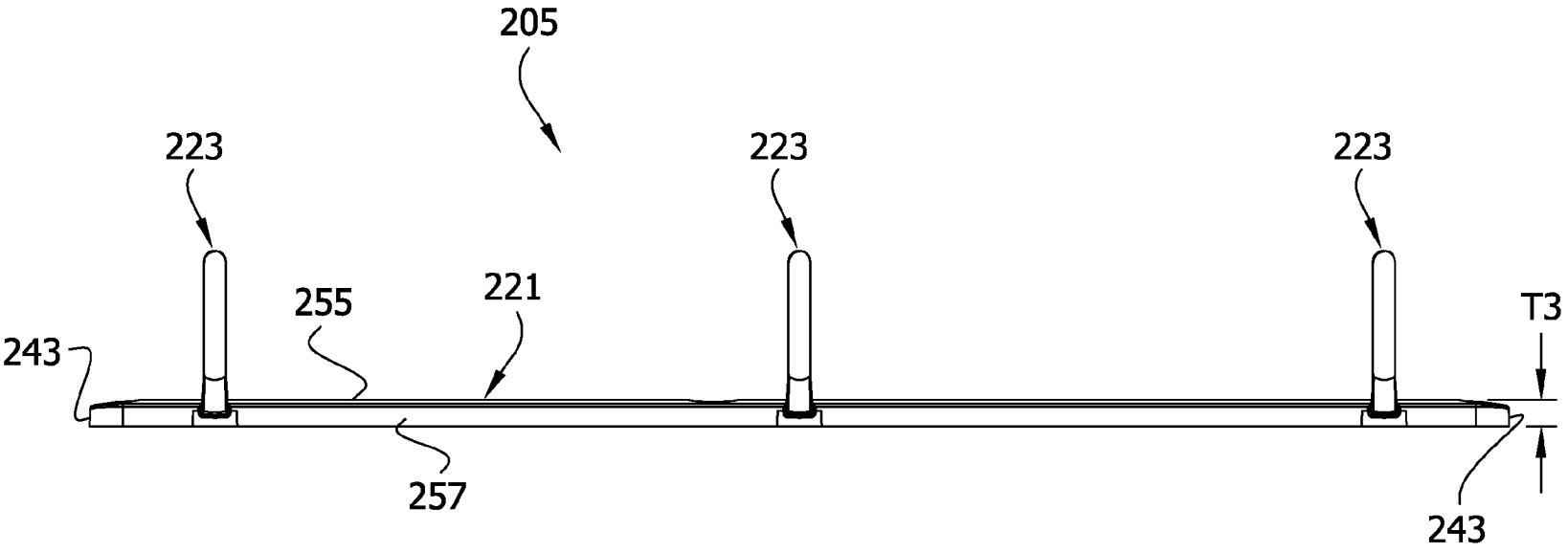
FIG. 13 is a side elevation of the ring mechanism illustrated in FIGS. 11-12.
Figure 14:
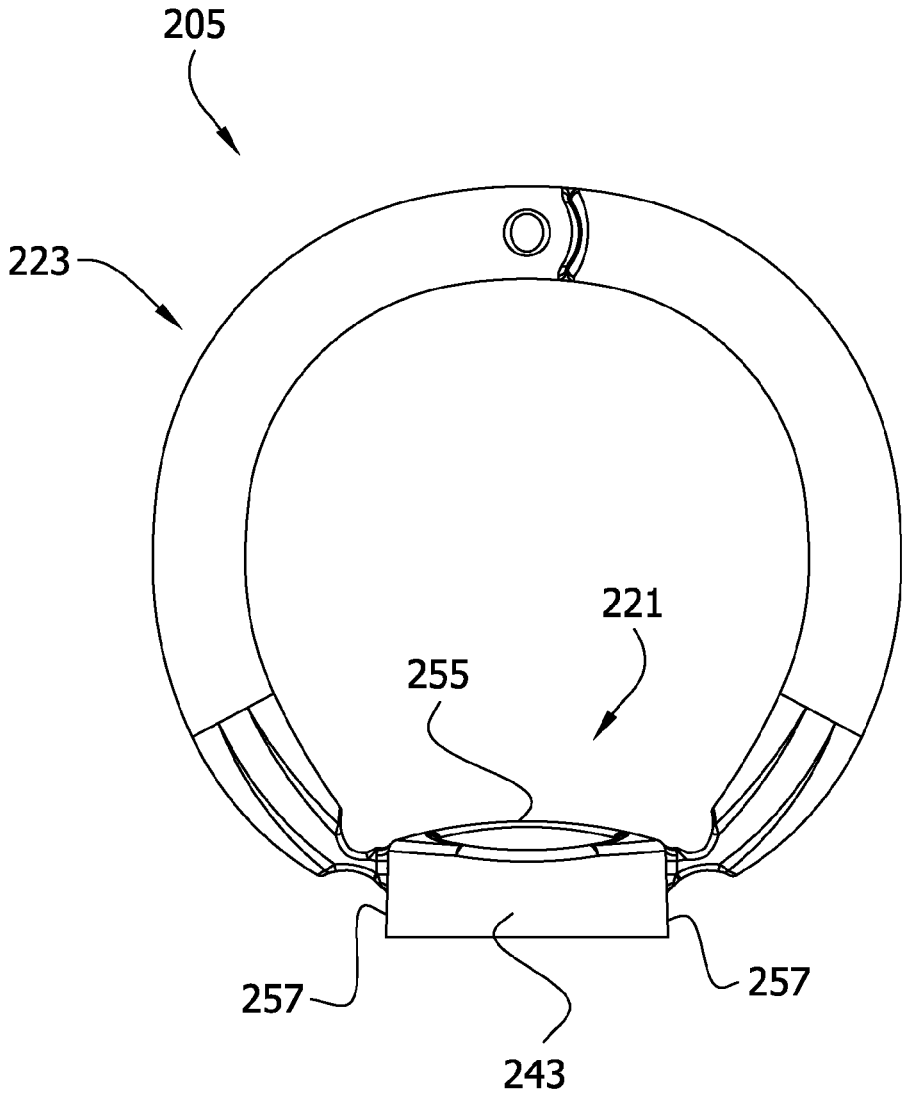
FIG. 14 is a front end elevation of the ring mechanism illustrated in FIGS. 11-13 with the rings in the closed position.
Figure 15:
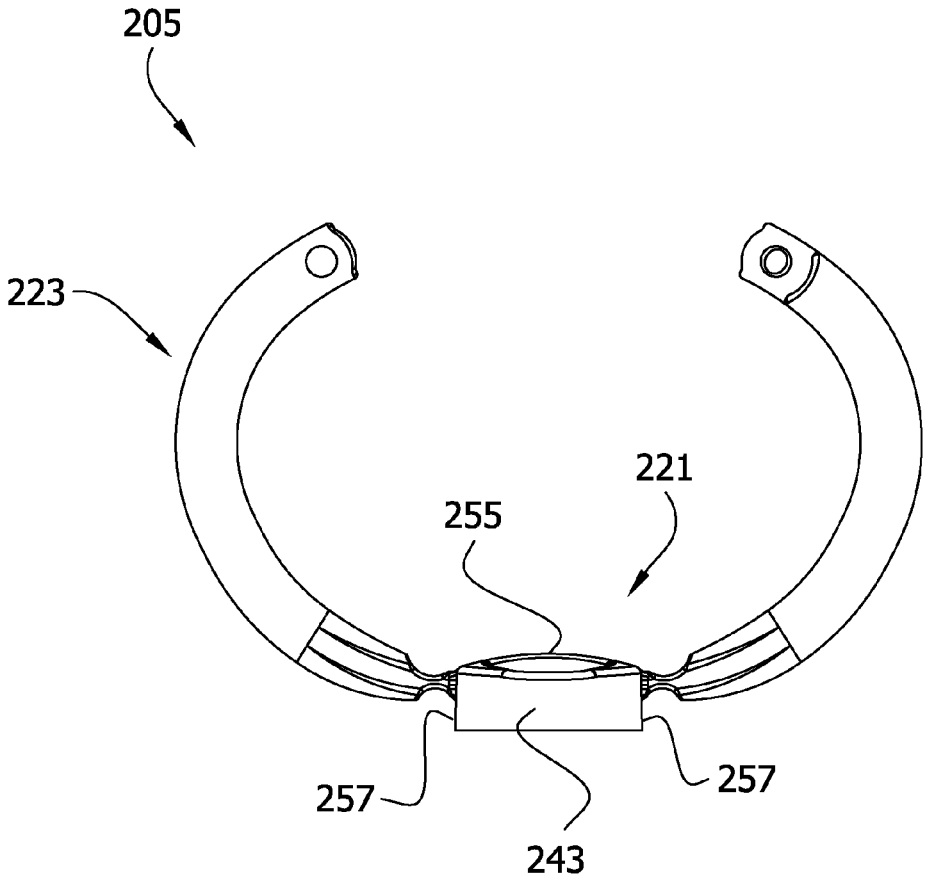
FIG. 15 is a front end elevation of the ring mechanism illustrated in FIGS. 11-14 with the rings in the open position.
Figure 16:
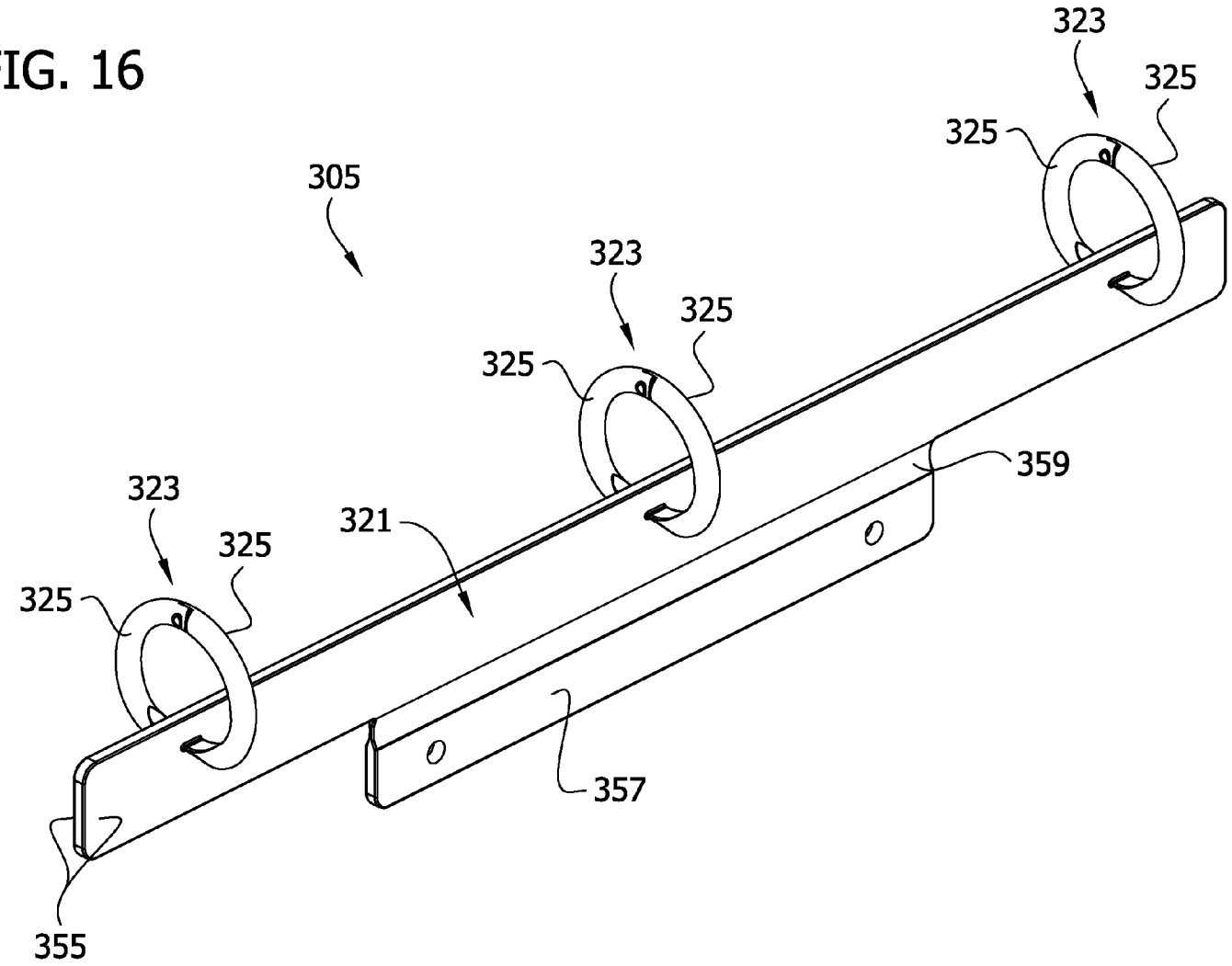
FIG. 16 is a perspective of a third embodiment of a ring binder mechanism.
Figure 17:
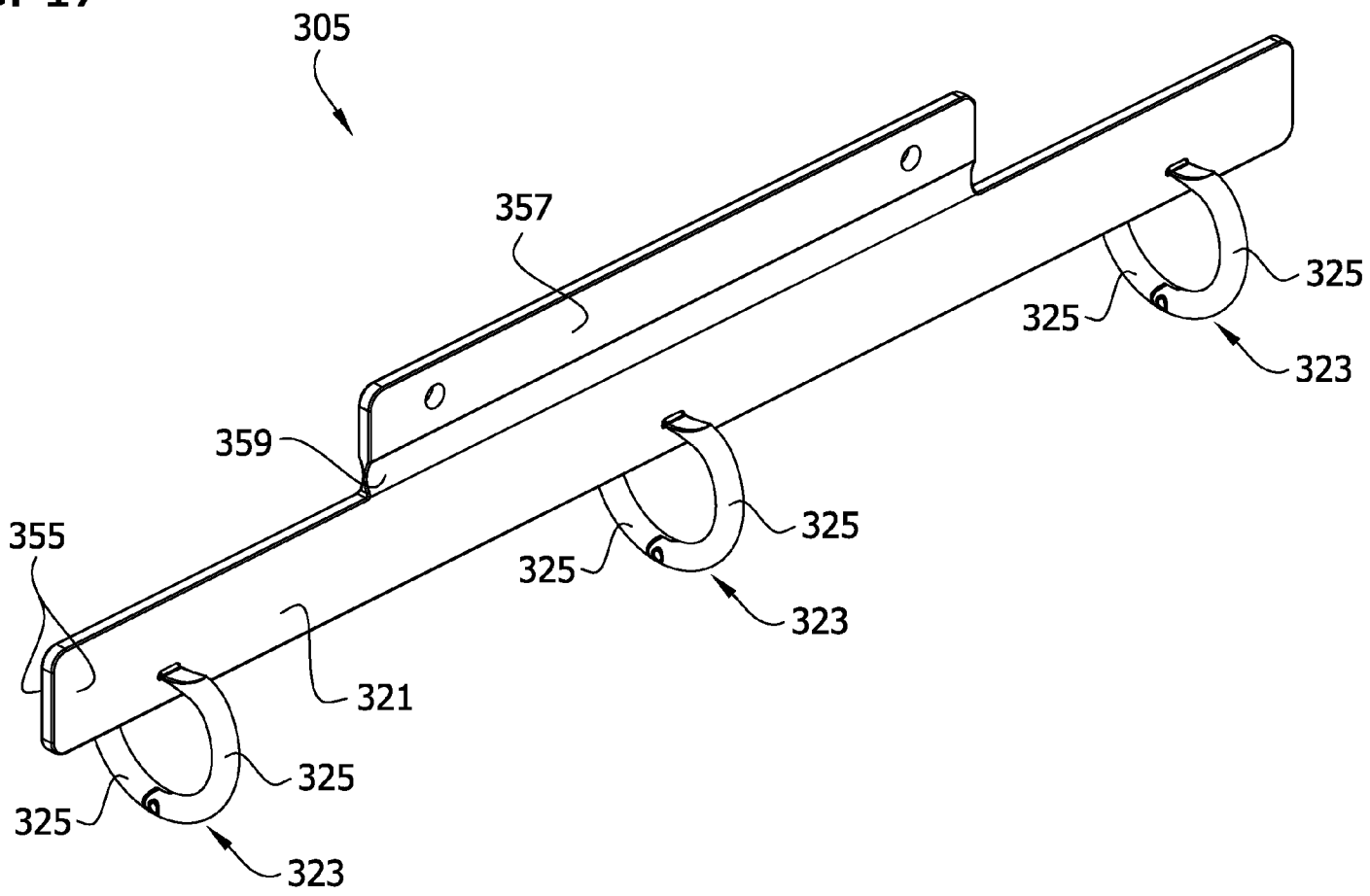
FIG. 17 is another perspective of the ring binder mechanism of FIG. 16 inverted from the position shown in FIG. 16.
Figure 18:
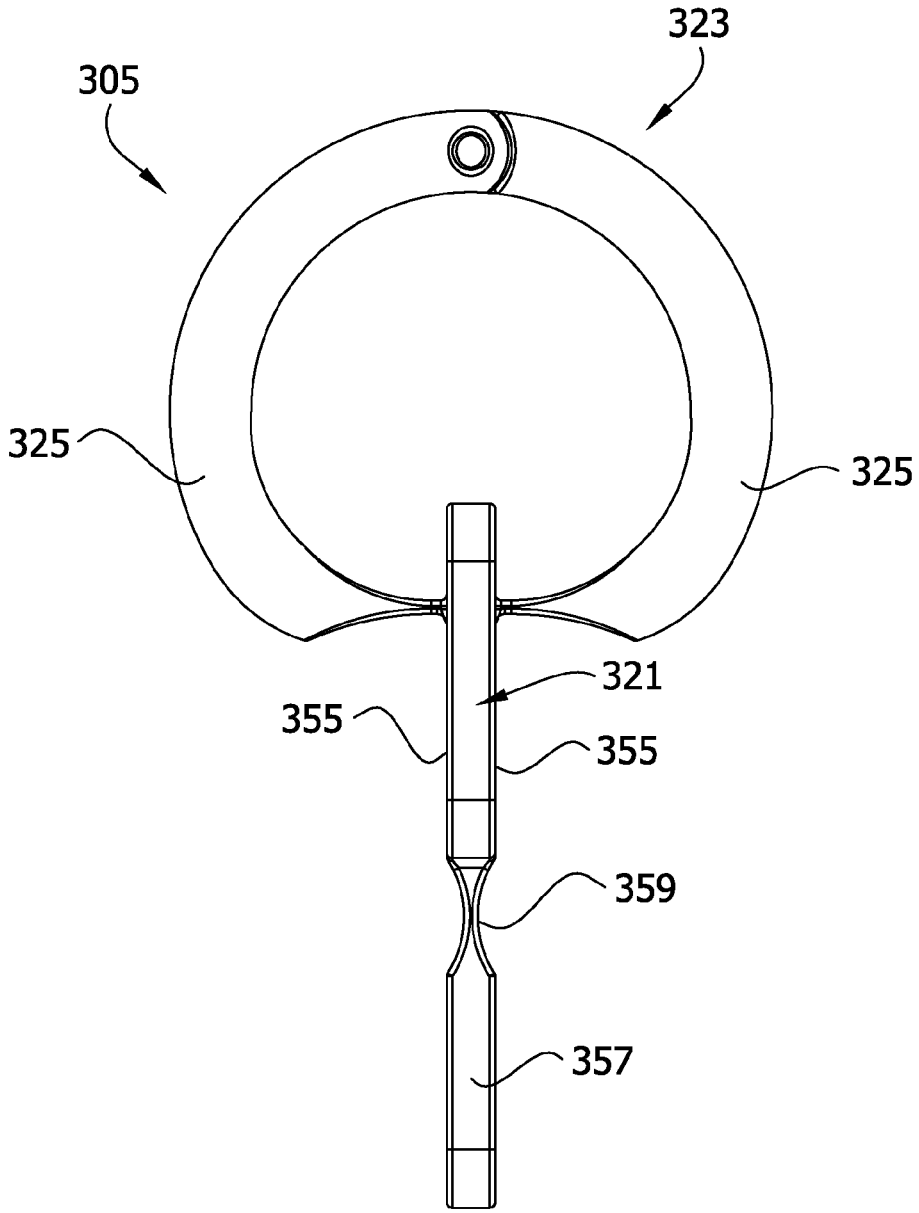
FIG. 18 is a front end elevation of the ring binder mechanism illustrated in FIGS. 16-17.
Figure 19:
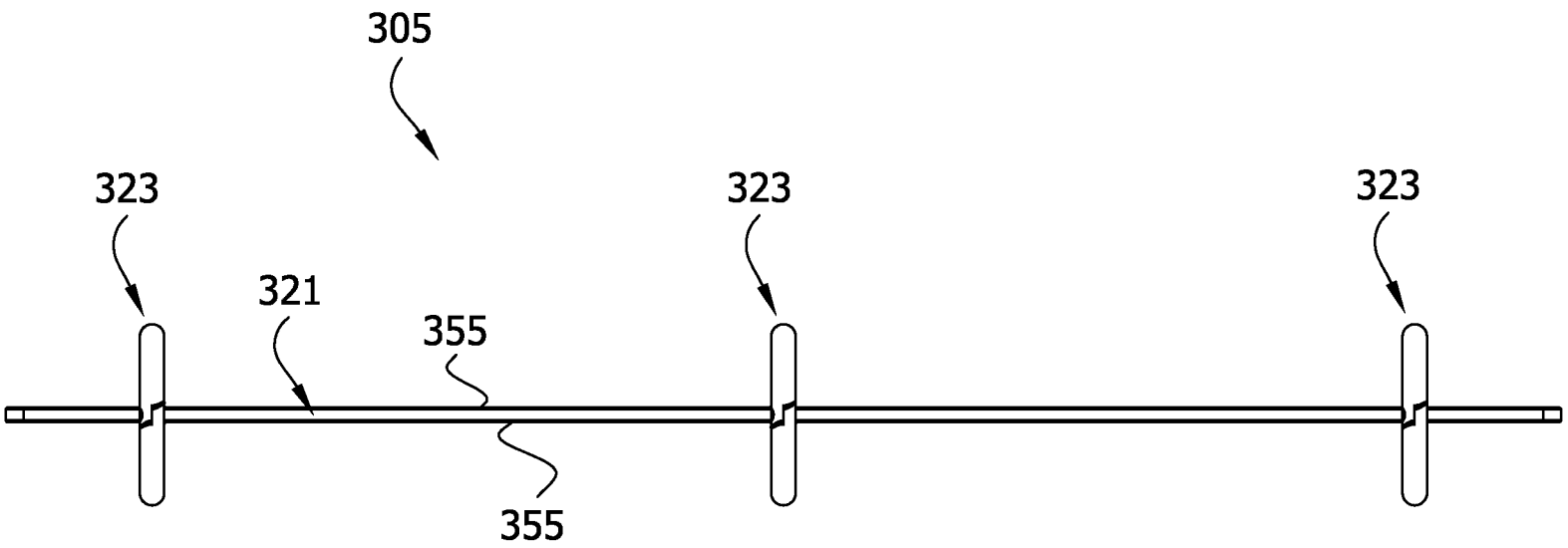
FIG. 19 is a top plan view of the ring binder mechanism illustrated in FIGS. 16-18.
Figure 20:
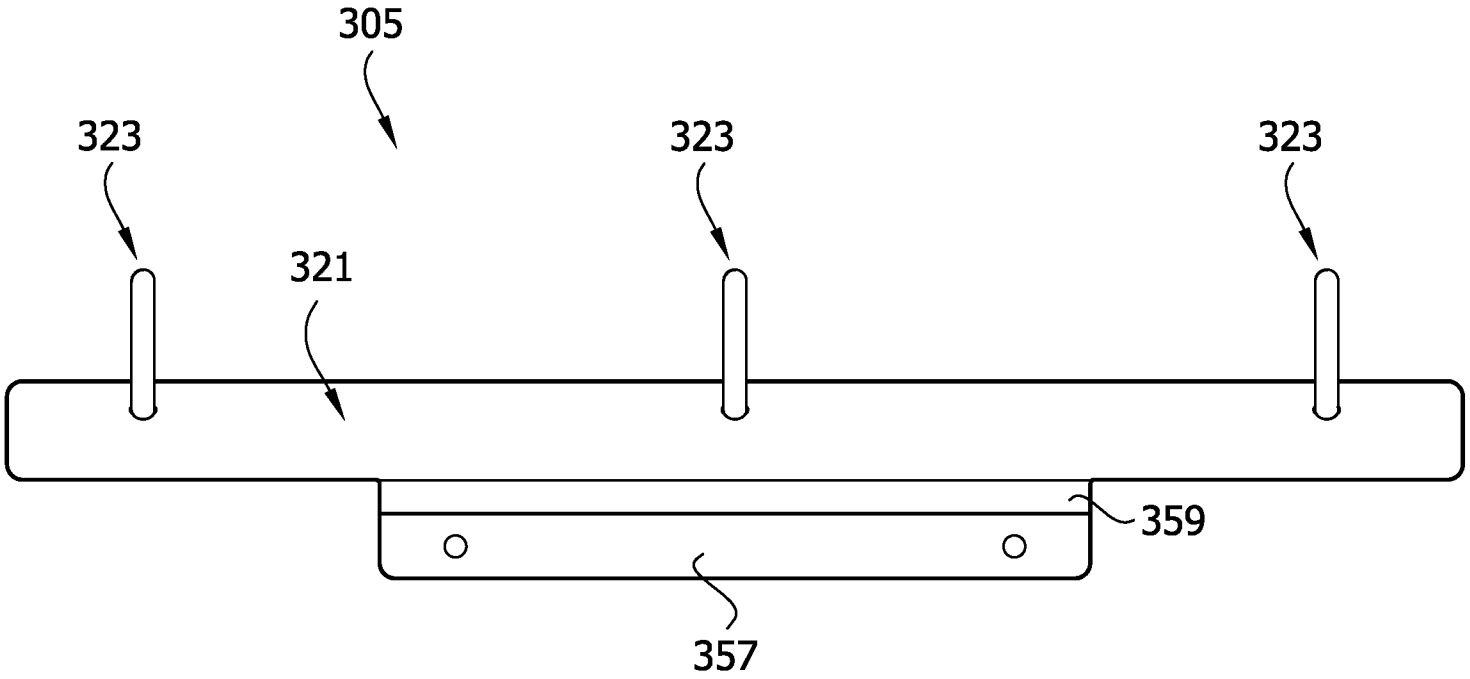
FIG. 20 is a side elevation of the ring binder mechanism illustrated in FIGS. 16-19.
Figure 21:
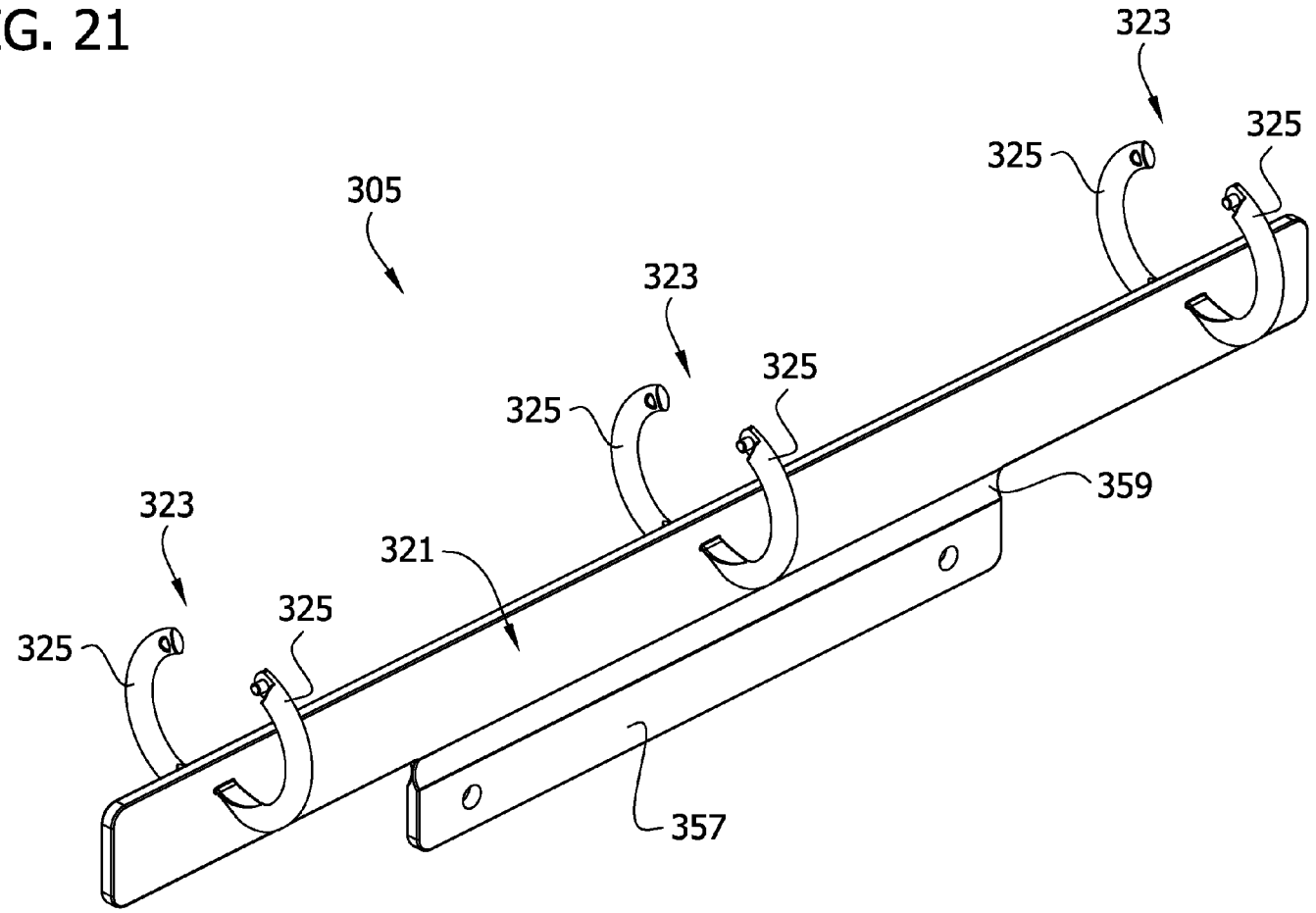
FIG. 21 is a perspective of the ring binder mechanism similar to FIG. 16, but with the rings in an open position.
Figure 22:
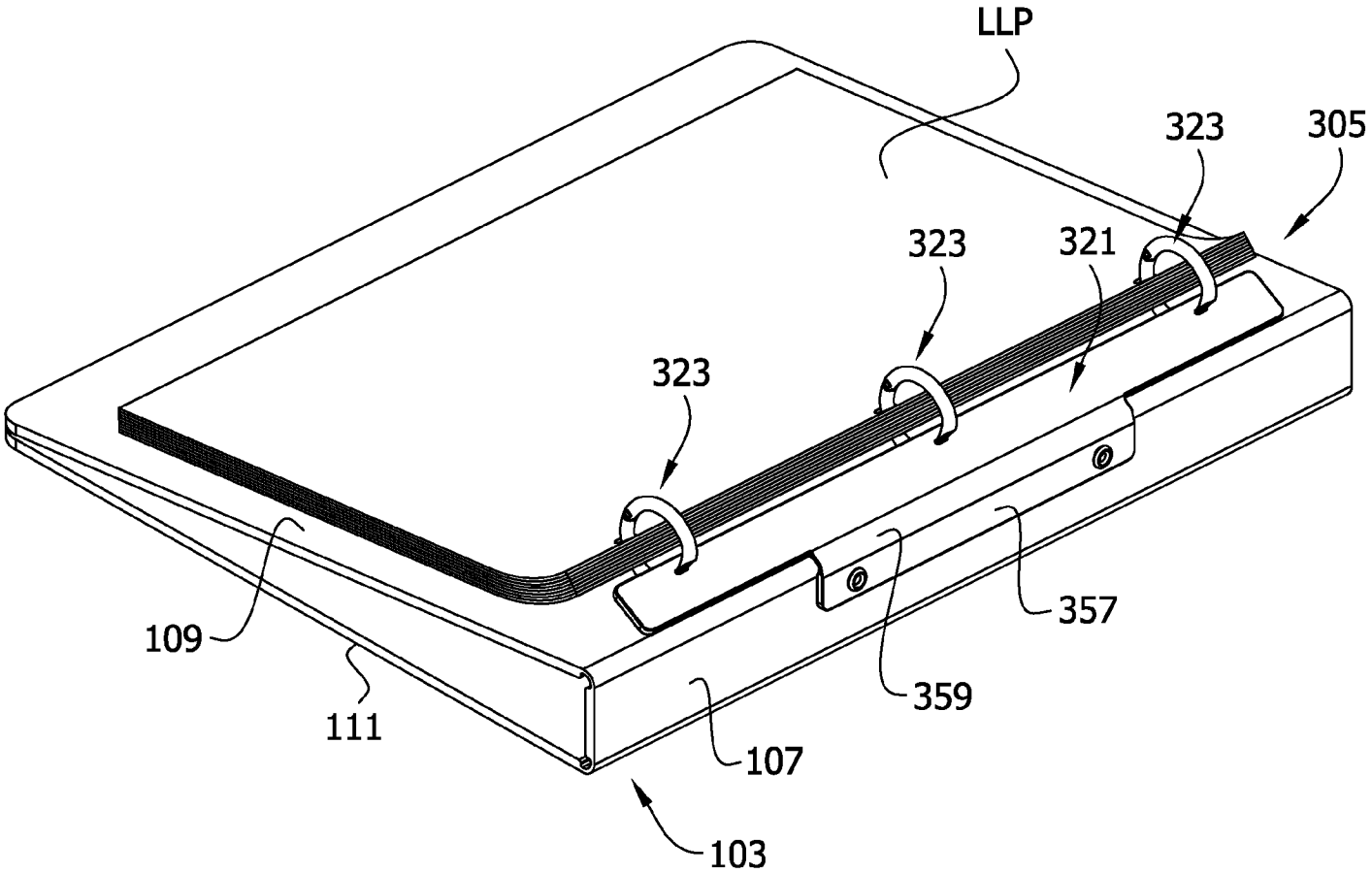
FIGS. 22 and 23 are perspectives of the ring binder mechanism illustrated in FIGS. 16-21 mounted on a notebook cover and retaining loose-leaf pages in various positions.
Figure 23:
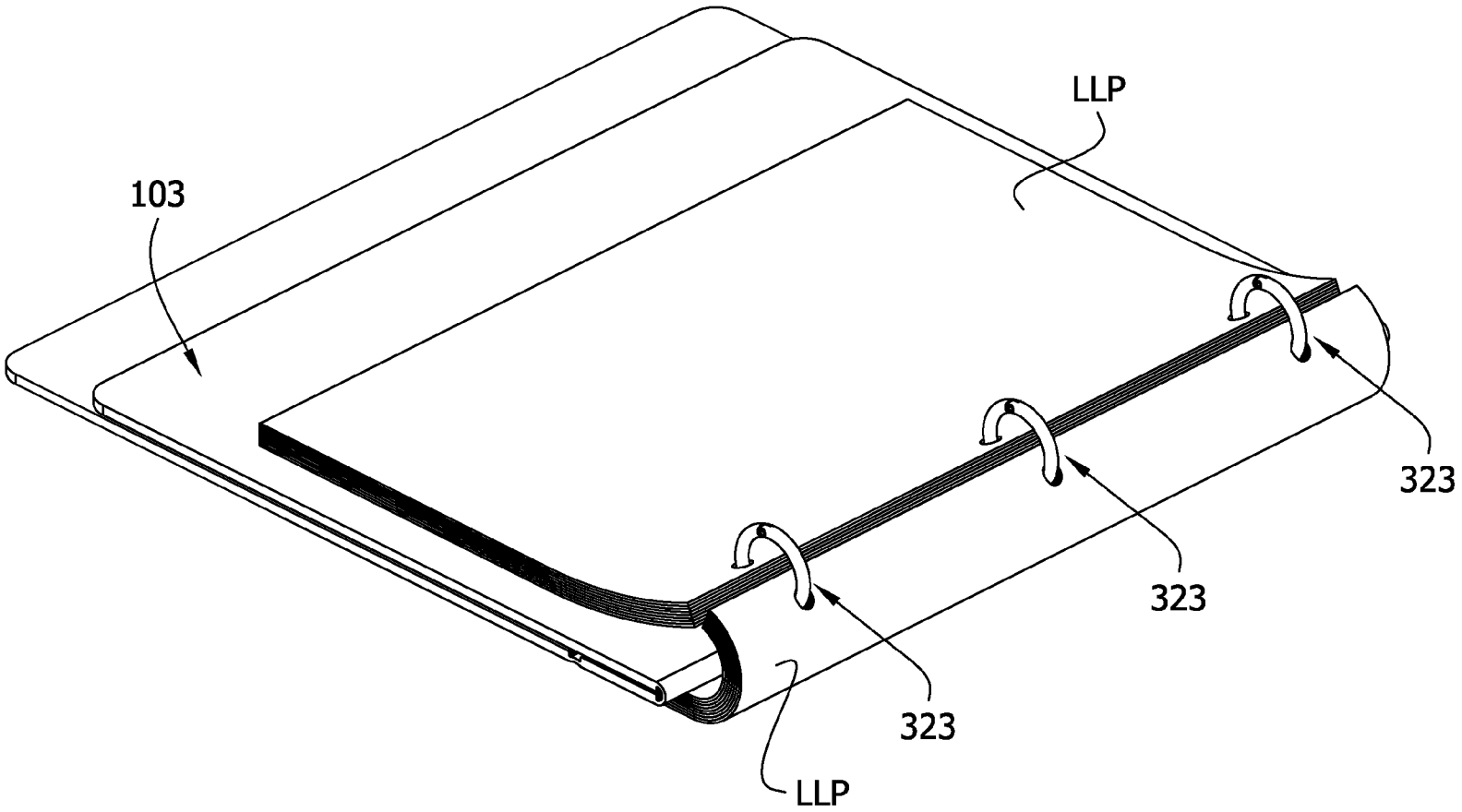

FIGS. 11-15 show a second embodiment of a ring binder mechanism 205. This embodiment is substantially similar to the embodiment 105 described above and illustrated in FIGS. 1-10, except as noted. As illustrated in FIG. 13, the body 221 of this ring binder has an overall thickness T3 that is greater than the overall thickness T1 of the body described above. Further, the body 221 has a top 255 and sides 257 extending down from the top. The body 221 is also reinforced with ribs 275 (FIG. 12). In particular, the body 221 has one longitudinal rib 277 extending along the central axis of the body. The longitudinal rib 277 extends all the way between the opposite rounded ends 243 of the body 221. The body 221 also includes a series of cross ribs 279 extending between the sides 257 of the body and generally perpendicularly to the longitudinal rib 277. There is a cross rib 279 at the same axial position along the body as each of the rings 223, which are constructed in substantially the same ways as the rings 123 described above. As illustrated, there is also a cross rib 279 positioned axially along the body between the rings 223 (e.g., at the midpoints between the rings). The ribs 277, 279 and sides 257 of the body 221 provide a more robust construction for applications in which the more robust construction is more desirable than the increased capacity of the ring binder mechanism 105 described above resulting from the thinner body 121. The ribbed construction of the body 221 also uses less material than would be required for a solid construction body having the same strength.

Figure 24:
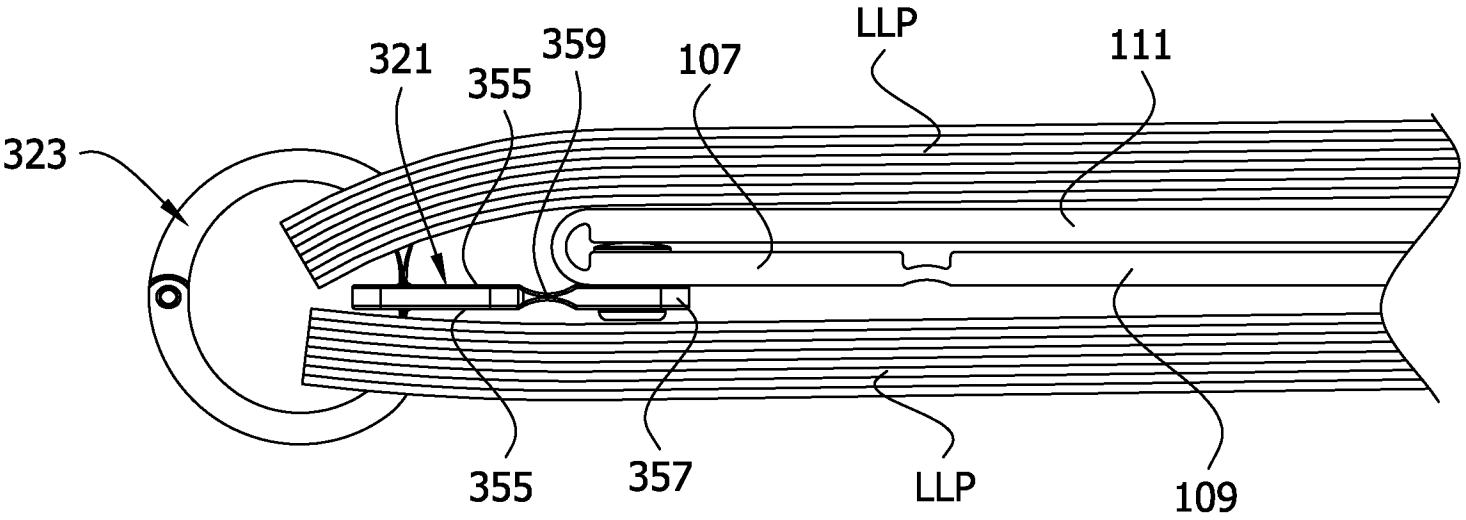
FIGS. 24-27 are front elevations showing the ring binder mechanism and notebook cover illustrated in FIGS. 22-23 supporting loose-leaf pages in various different positions.
Figure 25:
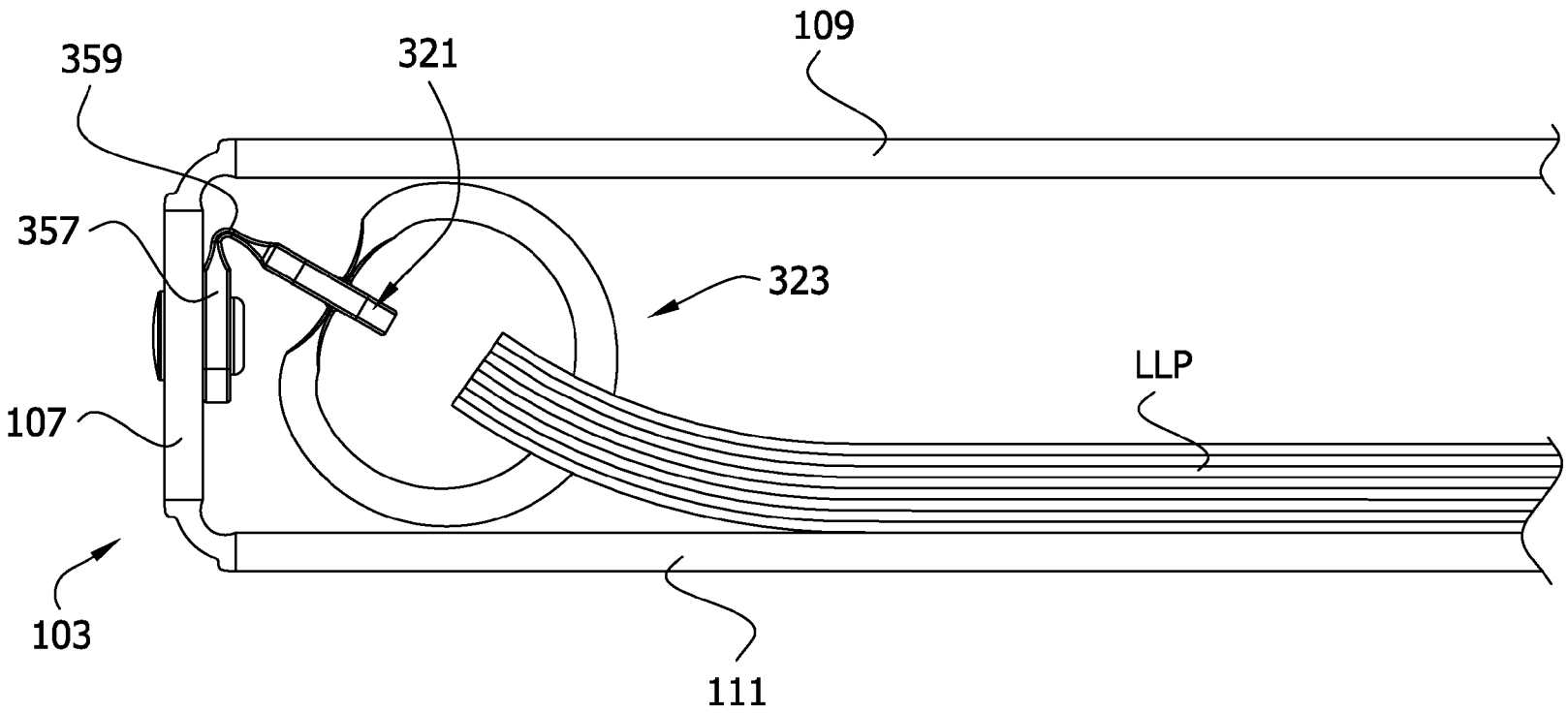
Figure 26:
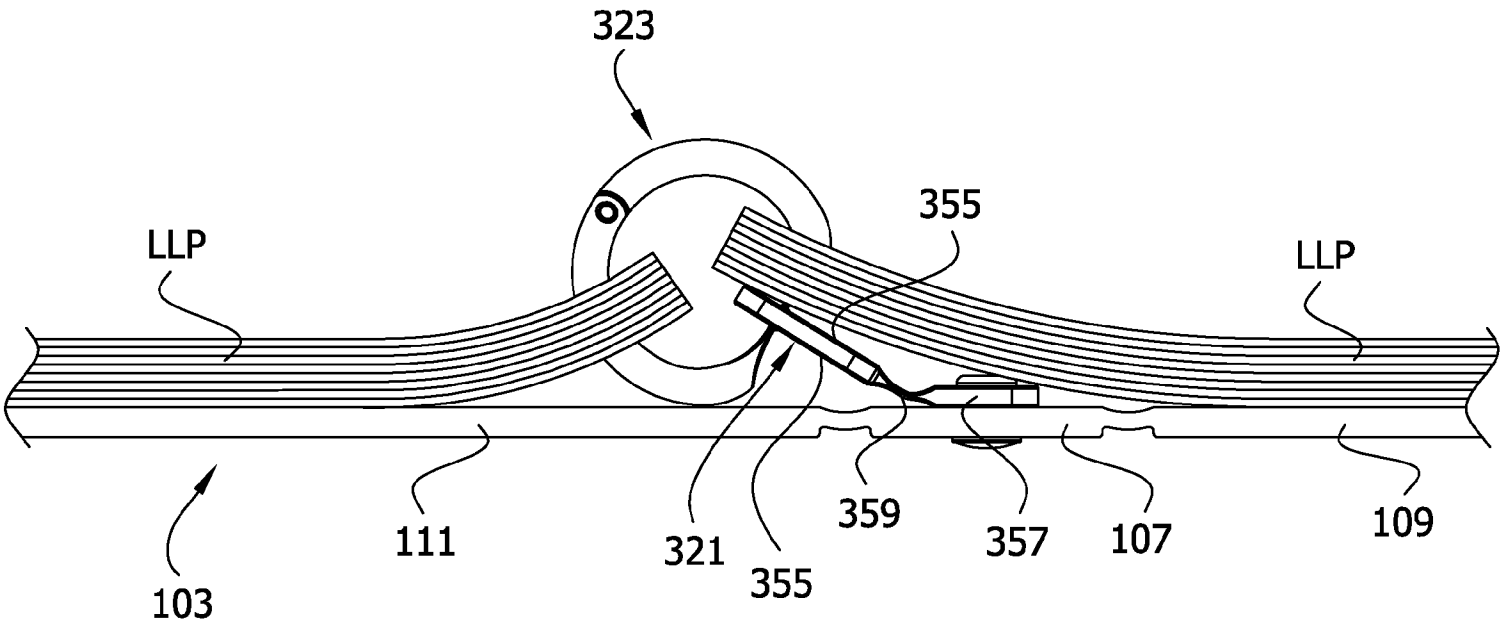
Figure 27:
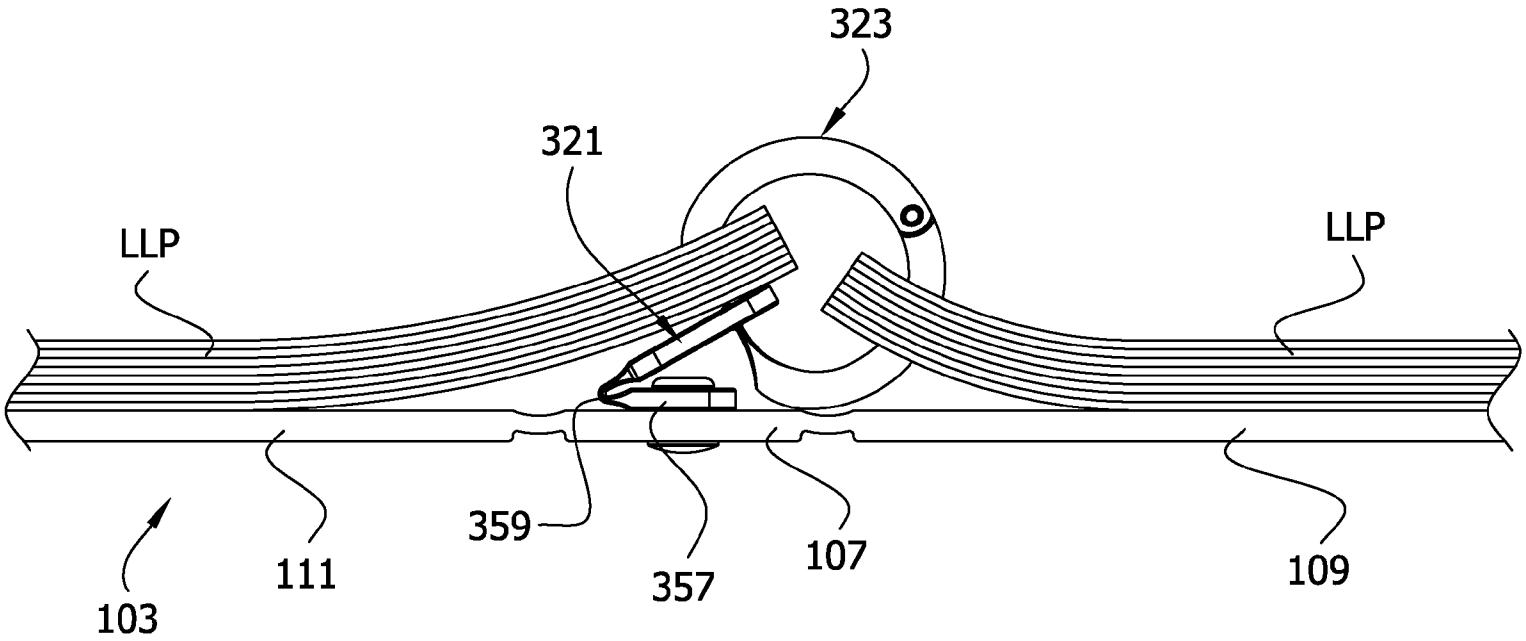
Figure 28:
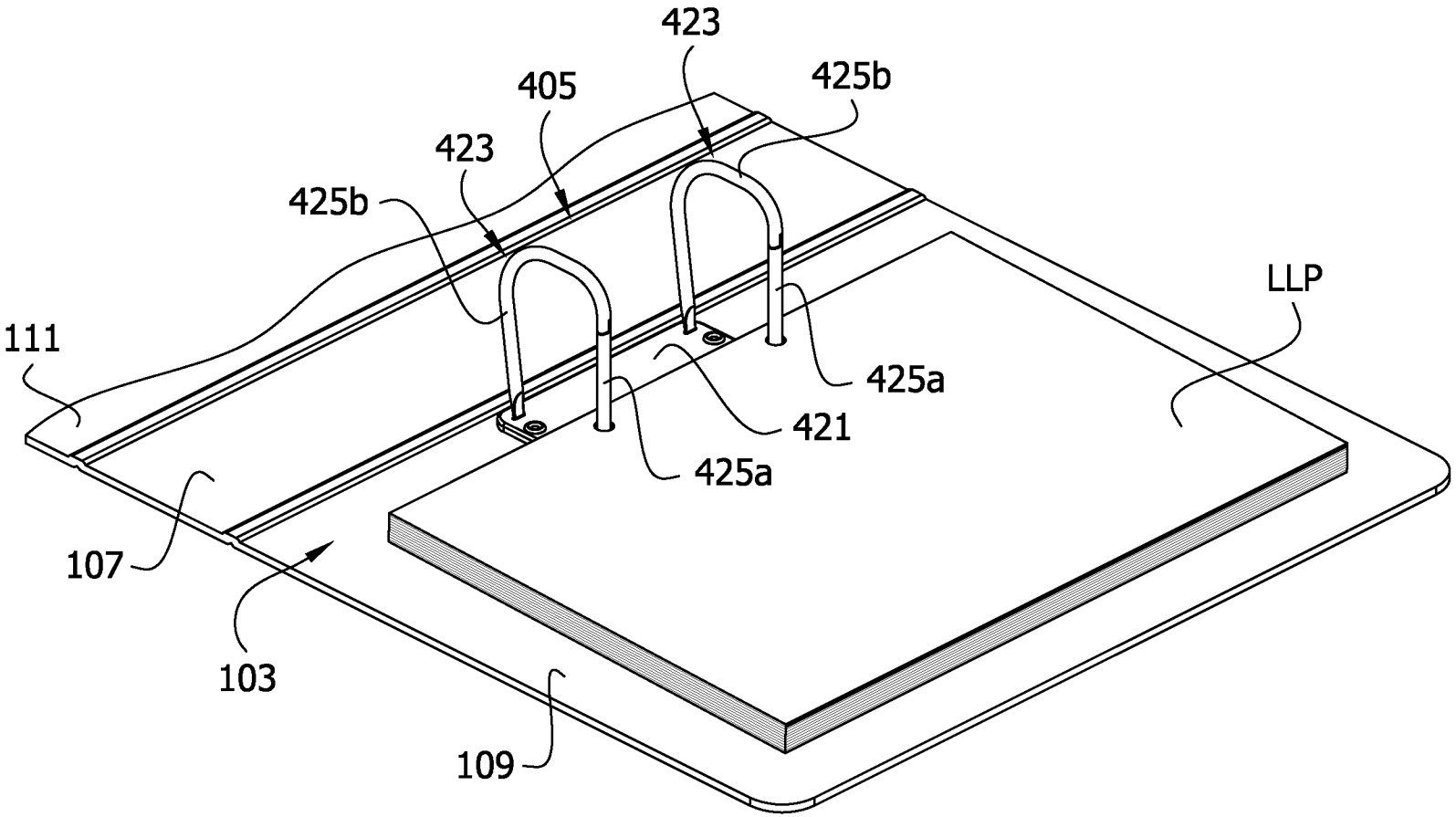
FIG. 28 is a perspective of a fourth embodiment of a ring binder mechanism of the present invention mounted on a notebook cover and retaining loose-leaf pages.
Figure 29:
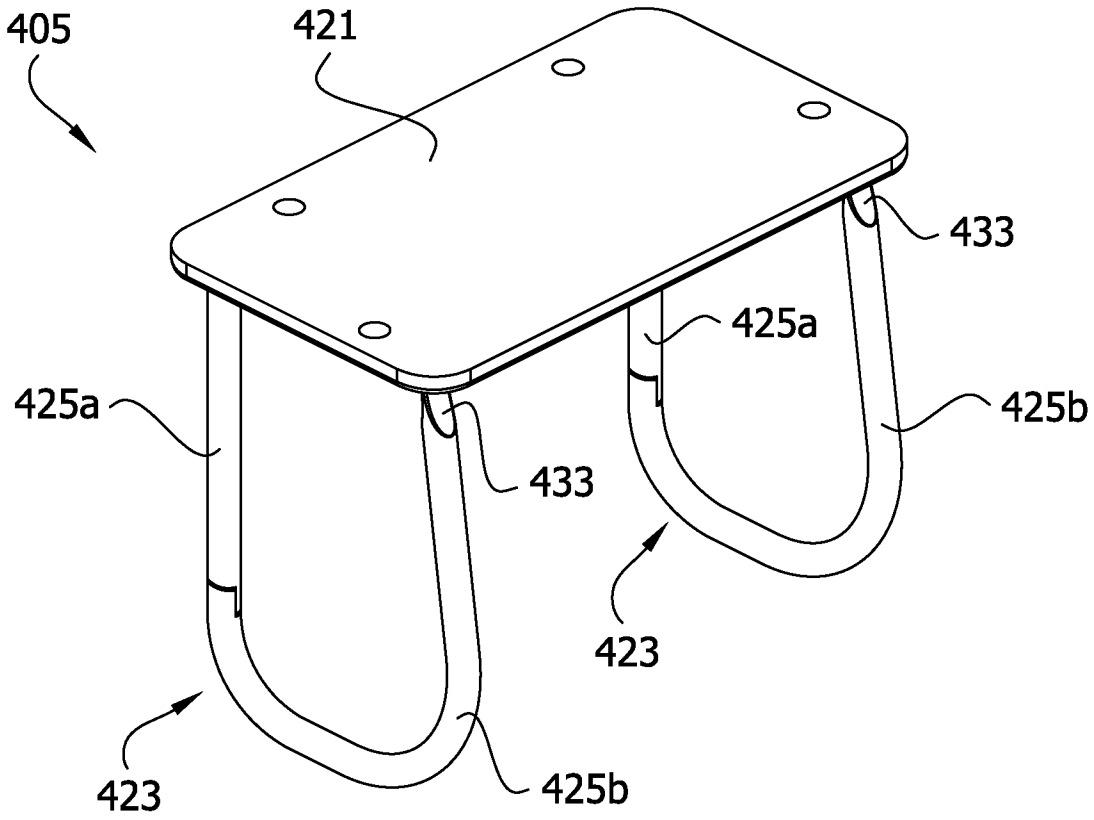
FIG. 29 is another perspective of the ring binder mechanism illustrated in FIG. 28 from a vantage point from which the bottom of the mechanism is visible.
Figure 30:
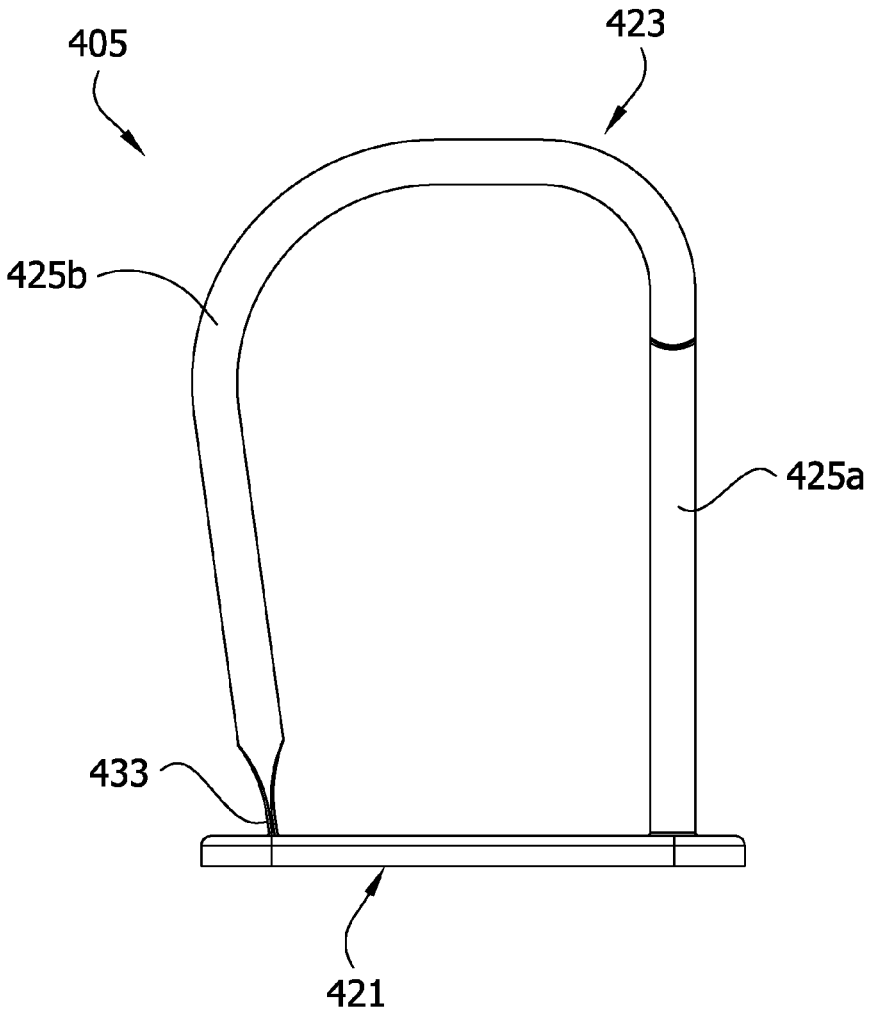
FIG. 30 is a front end elevation of the ring binder mechanism illustrated in FIG. 29.
Figure 31:
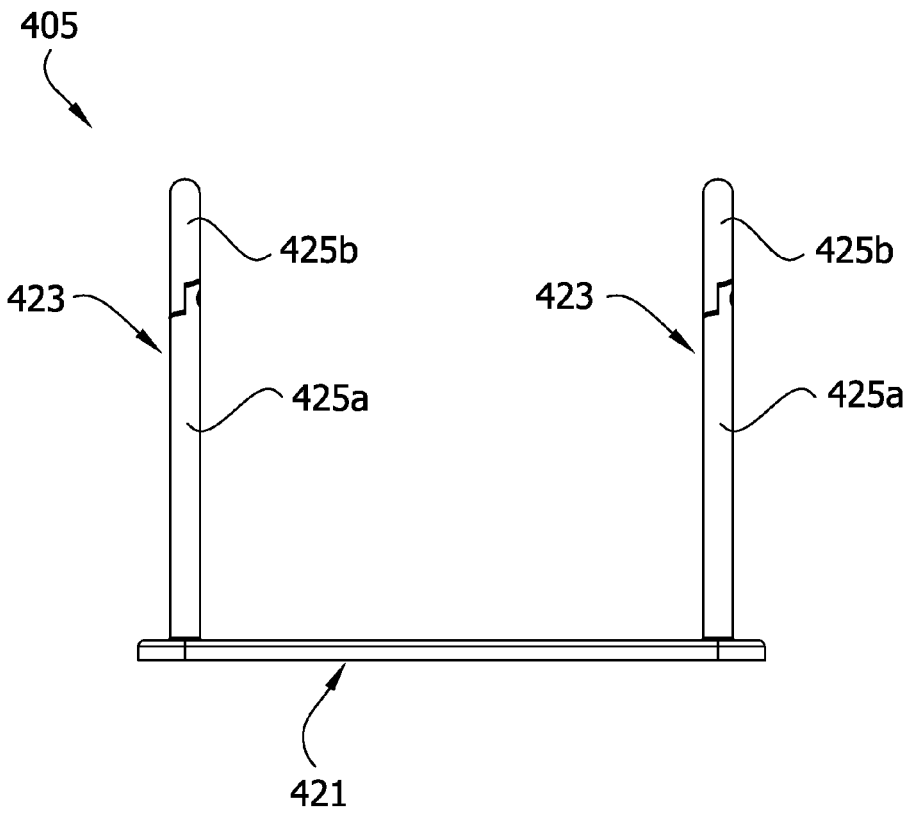
FIG. 31 is a side elevation of the ring binder mechanism illustrated in FIGS. 29-30.
Figure 32:
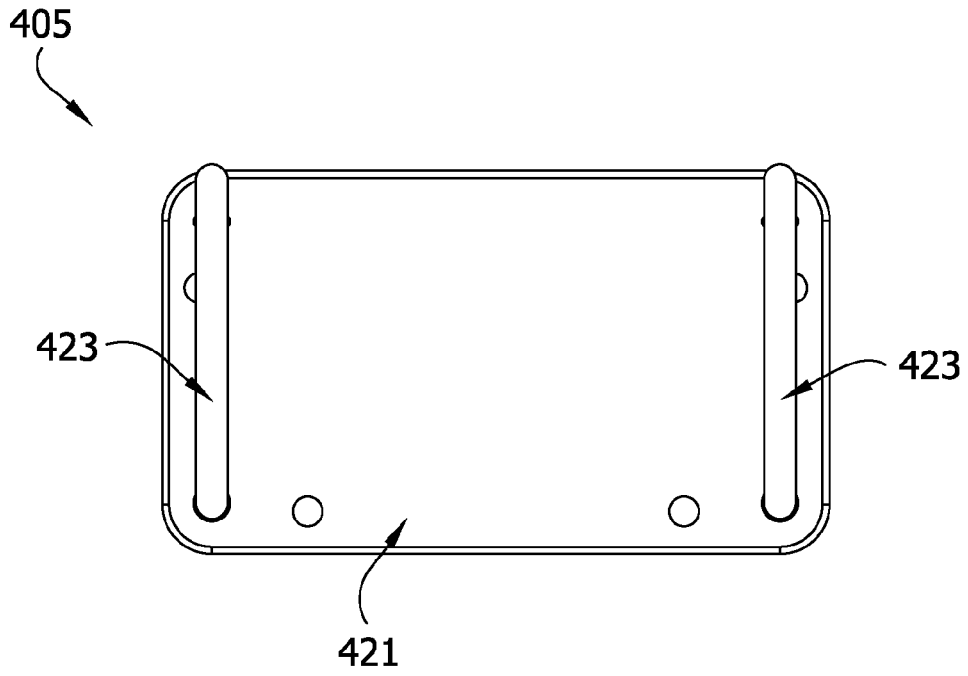
FIG. 32 is a top plan view of the ring binder mechanism illustrated in FIGS. 29-31.
Figure 33:
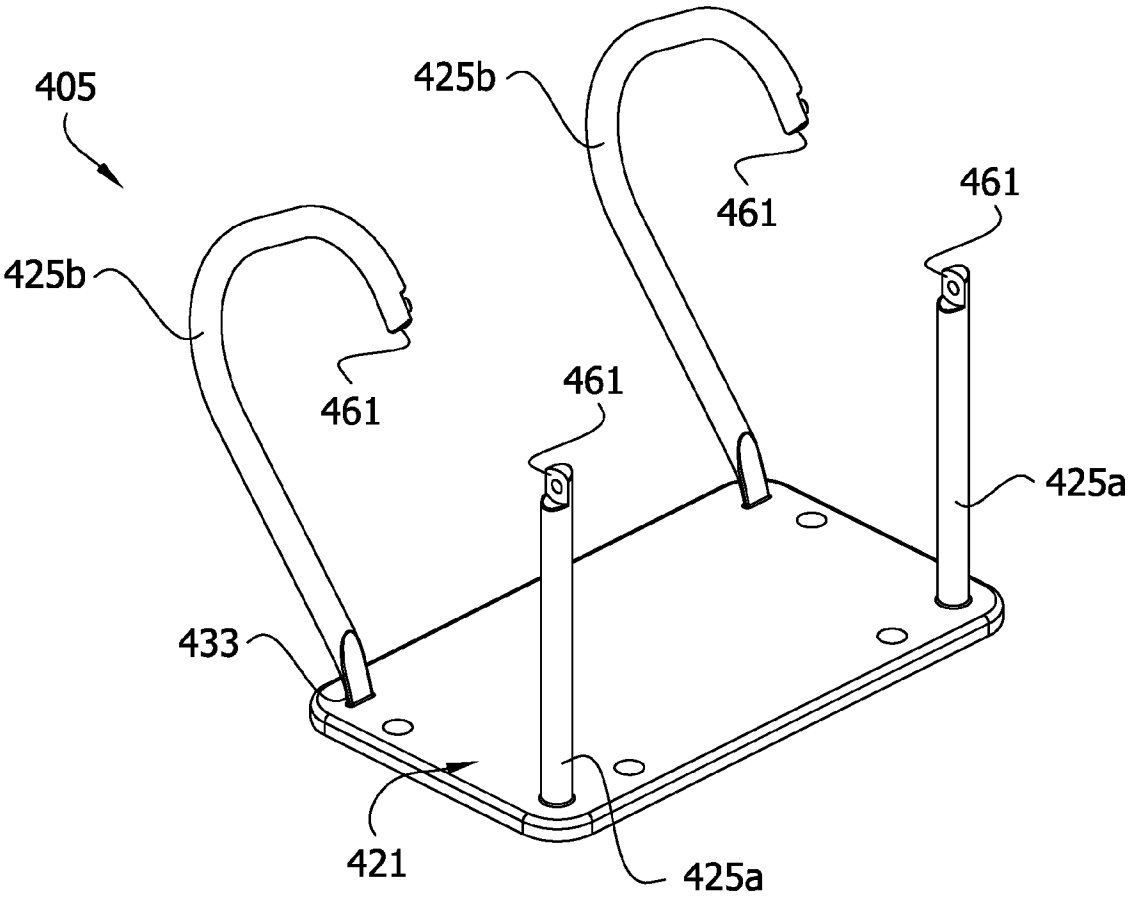
FIG. 33 is a perspective of the ring binder mechanism similar to FIG. 29, but with the rings in an open position and the mechanism separate from the notebook cover.
Figure 34:
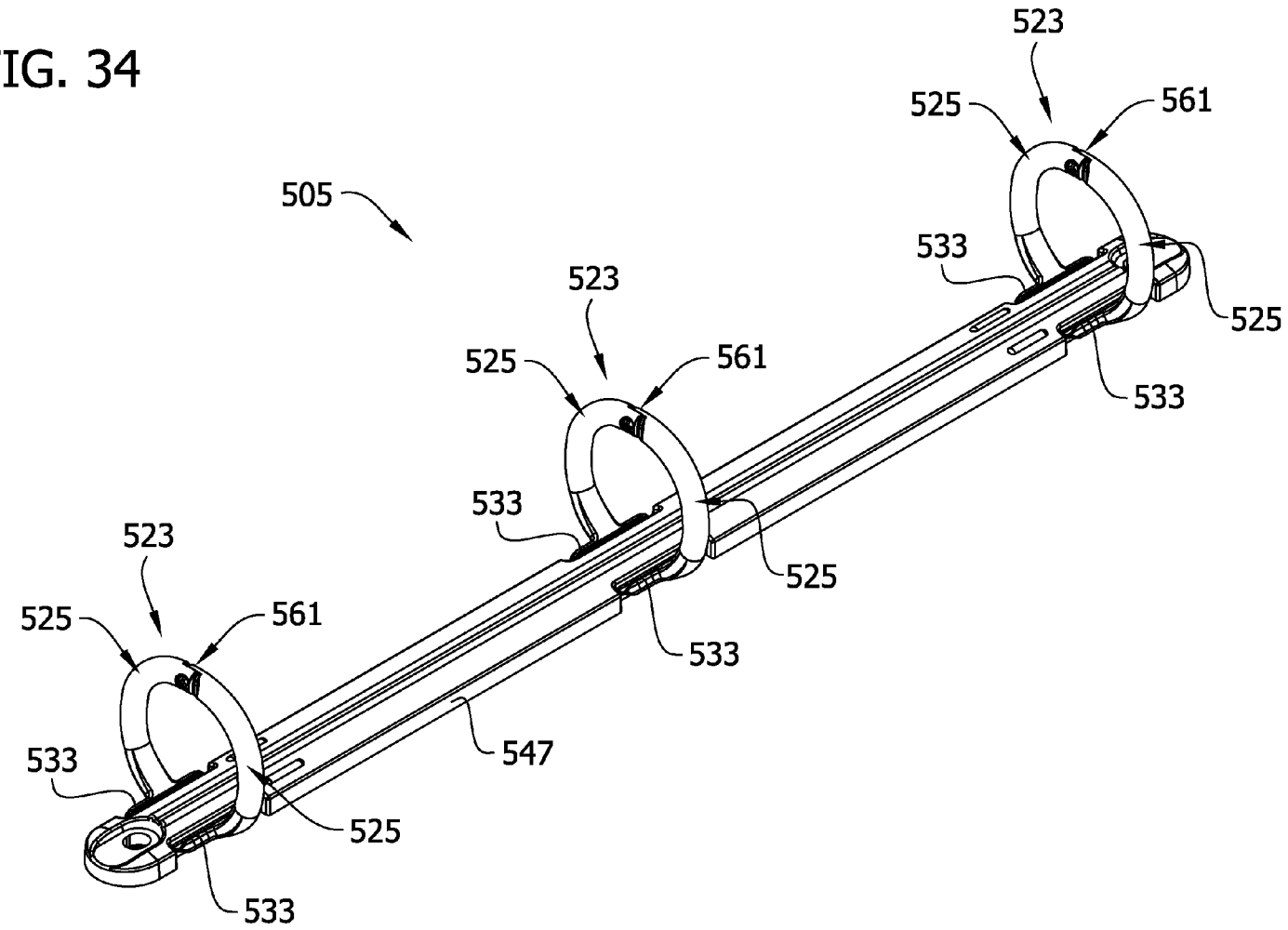
FIG. 34 is a perspective of a fifth embodiment of a ring binder mechanism.
Figure 35:
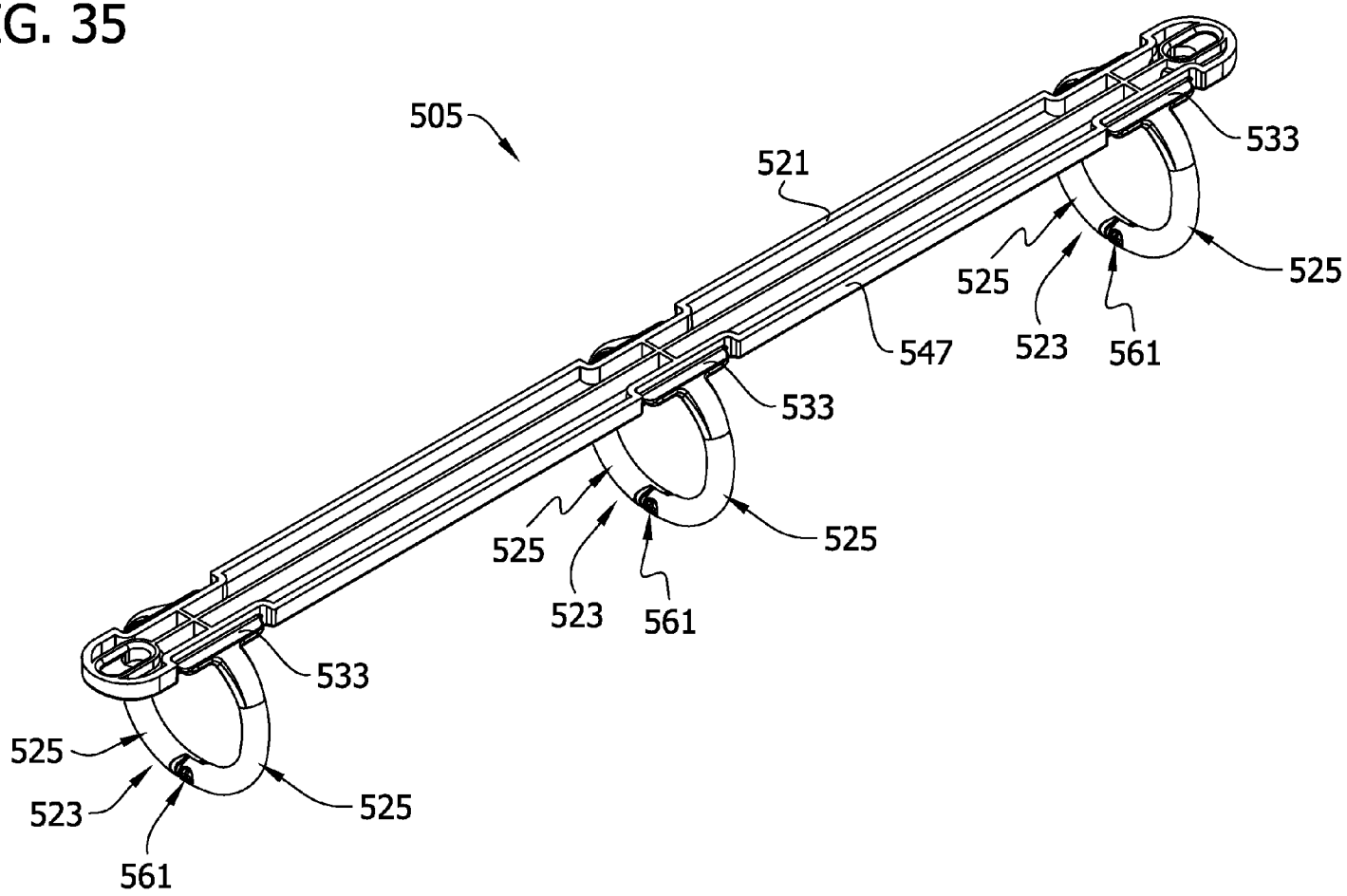
FIG. 35 is a perspective of a the ring binder mechanism shown in FIG. 34 from a vantage point in which the bottom of the mechanism is visible.

FIGS. 16-27 illustrate a third embodiment of a ring binder mechanism 305. This ring mechanism 305 is substantially identical to the ring mechanism 105 described in FIGS. 1-10, except as noted. The body 321 of the ring binder in this embodiment has a different orientation relative to the rings than the body 121 of the first embodiment 105. In particular, the body 321 is a generally flat plate having opposite major surfaces 355. The ring members 325 extend from the major surfaces 355 of the body 321. The ring members 325 are attached to the body by flexible segments 333 that are substantially similar to the flexible segments 133 of the first embodiment and opening and closing of the rings 323 is substantially the same as described for the rings 123 above. The ring mechanism 305 also includes a mounting plate 357 adapted to be secured to a notebook cover 103 or other substrate. The mounting plate 357 is suitably pivotally connected to the body 321 of the ring mechanism 305. For example as illustrated the mounting plate 357 is connected to the body 321 at a side of the body generally opposite the rings 323 by a living hinge 359. The mounting plate 357, body 321 and rings 323 are suitably formed as one piece from a moldable polymeric material as described above. When the mounting plate 357 is secured to the spine 107 of a notebook cover 103 or other substrate, the body 321 can pivot on the hinge 359 relative to the substrate and mounting plate, as illustrated in FIGS. 22-27. Those skilled in the art will recognize the type of ring mechanism illustrated in FIGS. 16-27 is sometimes referred to as a "turn around" because of the flexibility it provides to bend the panels 109, 111 back on themselves and arrange the loose-leaf pages so some of the pages are on top of the panels and some of the pages are under the panels, as illustrated in FIG. 24.

FIGS. 28-33 illustrate a fourth embodiment of a ring binder mechanism 405. This ring mechanism 405 is substantially identical to the mechanism 105 described above, except as noted. Whereas movement of the ring members 125 of the mechanism 105 describe above is substantially similar to many conventional metal ring binders of the type having rings mounted on hinge plates supported by a metal housing, the opening and closing movements of the rings 423 of the mechanism illustrated in FIGS. 28-33 are substantially similar to the movements of the rings of a conventional metal lever arch mechanism. The rings 423 of this mechanism 405 include one ring member 425*b* that is moveable relative to the body 421 and another ring member 425*a* that is substantially fixed so it does not move appreciably relative to the body during opening and closing of the rings 423. The moveable ring member 425*b* has a relatively flexible segment 433 connecting it to the body 421 in substantially the same way as the flexible segments 133 connect the ring members 123 to the body 121 of the mechanism 105 described above. The other ring member 425*a* suitably comprises a substantially straight cylindrical rod extending up from the body 421. The mechanism 405 includes a retaining system 461 substantially similar to the retaining system 161 described above. The body 421 and rings 423 are suitably formed as one piece from a moldable polymeric material as described above.

FIGS. 34-42 illustrate a fifth embodiment of a ring binder mechanism 505. This ring mechanism 505 is substantially similar to the mechanism 205 described above, except as noted. In this ring mechanism, each of the ring members 525 is connected to the body 521 by a living hinge 533 that extends along the body in a direction generally parallel to a longitudinal axis of the body 521. The body 521, living hinge 533, and ring members 525 are formed together as one-piece from a moldable polymeric material.

Figure 36:
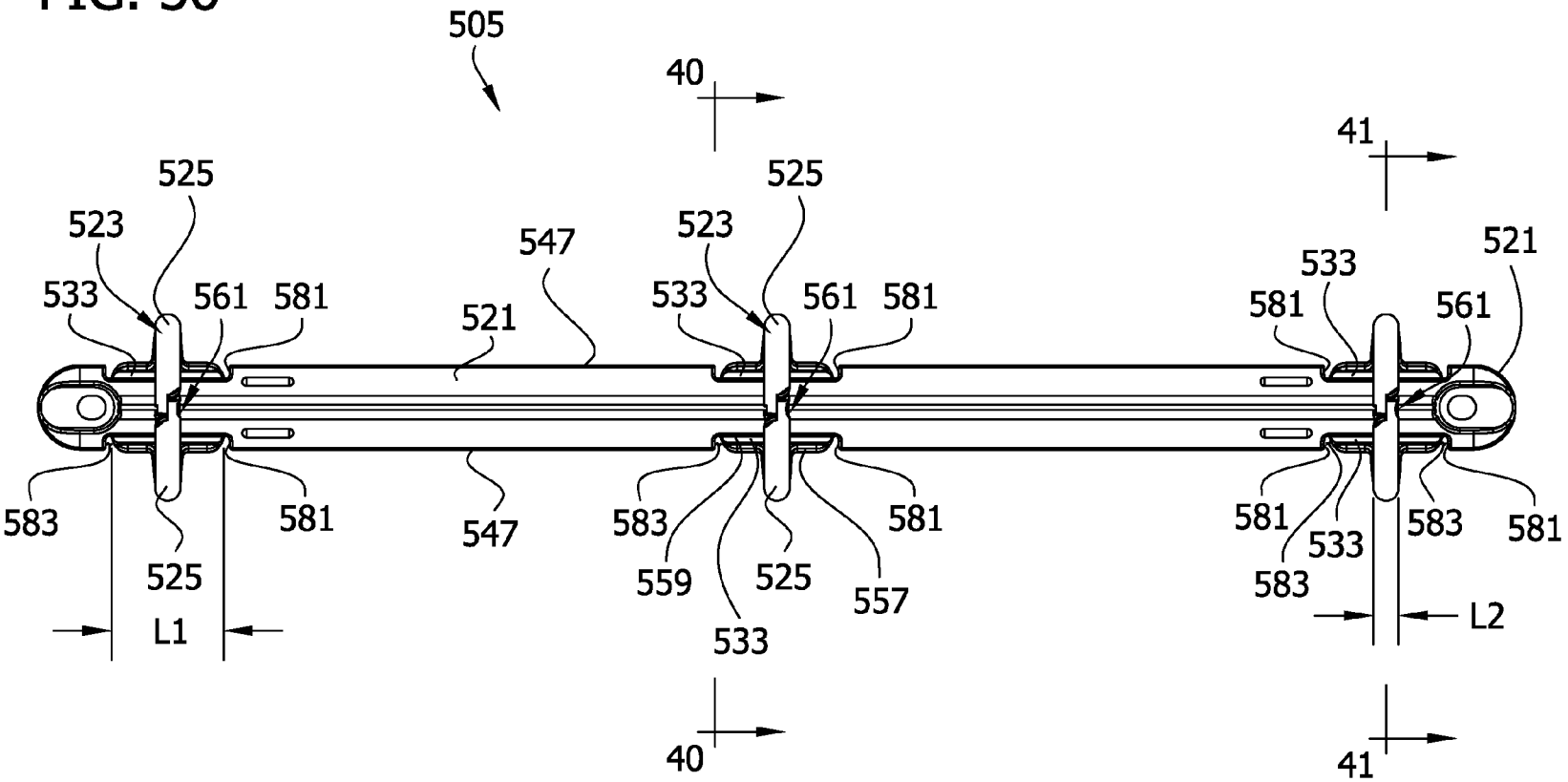
FIG. 36 is a top plan view of the mechanism illustrated in FIGS. 34-35.
Figure 40:
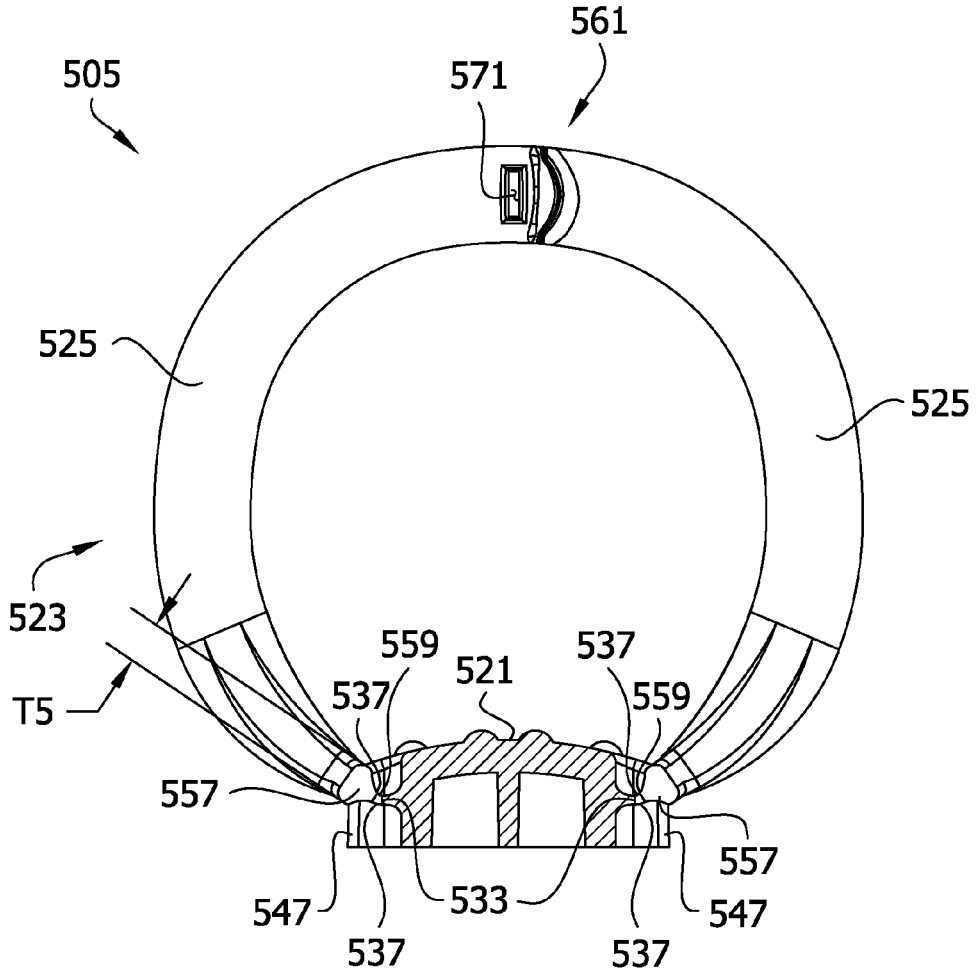
FIGS. 40-41 are cross sections of the ring mechanism illustrated in FIGS. 34-39 taken in a plane including lines 40-40 and 41-41, respectively, on FIG. 36 and illustrating a living hinge.
Figure 41:
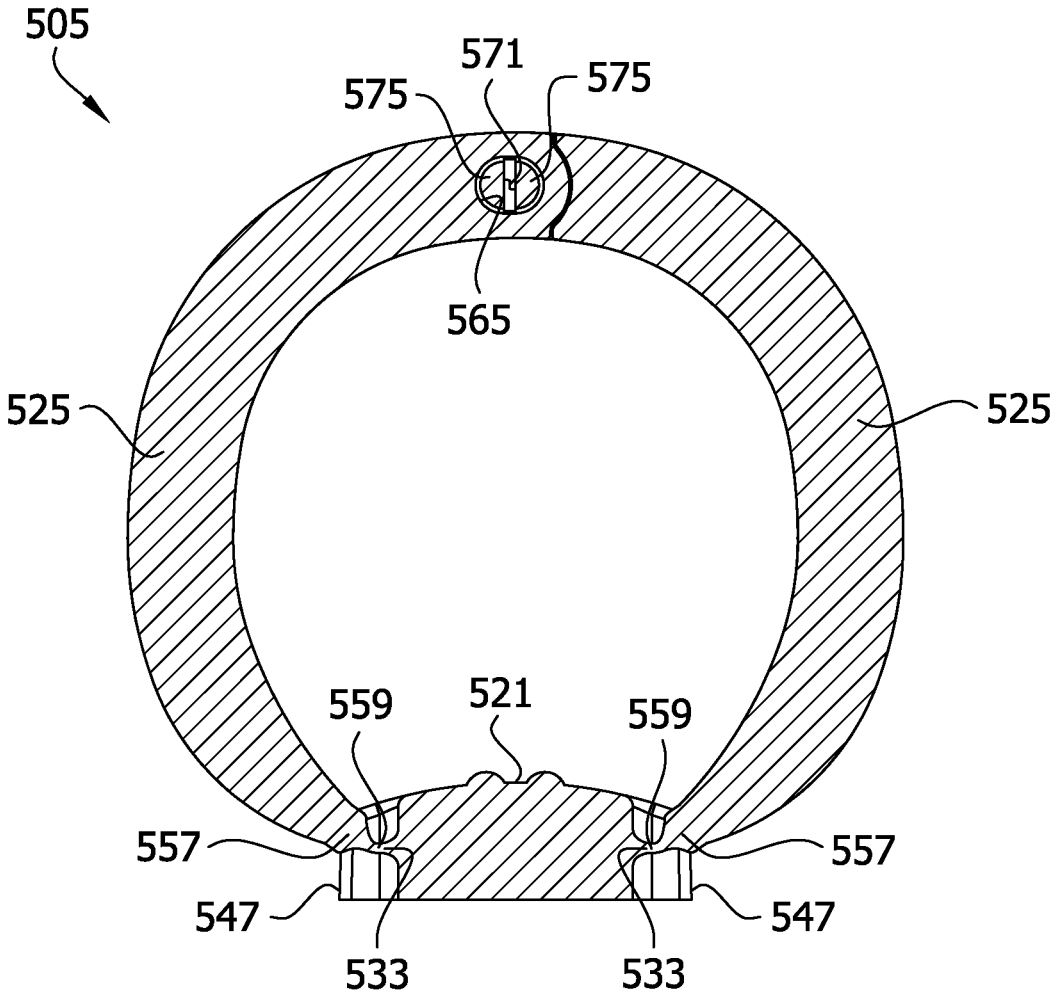
Figure 42:
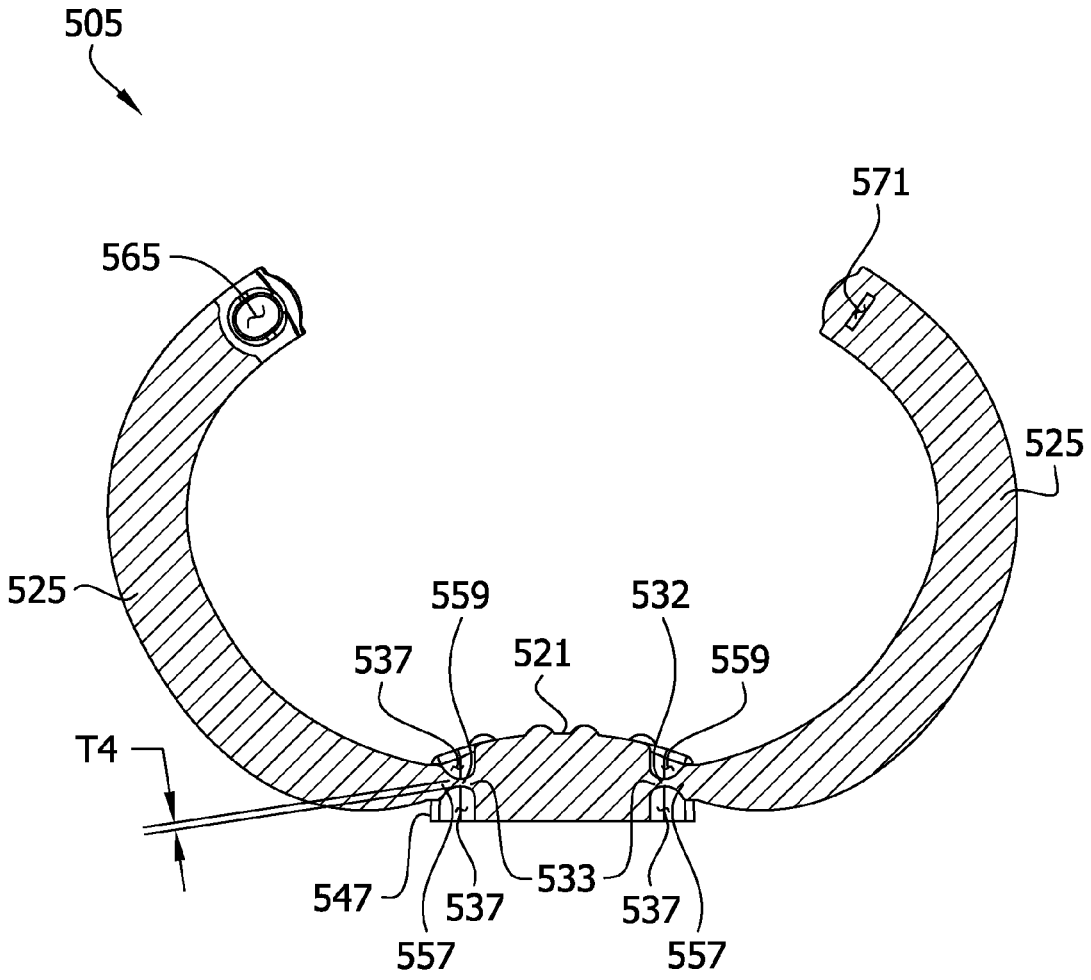
FIG. 42 is a cross section of the ring mechanism illustrated in FIGS. 34-41 taken in a plane including line 42-42 on FIG. 37 and illustrating the living hinge when the rings are in an open position.
Figure 43A:
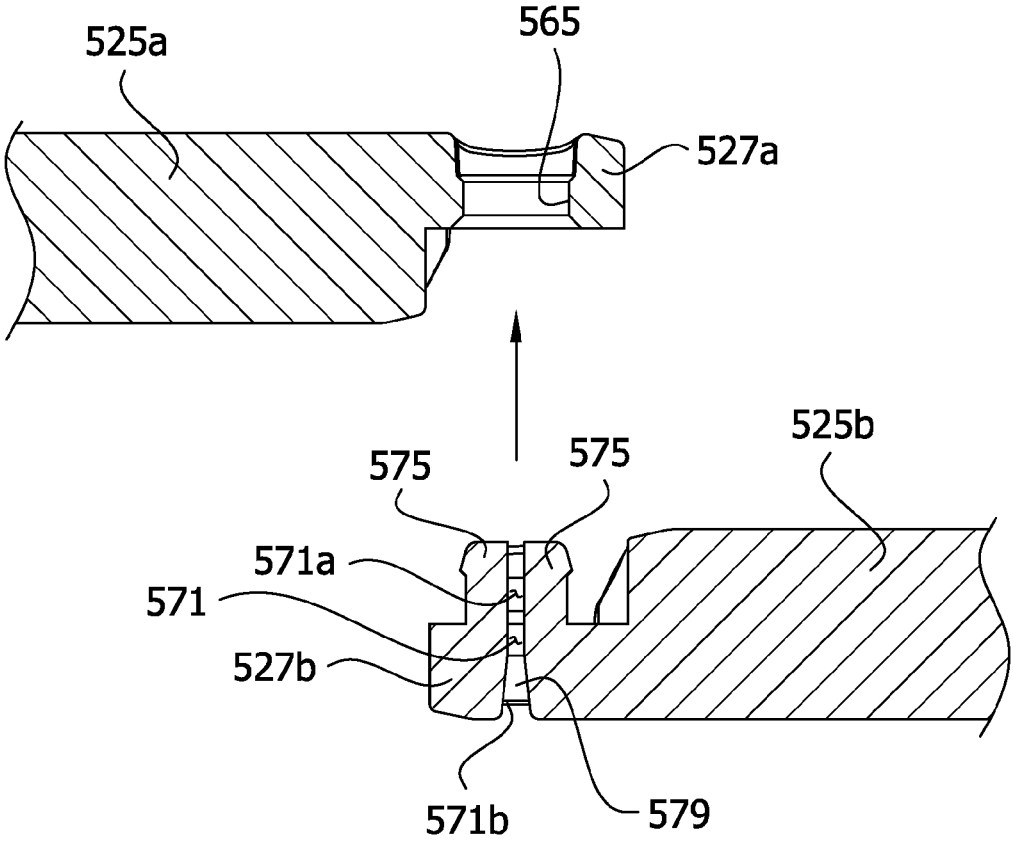
FIGS. 43A-43C are enlarged cross sections of the interlocking formations on the ends of the ring members of the ring mechanism illustrated in FIGS. 34-42 and illustrate a sequence in which the rings are moved between closed and open positions.
Figure 43B:
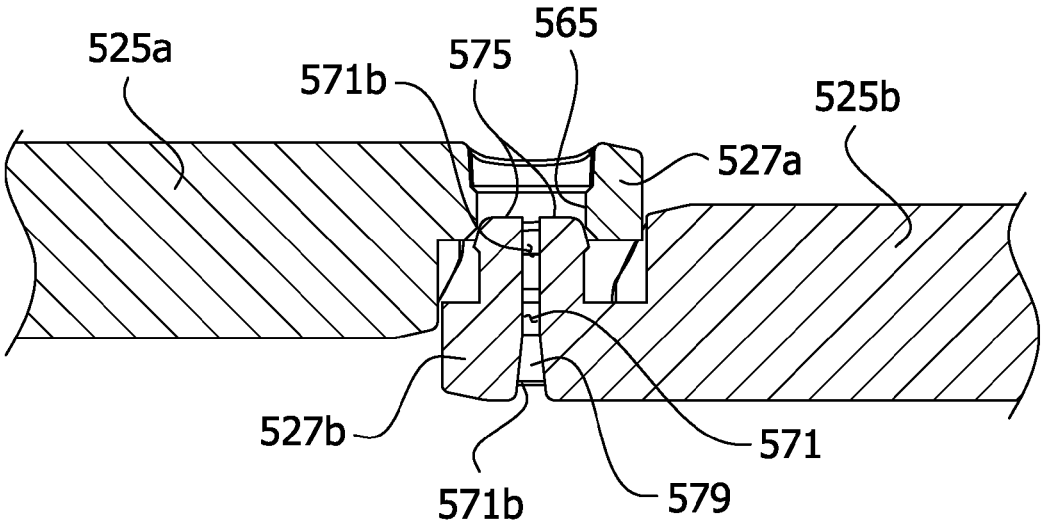
Figure 43C:
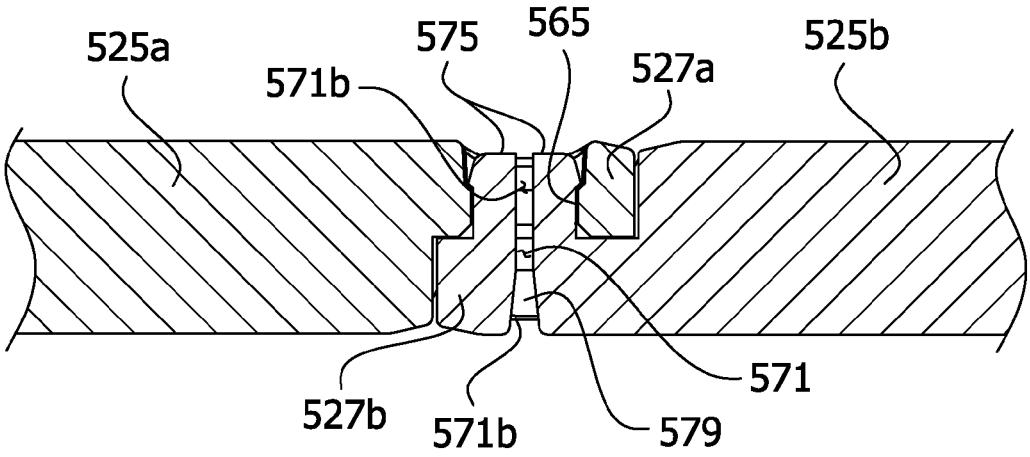
Figure 44:
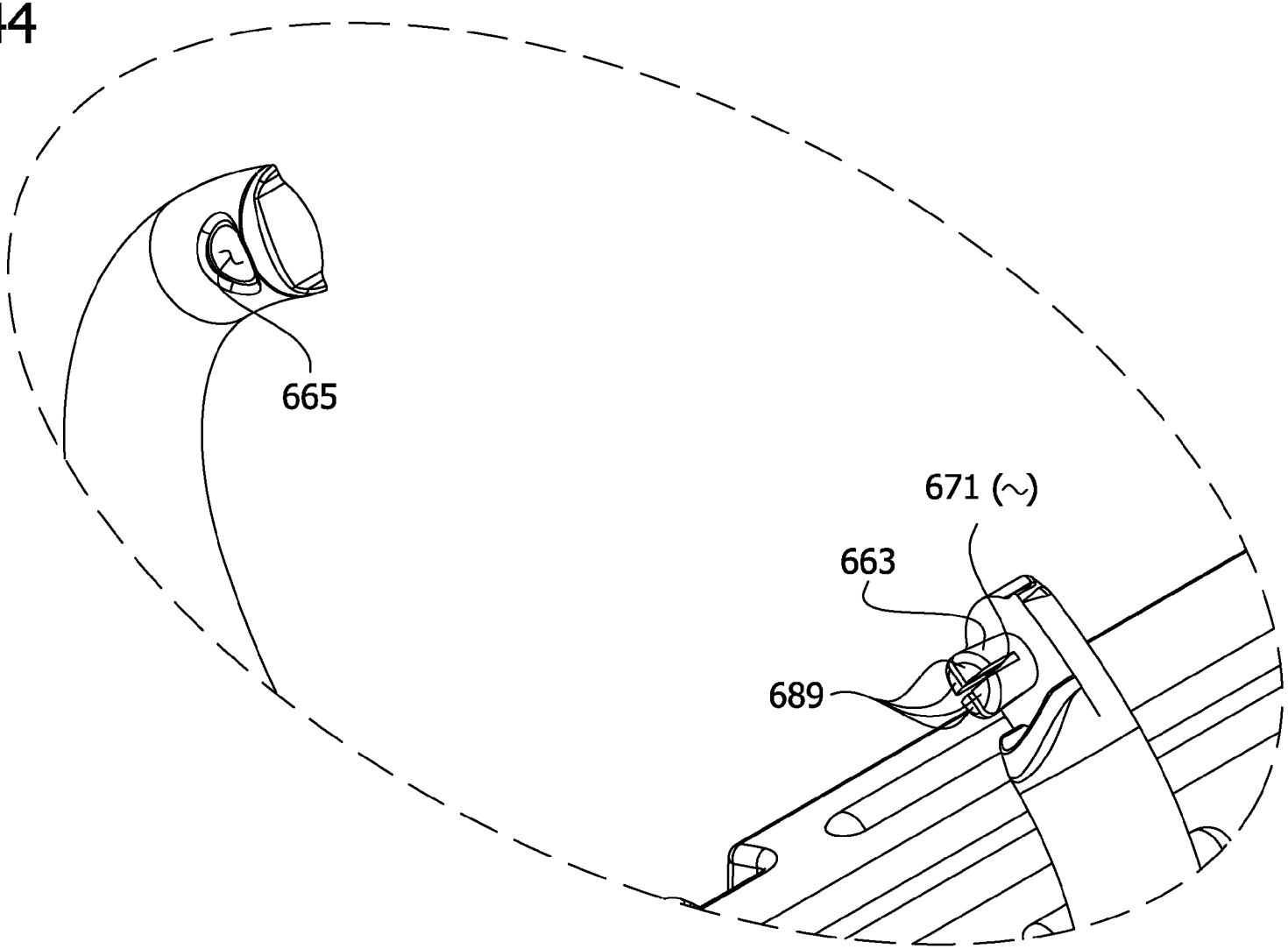
FIG. 44 is a perspective of an interlocking formation on the ends of the ring members of a sixth embodiment of a ring mechanism.
Figure 45:
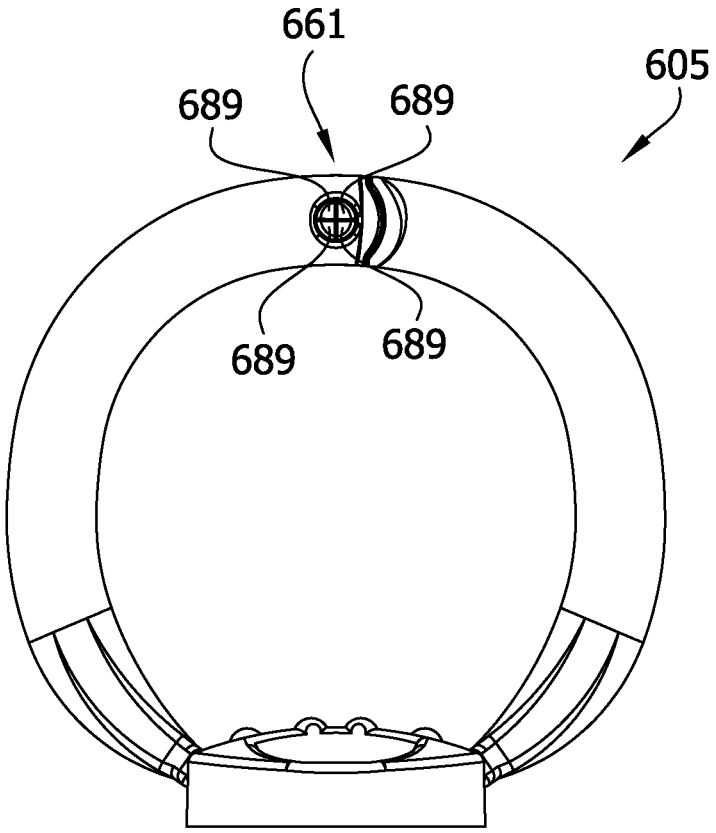
FIG. 45 is a side elevation of the ring mechanism illustrated in FIG. 44.
Figure 46A:
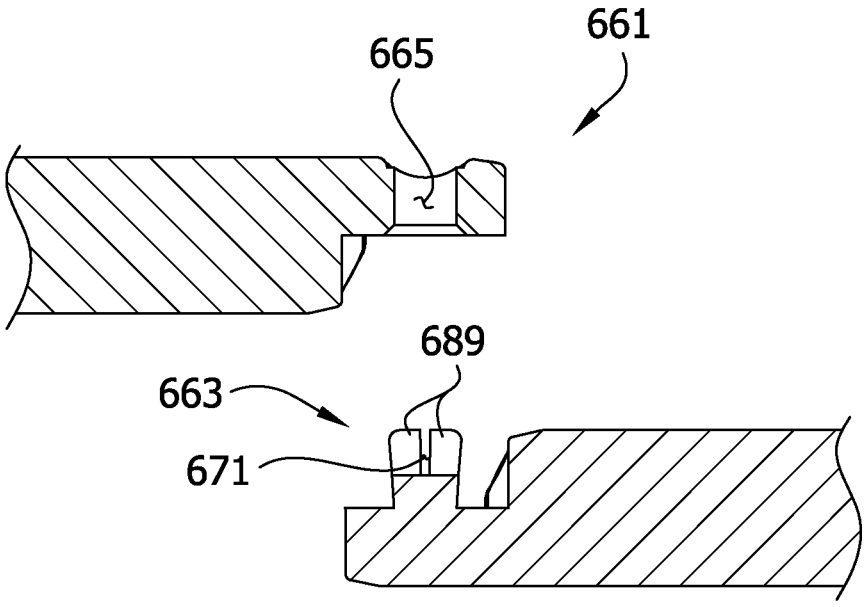
FIGS. 46A-46B illustrate a sequence in which a retaining system of the mechanism illustrated in FIGS. 44 and 45 is moved to a retaining position.
Figure 46B:
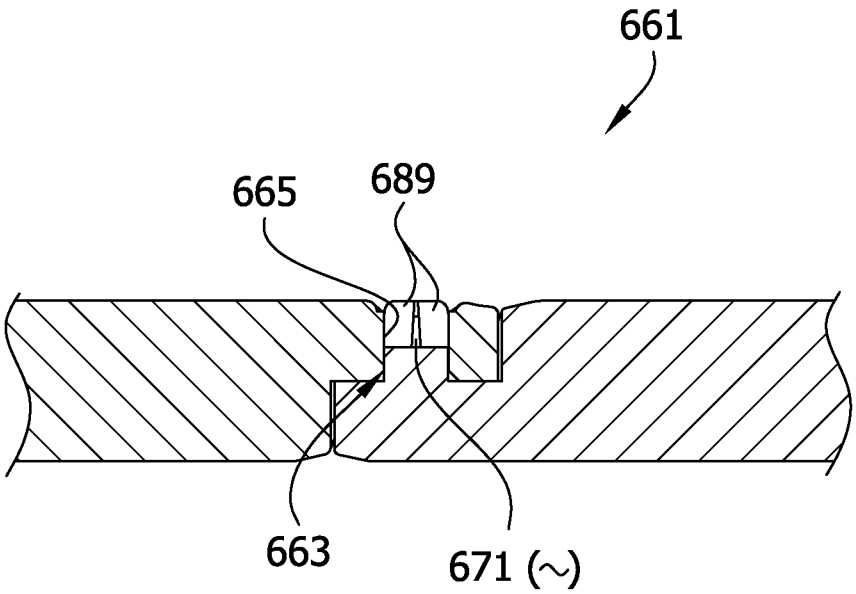
Figure 47:
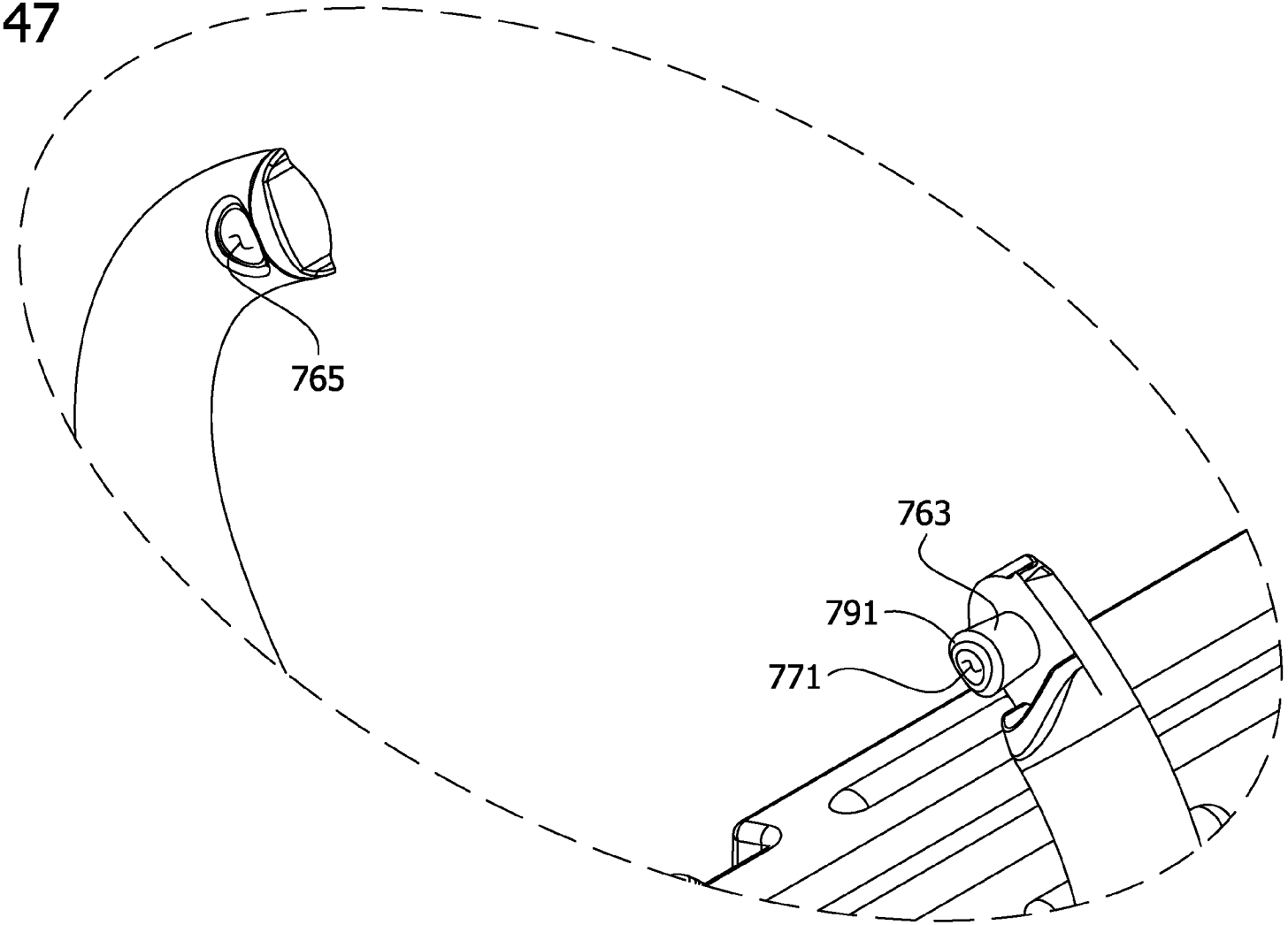
FIG. 47 is a perspective of an interlocking formation on the ends of the ring members of a seventh embodiment of a ring mechanism.
Figure 48:
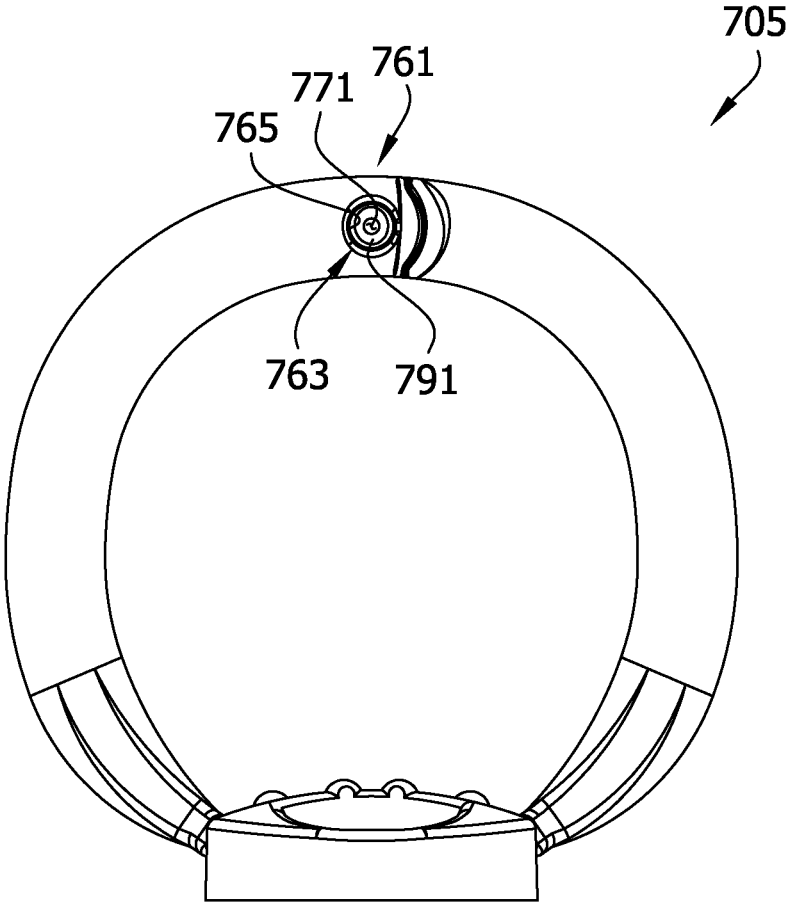
FIG. 48 is a side elevation of the ring mechanism illustrated in FIG. 47.
Figure 49A:
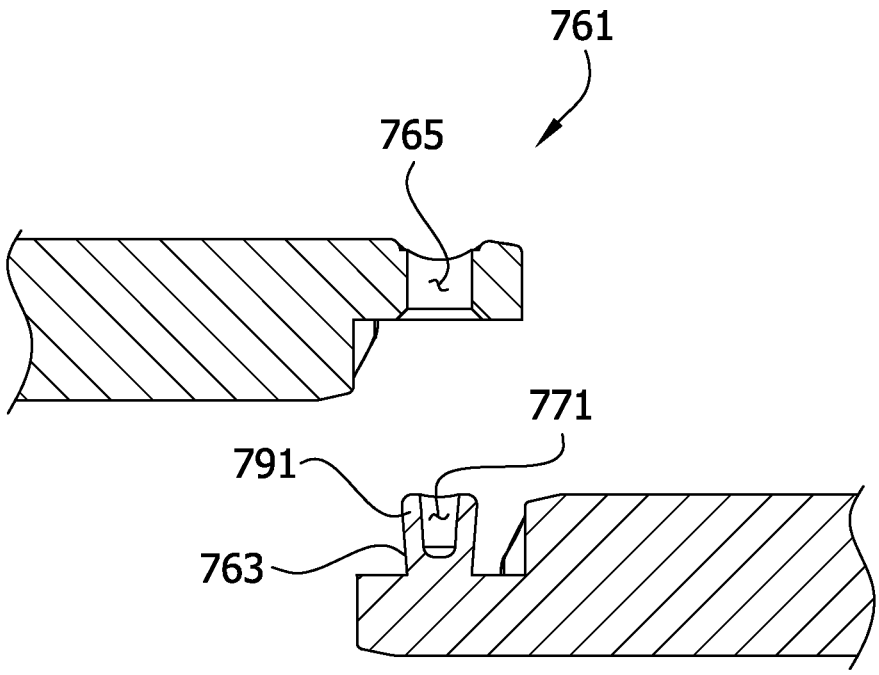
FIGS. 49A-49B illustrate a sequence in which a retaining system of the mechanism illustrated in FIGS. 47 and 48 is moved to a retaining position.
Figure 49B:
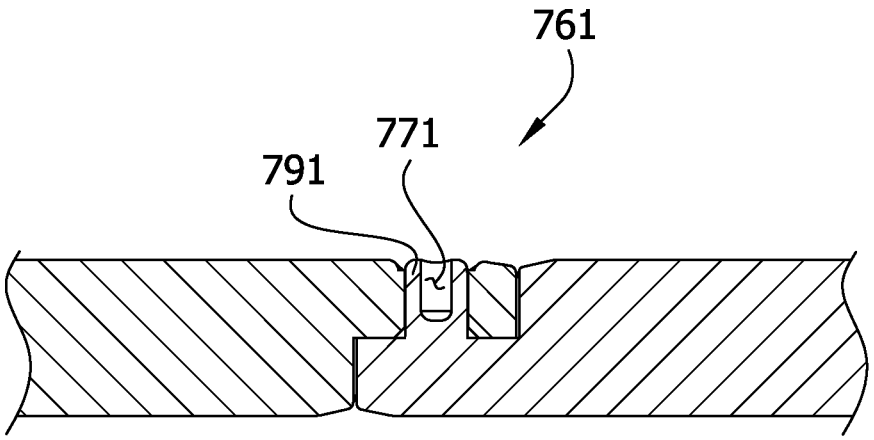

As illustrated in FIG. 36, the living hinges 533 are positioned within recesses 581 along opposite sides 547 of the body 521. In particular, referring to FIG. 40, the thinnest segment 559 of each living hinge extends axially of the body 521 and is positioned inward of the adjacent side 547 of the body 521. Further, the thinnest segment 559 is inward of the side 547 of the body 521 in both the open and closed position of the rings 523 and remains inward of the side of the body as the ring members move between the open and closed positions. As illustrated in FIGS. 41 and 42, the thinnest segment 559 of the living hinge 533 is defined by arcuate notches 537 in the upper and lower surfaces of the living hinge. The arcuate notches suitably have a relatively large radius of curvature in the range of about 0.5 mm to about 2.0 mm when the rings 523 are in the open undeformed position. When the rings 523 are in the closed position (FIG. 40) the notches 537 are shaped differently because of deformation of the living hinges 533. Except as noted, statements about the shape of the notches 537 herein refer to the shape of the notches when the rings 523 are in the open position and the living hinges 533 are in an undeformed configuration.

The actuate notches 537 are shaped to form a longitudinally extending rib 557 positioned outward of the thinnest segment 559 of the living hinge 533. The rib 557 is suitably supported entirely by the thinnest segment 559 of the living hinge 533 such that the thinnest segment of the living hinge is the only connection between the rib and the rest of the body 521. The outer margin of the rib 557 is suitably generally aligned with or positioned slightly outward of the sides 547 of the body 521. The rib 557 has a thickness T3 at its outer margin that is substantially thicker than the thickness T4 of the thinnest segment of the living hinge 533. For example, the thickness T3 of the rib 557 at its outer margin is suitably in the range of about 1.5 mm to about 5.0 mm while the thickness T4 of the thinnest segment 559 of the living hinge 533 is suitably in the range of about 0.25 mm to about 0.9 mm.

The bases of the ring members 523 are attached to the ribs 557 of the corresponding living hinges 533 at the outer margins of the ribs. The thickness T3 of each rib 557 at its outer margin is suitably about equal to the thickness T5 of the base of the corresponding ring member 523 where it attaches to the rib. The arcuate notches 537 produce a smooth transition between the thinnest segment 559 of the living hinge 533 and the outer margin of the rib 557. Because the rate at which the thickness of the living hinge 533 increases moving outward from the thinnest segment 559 is continuously increasing along the arcuate notches, the overall strength and durability of the living hinge is increased. Also, the arcuate notches 537 extend in a continuously curved manner from a position inward of the thinnest segment 559 of the living hinge 533 to a position outward of the thinnest segment of the living hinge. Consequently, the thinnest segment 559 of the living hinge 533 is configured as a thin axially extending linear portion of the living hinge. For example, when viewed in cross section, as illustrated in FIGS. 40-42, the thinnest segment of the living hinge is only a single point and the living hinge 533 transitions smoothly to a larger thickness both inward and outward of that point.

The living hinges 533 each have an axial length L1 (FIG. 36) that is longer than the axial length L2 of the ring members 525. The axial length L1 of the living hinge 533 is determined by measuring the axial length of the thinnest segment 559 of the living hinge. The length L1 of the living hinge 533 is suitably at least three times the axial length L2 of the ring members 525. As another example, the length L1 of the living hinge 533 is suitably at least about ⅝ of an inch. The living hinges 533 are shorter in axial length than the recesses 581 in which they are received. Accordingly, there are small gaps 583 at opposite axial ends of the living hinges 533 between the ends of the living hinge at its thinnest segment 559 and the ends of the recesses. The size of the gaps 583 can vary within the scope of the invention. The gaps 583 are advantageous because they disconnect the body 521 of the ring mechanism 505 at the ends of the recesses 581 from the movement of the living hinges 533. Because of the gaps 583 the axial ends of the thinnest segments 559 of the living hinges 533 can move relative to the body 521 during movement of the ring members 525 between the open and closed position. The gaps 583 also limit or avoid stress concentrations that could result if the body 521 connected the axial ends of the living hinges 533 directly to the sides of the recesses 581 across the gaps. The gaps 583 are suitably relatively small so the sides 547 of the body 521 provide better shielding for the living hinges 533 (e.g., to protect the living hinges 533 from incidental collisions with other object during use of the mechanism).

Figure 37:
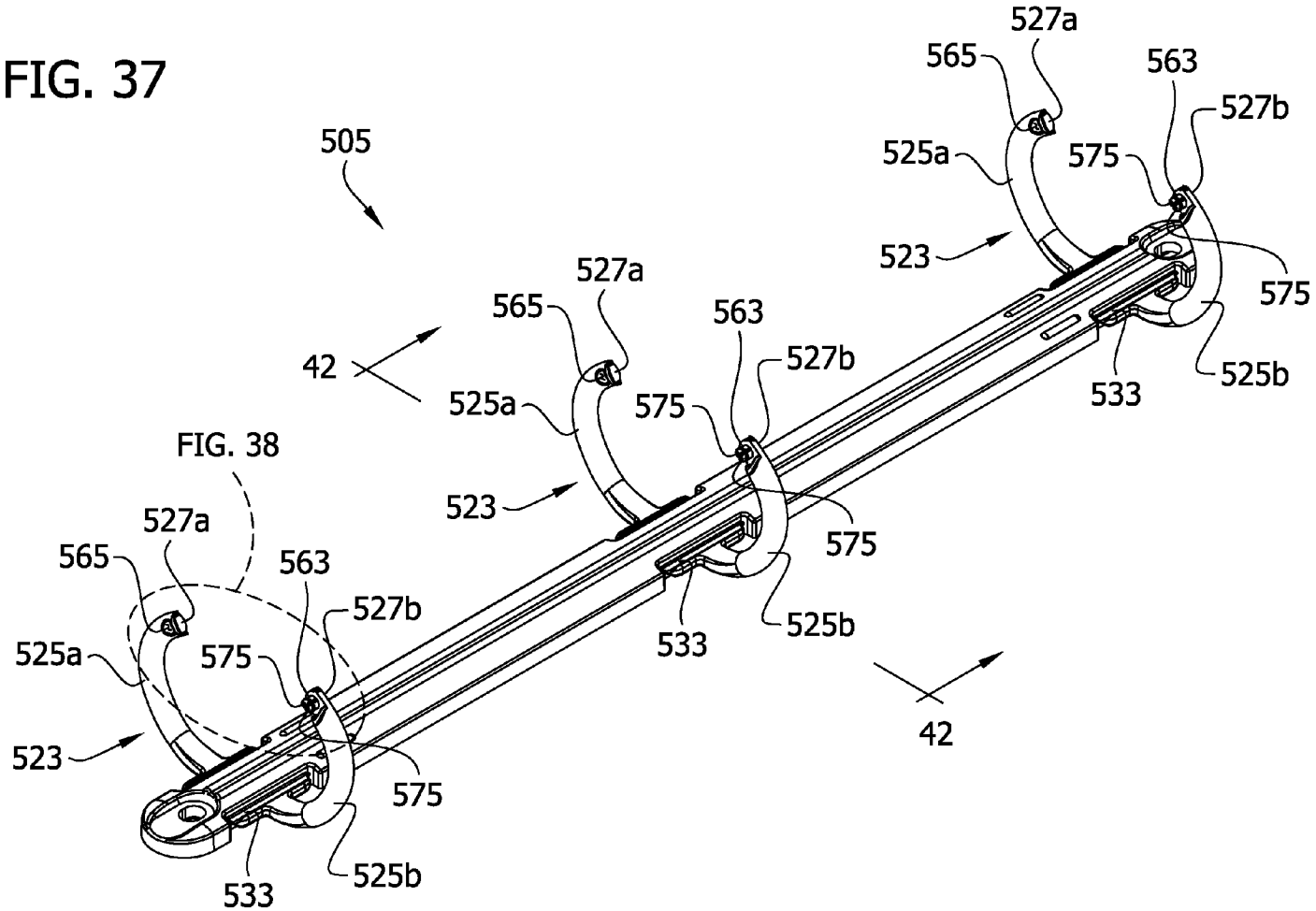
FIG. 37 is a perspective of the mechanism illustrated in FIGS. 34-36 showing the rings in an open position.
Figure 38:
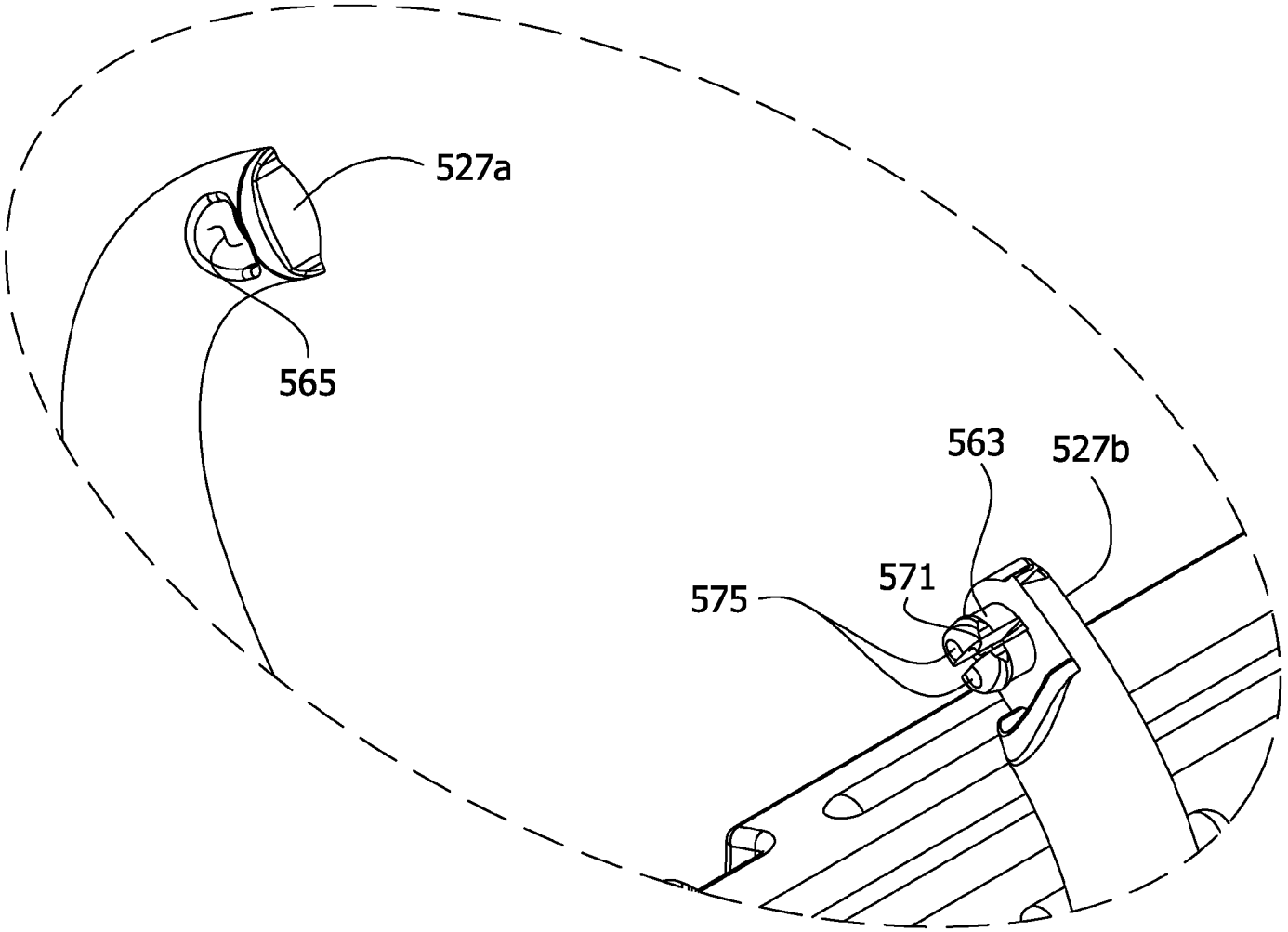
FIG. 38 is an enlarged perspective of a portion of the mechanism illustrated in FIG. 37 showing interlocking formations on the ends of the ring members.
Figure 39:
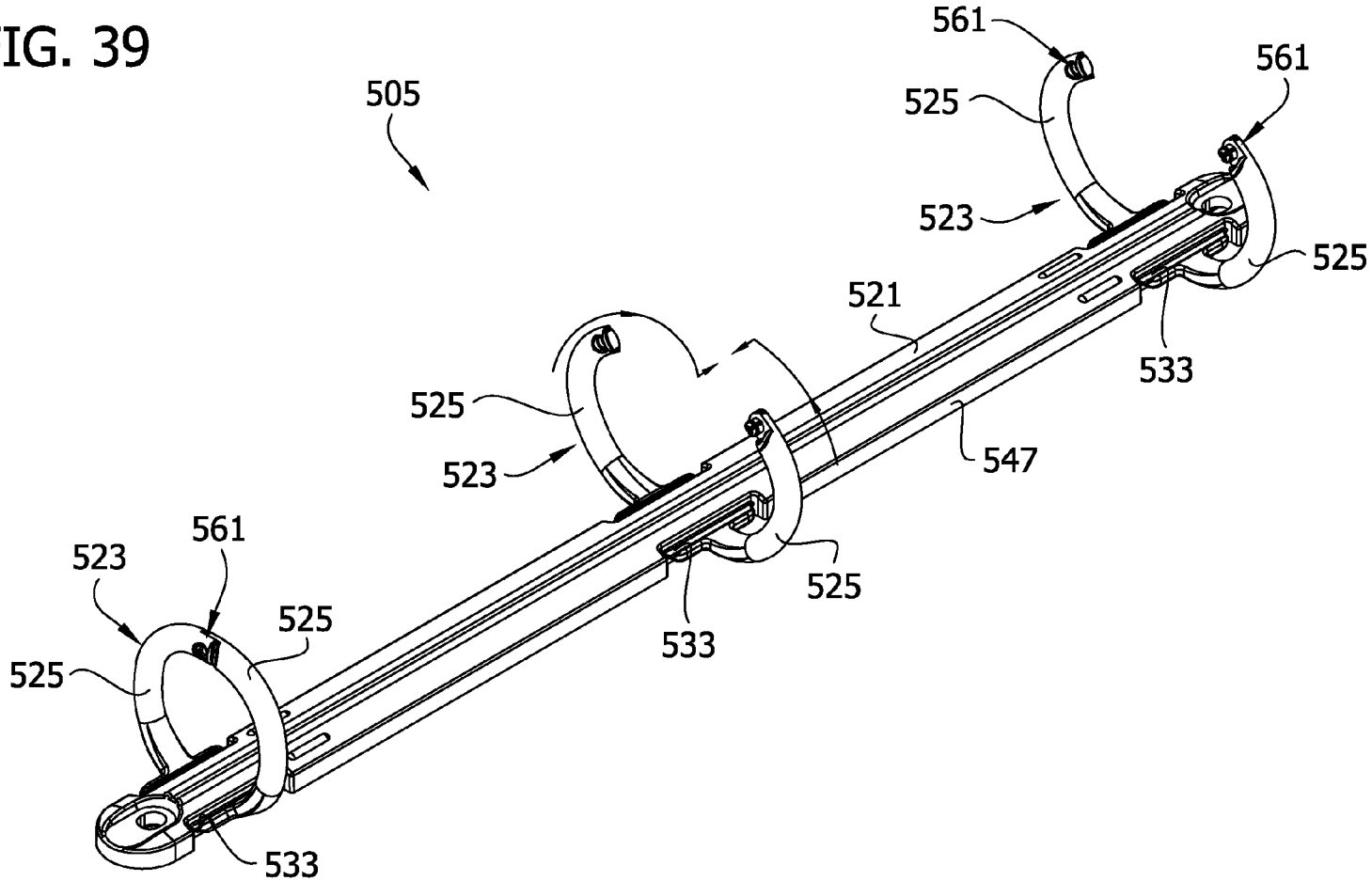
FIG. 39 is a perspective of the ring mechanism illustrated in FIGS. 34-38 with one of the rings in the closed position and other rings in the open position.

Ring binder mechanism 505 also comprises a retaining system 561 for selectively and releaseably holding the ring members 525 in the closed position. The retaining system 561 is similar to the retaining system 161 described above, except as noted. Referring to FIGS. 37 and 38, the interlocking formation on the end 527*b* of one ring member 525*b* includes at least one projection 563 (e.g., post) extending axially of the body 521 having a free end. As illustrated in FIG. 38, for example, the interlocking formation on the other ring member 525*a* is suitably an axially extending opening 565 for receiving the projection 563.

The opening 565 is suitably sized to resiliently compress the at least one projection 563 radially inward with respect to an axis of the opening when the ring members 525 are moved from the non-retaining position to the retaining position. The opening 565 is suitably adapted to squeeze the projection 563 radially inward in multiple different directions as the projection is inserted into the opening. Likewise, the projection 563 is suitably adapted to exert radially outward forces on the opening 565 when the projection is inserted into the opening. The opening 565 suitably has a slightly enlogate (e.g., oval) cross sectional shape, as illustrated in FIG. 42, although the opening can have other shapes within the broad scope of the invention. As indicated by the arrows on FIG. 39, the movement of the ring members 525 during opening and closing of the rings 523 is substantially the same as it is for the retaining system 161 described above.

As illustrated in FIGS. 37 and 38, the projection 563 suitably includes a plurality of fingers 575 spaced apart from one another at least at the free end of the projection. The number of fingers can vary within the scope of the invention. In FIGS. 37 and 38, each projection 563 has two fingers 575 which collectively form an axially extending post. In the illustrated embodiment, the fingers 575 are connected at their base to the end 527*b* of the ring member 525*b* and remain separate from one another along the entire length of the axially-extending post/projection 563. However, it is contemplated the fingers 575 may be separate from one another along only a portion of the axially-extending projection 563. For example, the fingers may be separate from one another at the free end of the projection, but not separate from one another at the base of the projection where the projection connects to the end of the ring member.

At least one void 571 is included in the projection 563 and is adapted so at least a portion of the void is resiliently compressed by the interlocking formation on the end 527*a* of the opposite ring member 525*a* when the interlocking formations 563, 565 are moved between the retaining and non-retaining positions. In the illustrated embodiment, the void 571 extends between the fingers 575 of the projection 563. In particular, the void 571 suitably extends axially into the projection 563 from the free end of the projection. As illustrated in FIG. 38, the void 571 is suitably an elongate slot extending between the fingers 575. The slot forming the void 571 suitably extends transversely all the way through the projection 563 between opposite sides of the projection. The void 571 suitably extends substantially all the way through the axial length of the projection 563 from the free end to the base of the projection. Moreover, in the illustrated embodiment, the void 571 includes a first portion 571*a* that is positioned between the fingers 575 and a second portion 571*b* that extends beyond the base of the projection 563 into the end 527*b* of the ring member 525*b*. As illustrated in FIG. 40, for instance, the void 571 suitably extends axially all the way through the end 527*b* of the ring member 525*b* from the free end of the projection 563 on one side of the end of the ring member to the side of the end 527*b* of the ring member opposite the projection.

Because the void 571 extends beyond the base of the projection 563 there is a less abrupt change in thickness of the molded polymeric material where the fingers 575 of the projection are connected to the end 527*b* of the ring member 525*b*. This provides several advantages, such as alleviating problems that can occur when a molded polymeric structure cools unevenly after being removed from the mold. This can improve durability of the projection 563. Also, because the void 571 extends through the end 527*b* of the ring member, the distal most portion of the end 527*b* of the ring member 525*b* is connected to the rest of the ring member by a pair of arms 579 on opposite sides of the void 571 (e.g., above and below the void). The arms 579 can flex very slightly as the projection 563 is inserted into the opening 565 in the end 527*a* of the other ring member 525*a* to help alleviate stress concentrations in the projection 563 (e.g., where the fingers 575 are connected to the end 527*b* of the ring member 525*b*). This can also improve durability of the projection 563 and performance of the retaining system 561 over numerous opening and closing cycles. The void 571 can also facilitate removal of the mechanism 501 from the mold.

The portion of the void 571*a* within the projection 563 has a first volume in the non-retaining position and a second volume smaller than the first volume when the ring members 525 are at an intermediate position in which the retaining system 561 is between the retaining position and the non-retaining position. The portion of the void 571*a* within the projection 563 has a third volume (which may be equal to the first volume, equal to the second volume, or different from both the first and second volumes) when the retaining system 561 is in the retaining position. In the illustrated embodiment, the volume of the portion of the void 571*a* within the projection 563 is about equal to the volume of the void in the non-retaining position. In order to remove the projection 563 from the opening, a force large enough to deform the projection and deform the void to compress it to it second volume is required. This helps ensure the retaining system 561 holds the rings 523 in the closed position. As the portion of the void 571*a* within the projection is compressed to a smaller volume, the other portion of the void 571*b* can expand to a larger volume as the arms 579 flex slightly to alleviate undesirable stress concentrations.

FIGS. 44-46B illustrate a sixth embodiment of a ring binder mechanism 605. This ring mechanism 605 is substantially identical to the mechanism 505 described above, except as noted. The projection 663 of the retaining system suitably includes four fingers 689. The void 671 is generally plus-shaped and extends between each of the four fingers 689. The void 671 does not extend axially beyond the projection 683. Moreover, the void 671 extends from the free end of the projection a distance that is less than the distance to the opposite end of the projection 663. The void 671 is compressed by the opening 665 in multiple radial directions as the projection 683 is inserted in the opening. Accordingly, when the retaining system 661 is in the retaining position (FIG. 46B) the fingers 689 and opening 665 exert radial forces on each other than help limit the possibility the rings will be inadvertently opened.

FIGS. 47-49B illustrate a seventh embodiment of a ring binder mechanism 705. This ring mechanism 705 is substantially identical to the mechanism 505 described above, except as noted. The projection 763 of the retaining system 761 suitably comprises a peripheral wall 791 extending to the free end of the projection. There is a void 771 surrounded by the wall 791. The void 771 extends axially from the free end of the projection 763 at least part of the way through the axial length of the projection. The wall 791 suitably tapers outward as it extends toward the free end of the projection 763 when the retaining system 761 is in the non-retaining position. Although the peripheral wall 791 (and thus the projection 763) are tapered, the opening 765 suitably has straight sides when the retaining system 761 is in the non-retaining position. The opening 765 is configured to resiliently compress the projection 763 and the void 771 therein as the projection is inserted in the opening (e.g., due to the taper of the wall 791 and the straight sided opening 765). Accordingly, when the retaining system 761 is in the retaining position (FIG. 49B) the peripheral wall 791 and opening 765 exert radial forces on each other than help limit the possibility the rings will be inadvertently opened.

Figure 50:
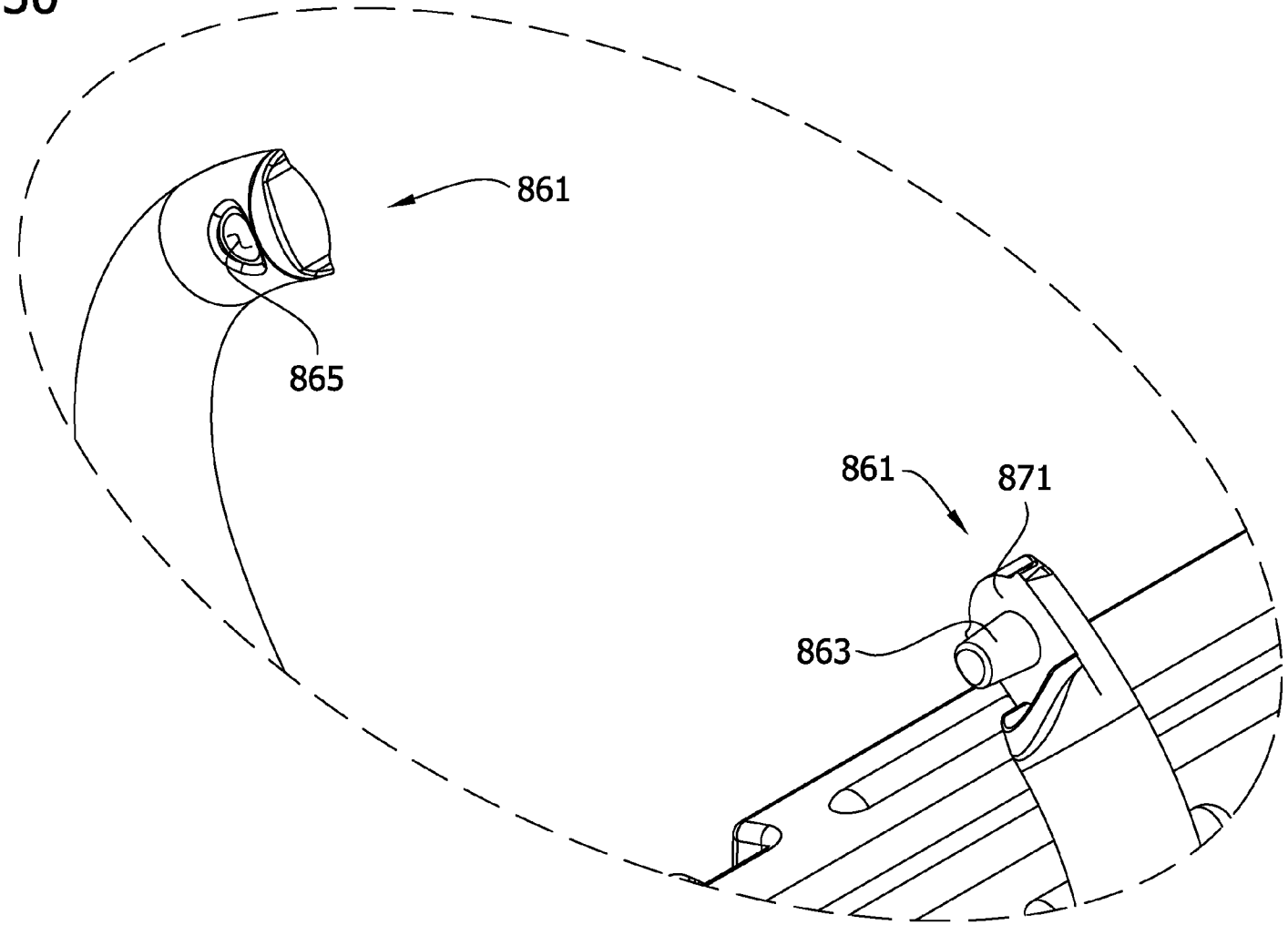
FIG. 50 is a perspective of an interlocking formation on the ends of the ring members of an eighth embodiment of a ring mechanism.
Figure 51:
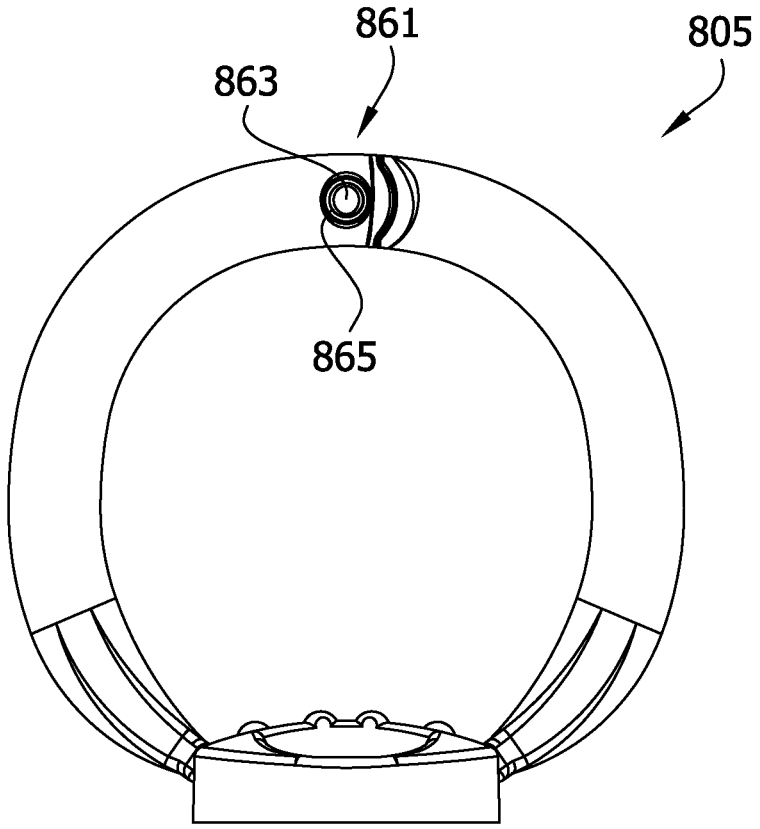
FIG. 51 is a side elevation of the ring mechanism illustrated in FIG. 44.
Figure 52A:
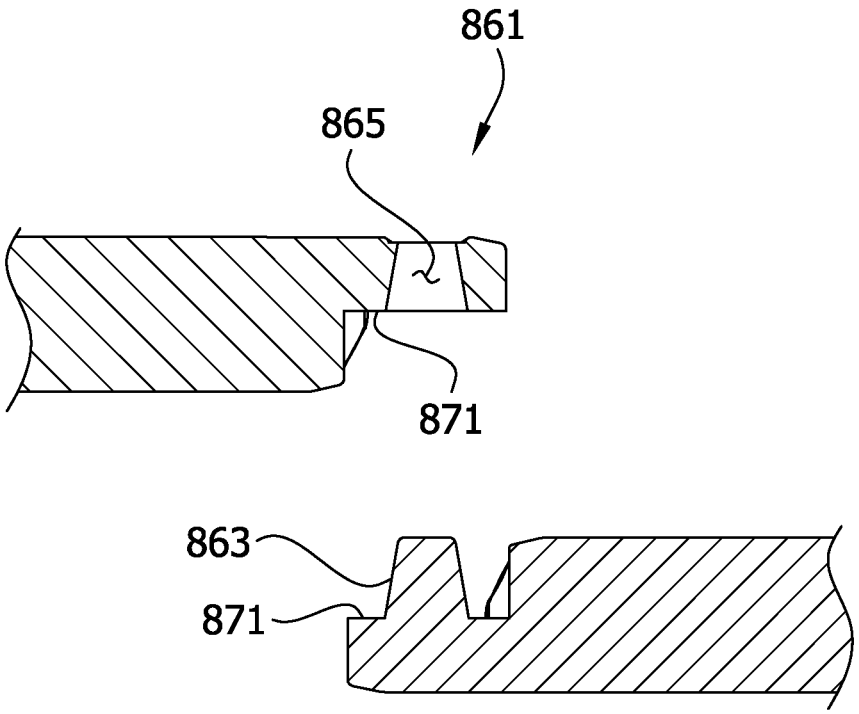
FIGS. 52A-52B illustrate a sequence in which a retaining system of the mechanism illustrated in FIGS. 44 and 45 is moved to a retaining position.
Figure 52B:
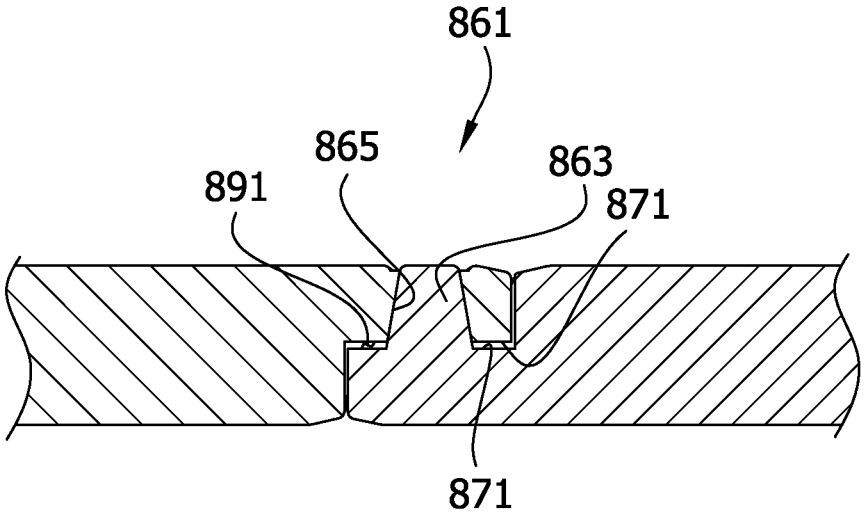
Figure 53:
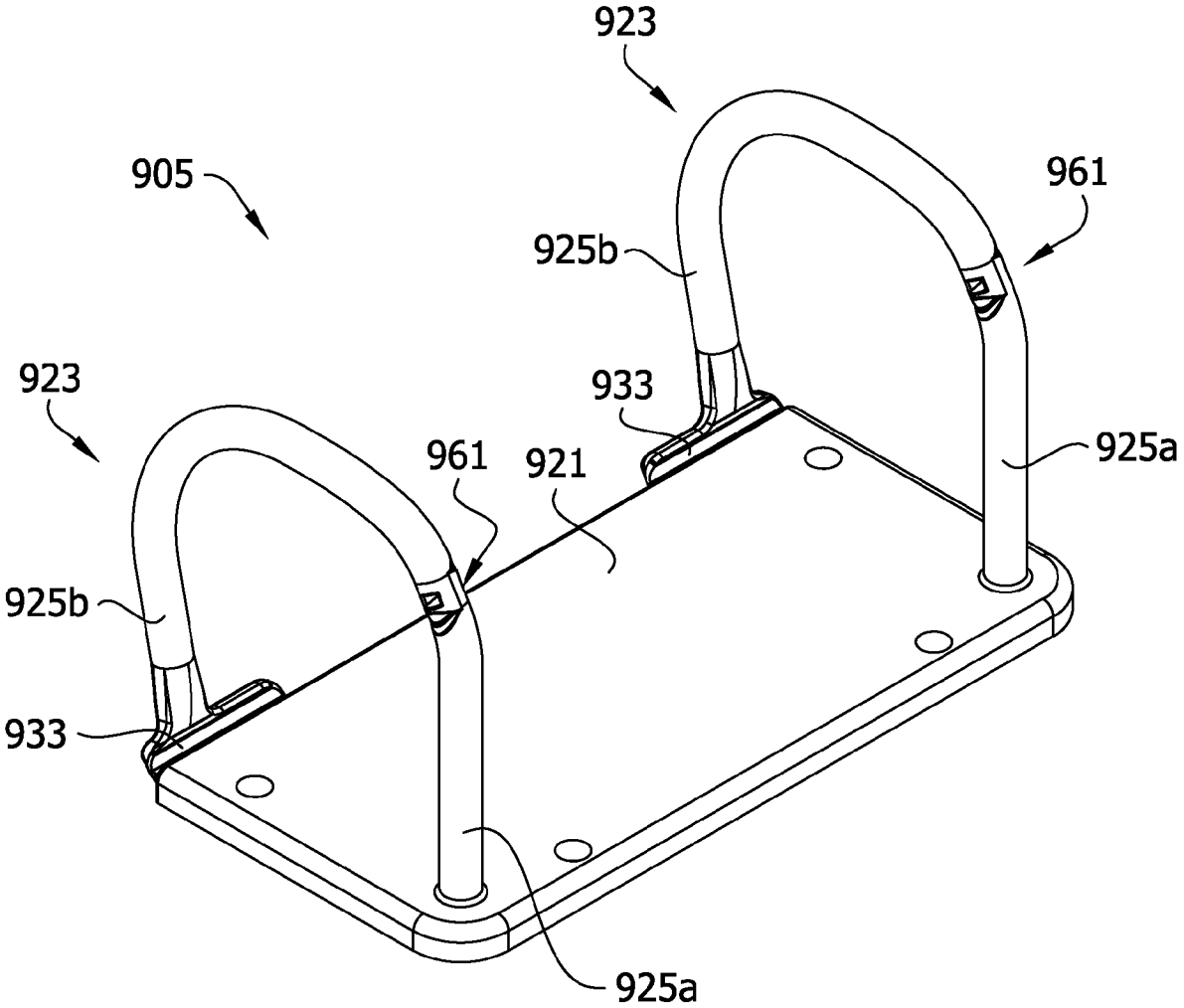
FIG. 53 is a perspective of a ninth embodiment of a ring mechanism.
Figure 54:
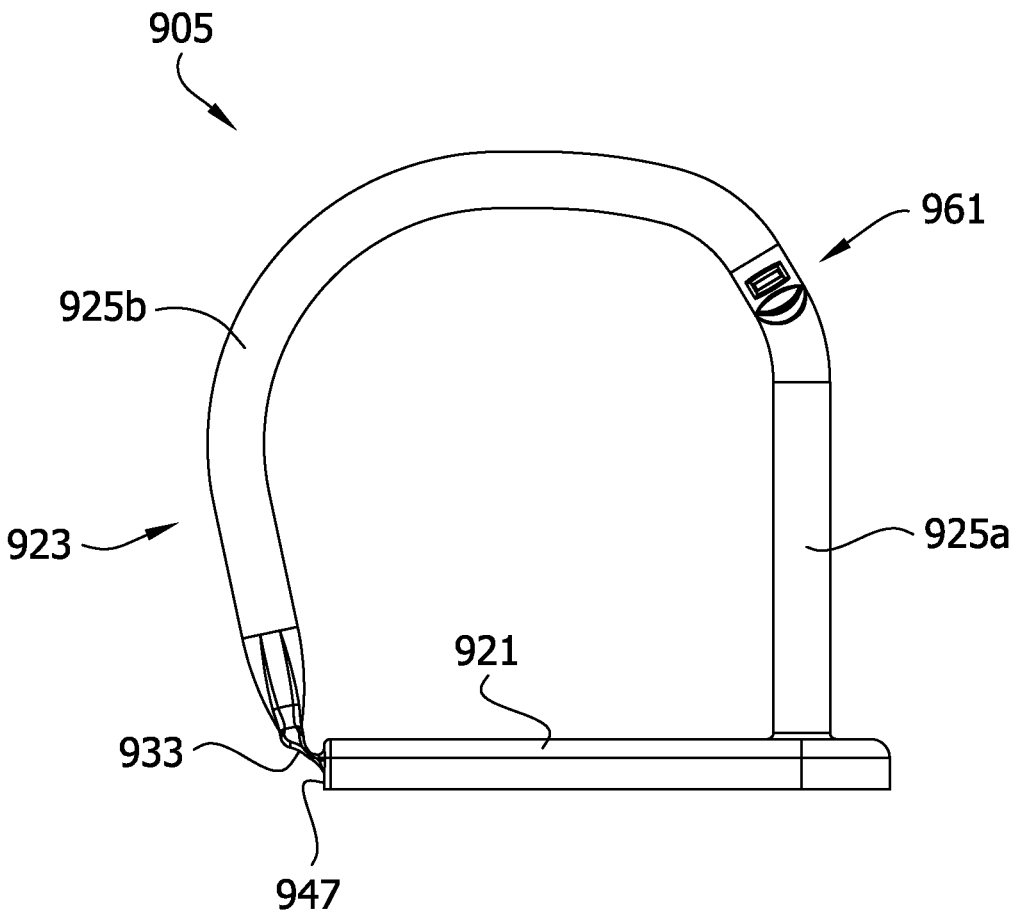
FIG. 54 is a side elevation of the ring mechanism illustrated in FIG. 53.
Figure 55:
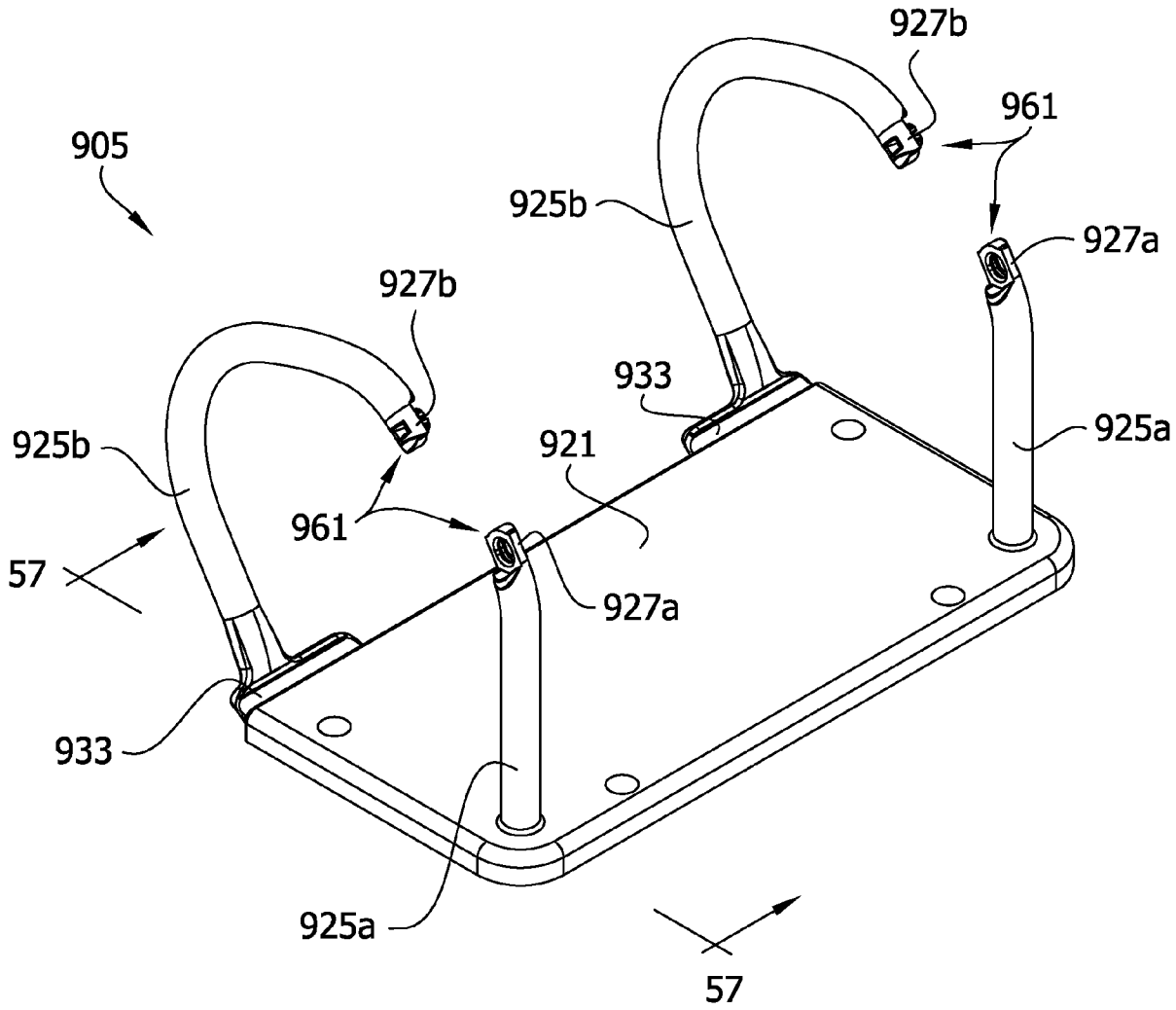
FIG. 55 is a perspective of the ring mechanism illustrated in FIGS. 53 and 54 showing the rings in an open position.
Figure 56:
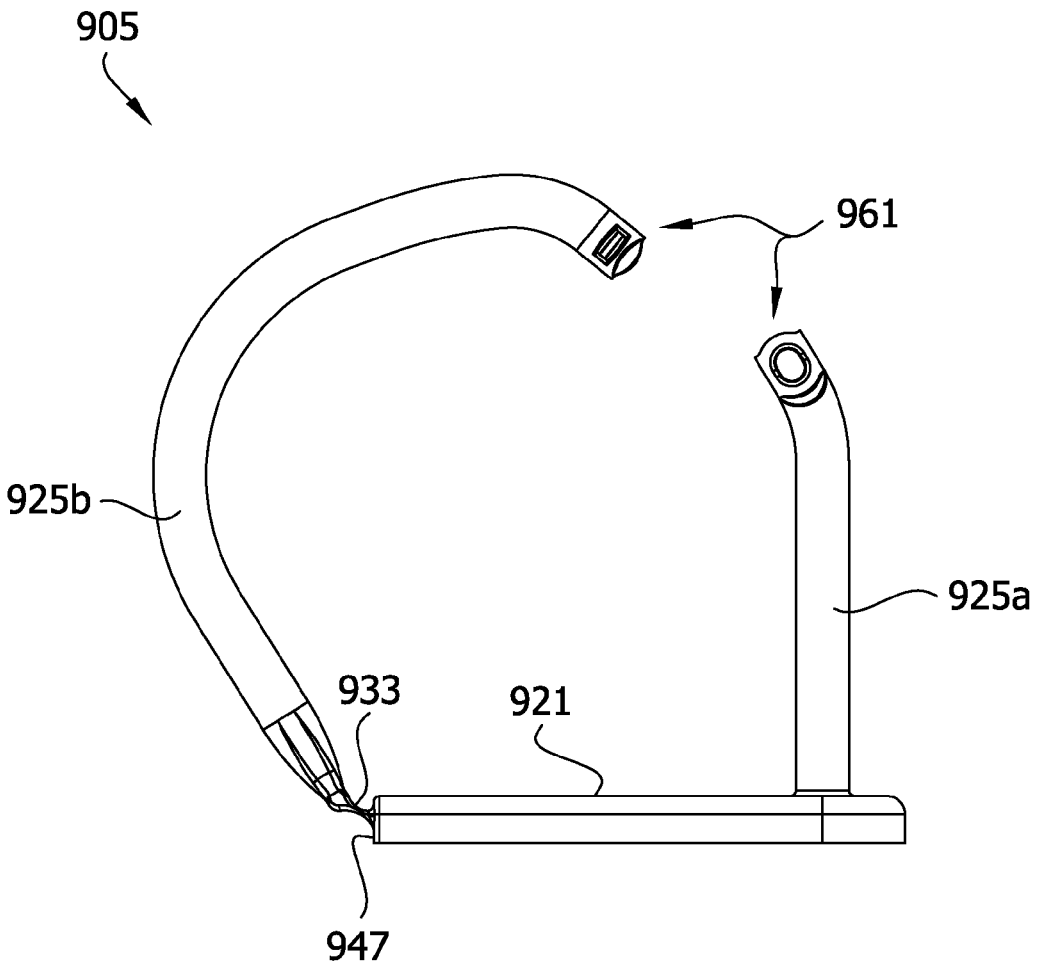
FIG. 56 is a side elevation of the ring mechanism illustrated in FIGS. 53-55 showing the rings in an open position.
Figure 57:
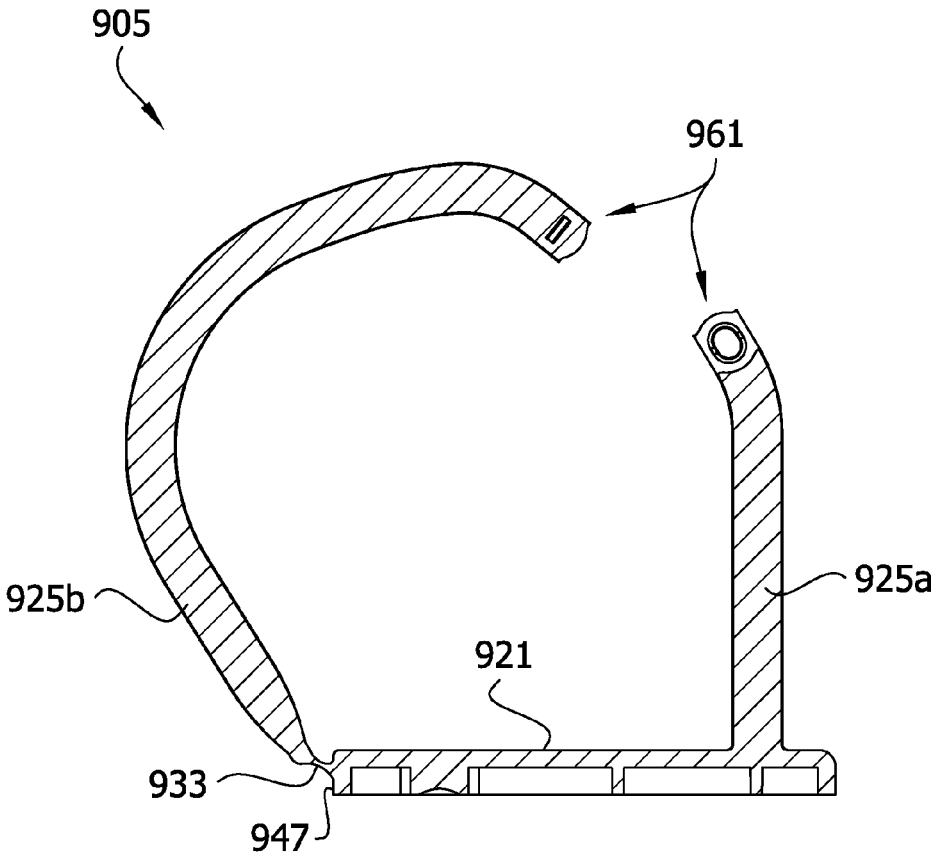
FIG. 57 is a cross section of the ring mechanism illustrated in FIGS. 53-56 taken in a plane including line 57-57 on FIG. 55.
Figure 58:
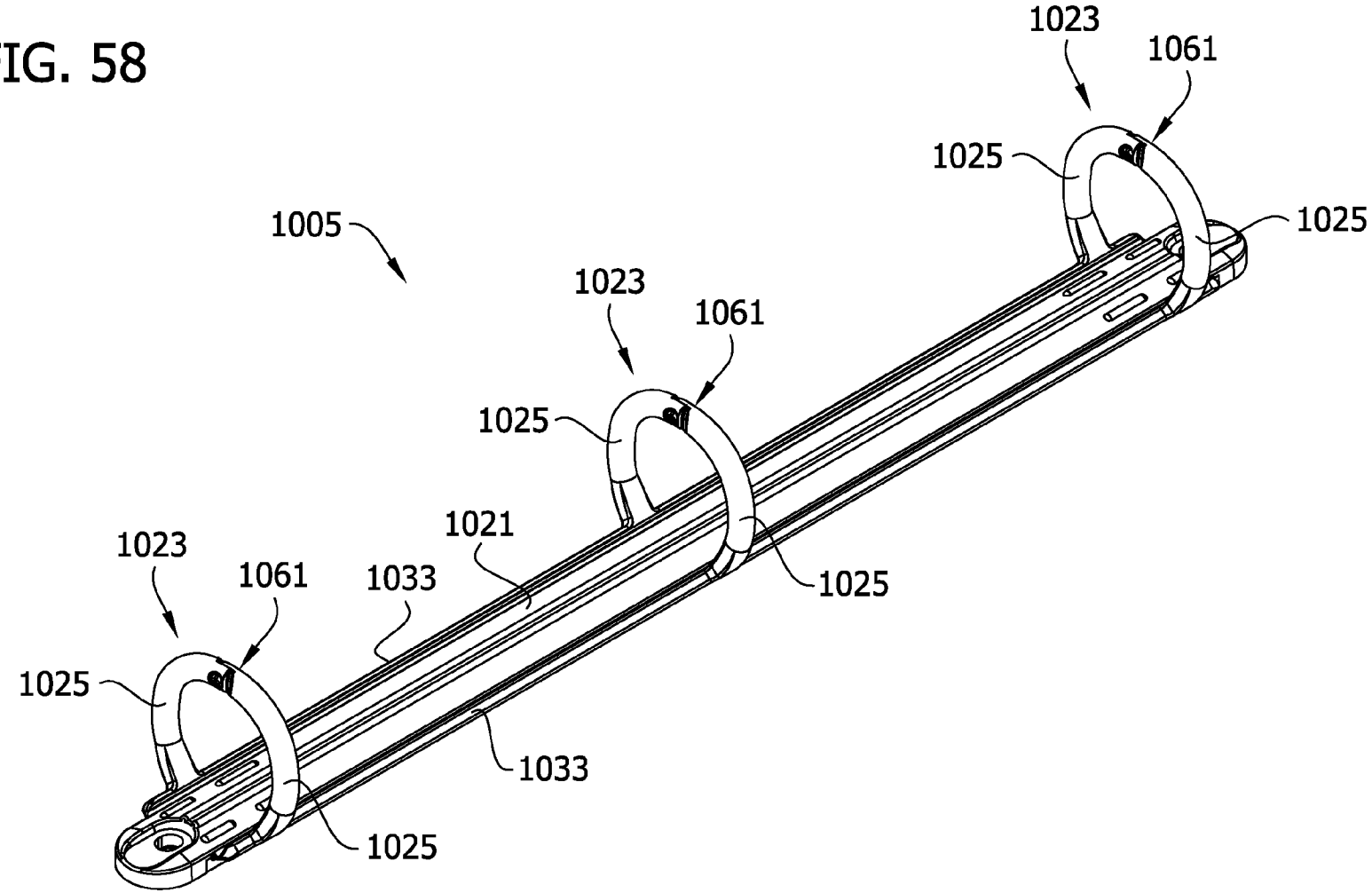
FIG. 58 is a perspective of a tenth embodiment of a ring mechanism.
Figure 59:
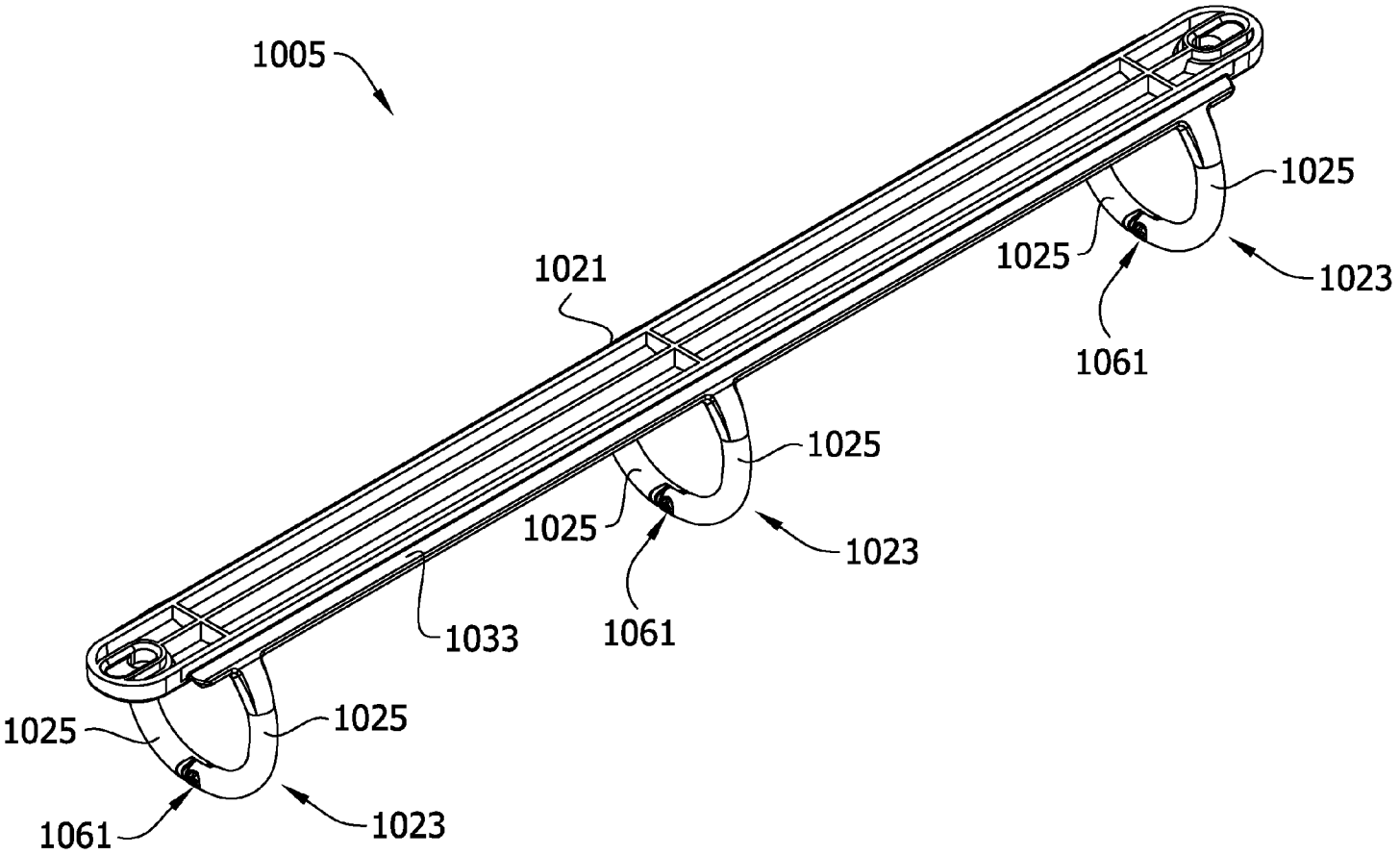
FIG. 59 is another perspective of the ring mechanism illustrated in FIG. 58 from a vantage point in which the bottom of the mechanism is visible.
Figure 60:
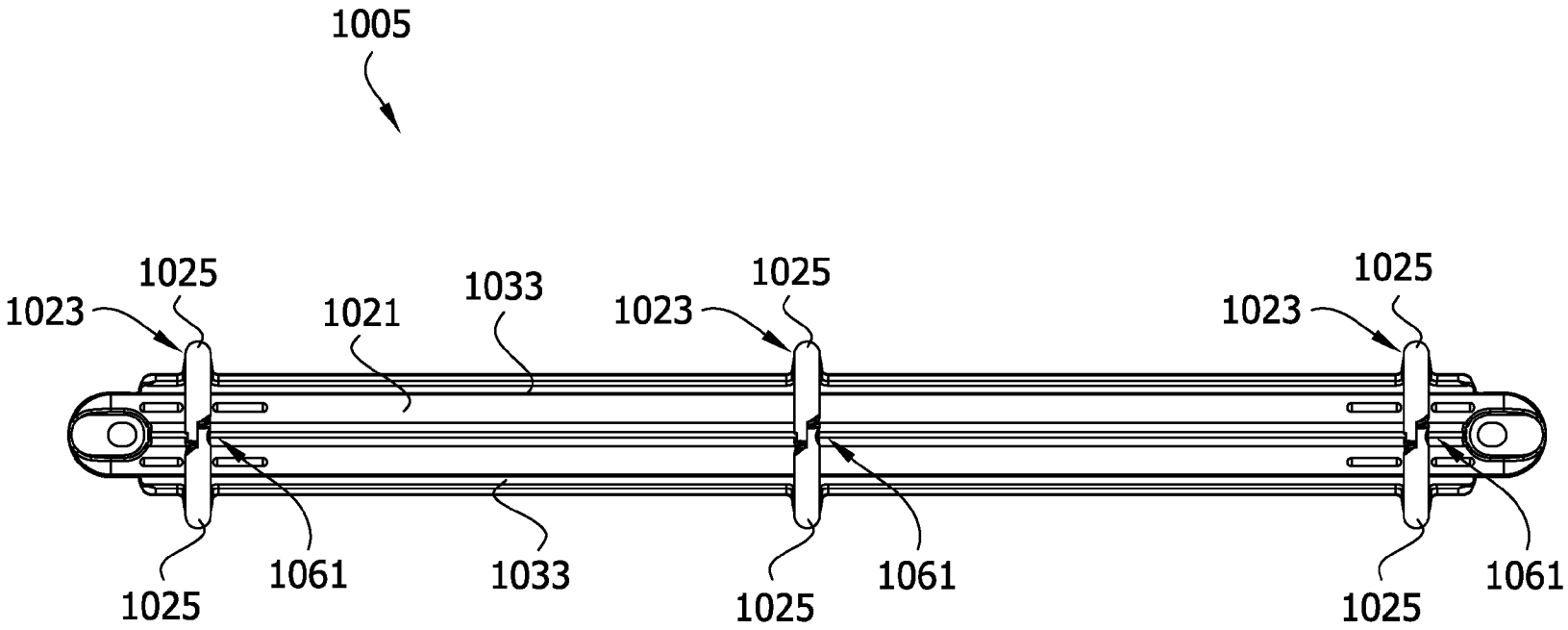
FIG. 60 is a top plan of the ring mechanism illustrated in FIGS. 58 and 59.
Figure 61:
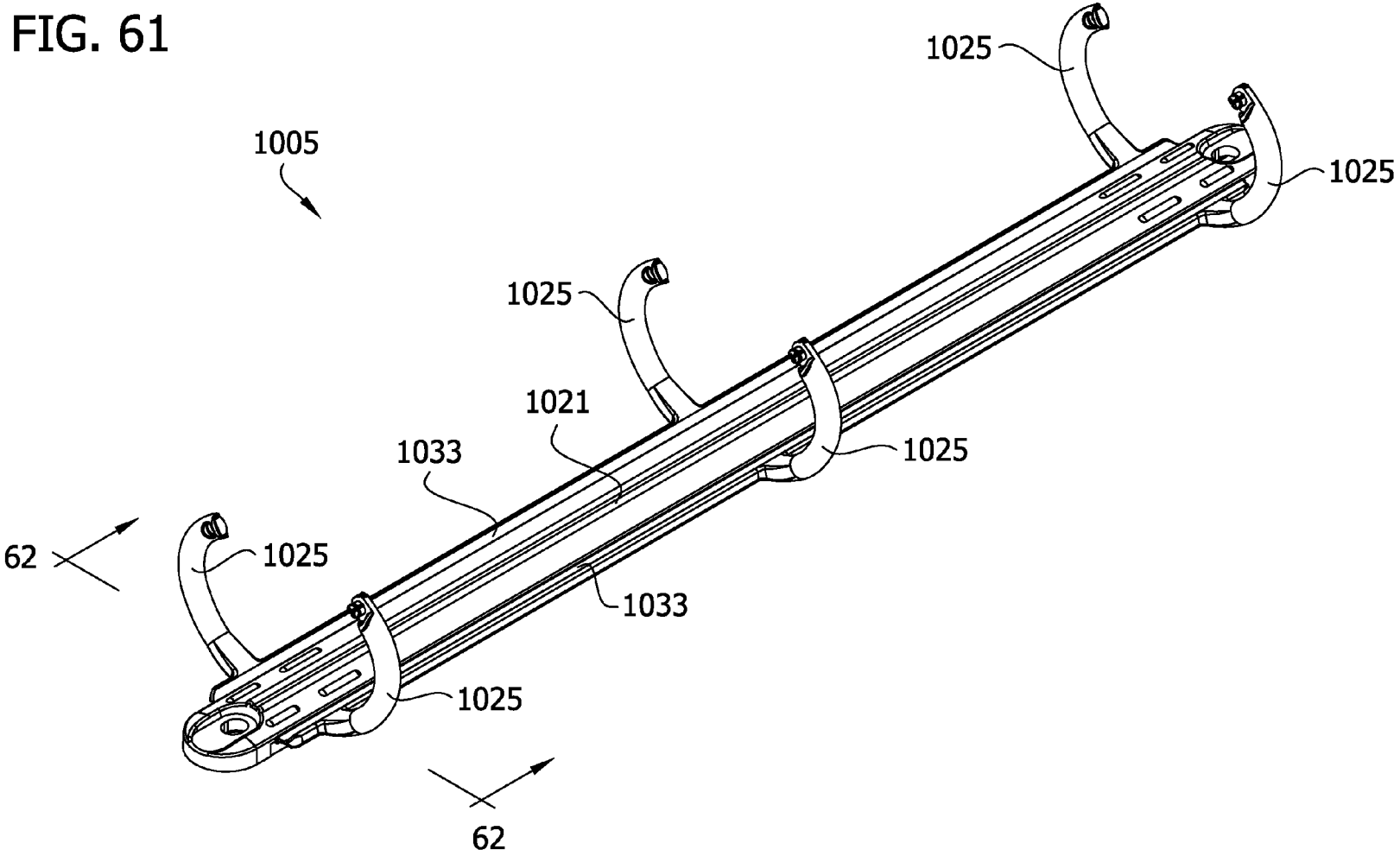
FIG. 61 is a perspective of the ring mechanism illustrated in FIGS. 58-60 showing the rings in an open position.
Figure 62:
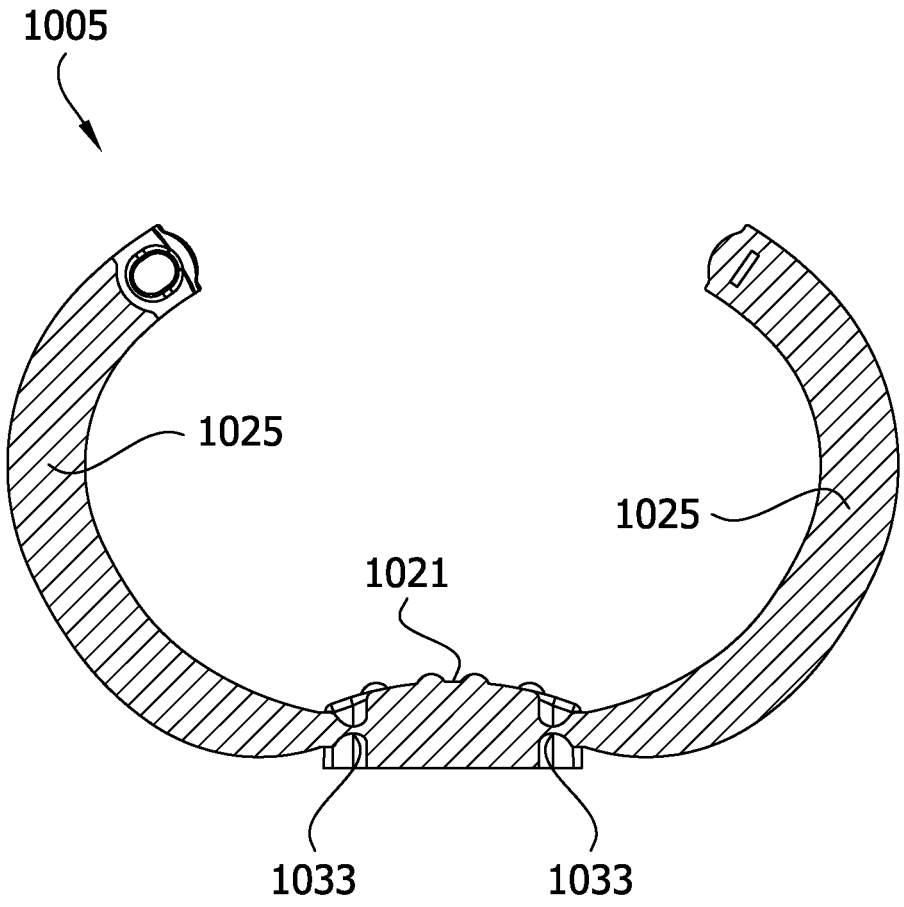
FIG. 62 is a cross section of the ring mechanism illustrated in FIGS. 58-61 taken in a plane including line 62-62 on FIG. 61.

FIGS. 50-52B illustrate an eighth embodiment of a ring binder mechanism 805. This ring mechanism 805 is substantially identical to the mechanism 505 described above, except as noted. The retaining system 861 includes a projection 863 (e.g., a post as in the illustrated embodiment) extending axially of the body 821. The opening 865 in the opposite ring member 825 is adapted to receive the post 863 when the ring members 825 are closed and the retaining system 861 is in the retaining position. The post 863 suitably extends from a relatively wider base to a relatively narrower free end. As shown in FIGS. 50 52A, and 52B, the post 863 is suitably has a frusto-conical shape. The opening 865 is suitably tapered to conform to the shape of the post 863, as illustrated. The opening 865 and projection 863 are dimensions so the opening compresses the projection as it is inserted into the opening. When the ring members 825 are in the retaining position and the projection 863 in its as manufactured condition is fully inserted into the opening, there is a gap 891 between the facing surfaces 871 of the ring members. This gap 891 facilitates continued performance of the retaining system 861 even after the post 863 and opening 865 are worn down from repeated opening and closing of the rings.

FIGS. 53-57 illustrate a ninth embodiment of a ring binder mechanism 905. This ring mechanism 905 is substantially identical to the mechanism 505 described above, except as noted. Whereas movement of the ring members 525 of the mechanism 505 describe above is substantially similar to many conventional metal ring binders of the type having rings mounted on hinge plates supported by a metal housing, the opening and closing movements of the rings 923 of the mechanism illustrated in FIGS. 53-58 are substantially similar to the movements of the rings of a lever arch mechanism. The rings 923 of this mechanism 905 include one ring member 925*b* that is moveable relative to the body 921 and another ring member 925*a* that is substantially fixed to the body. The moveable ring members 925*b* are each connected to a side 947 of the body 921 by a living hinge 933. The living hinges 933 include arcuate notches 937 and a hinge rib 957 corresponding to the notches 537 and hinge rib 557 described above. Each fixed ring member 925*a* suitably includes a segment extending substantially straight up from the body 921. There is no living hinge connecting the fixed ring members 925*a* to the body 921 and the fixed ring members 925*a* do not move as easily as the moveable ring members 925*b*. However, the ends 927*a* of the ring members 925*a* can be moved slightly relative to the body 921 by elastic deformation of the ring members (e.g., to engage or disengage the retaining system 961). In the illustrated embodiment, a segment of the ring member adjacent the end 927*b* extends slightly inward toward the opposite ring member 925*b*. The mechanism 905 includes a retaining system 961 substantially similar to the retaining system 561 described above. The body 921 and rings 923 are suitably formed as one piece from a moldable polymeric material as described above.

Figure 63:
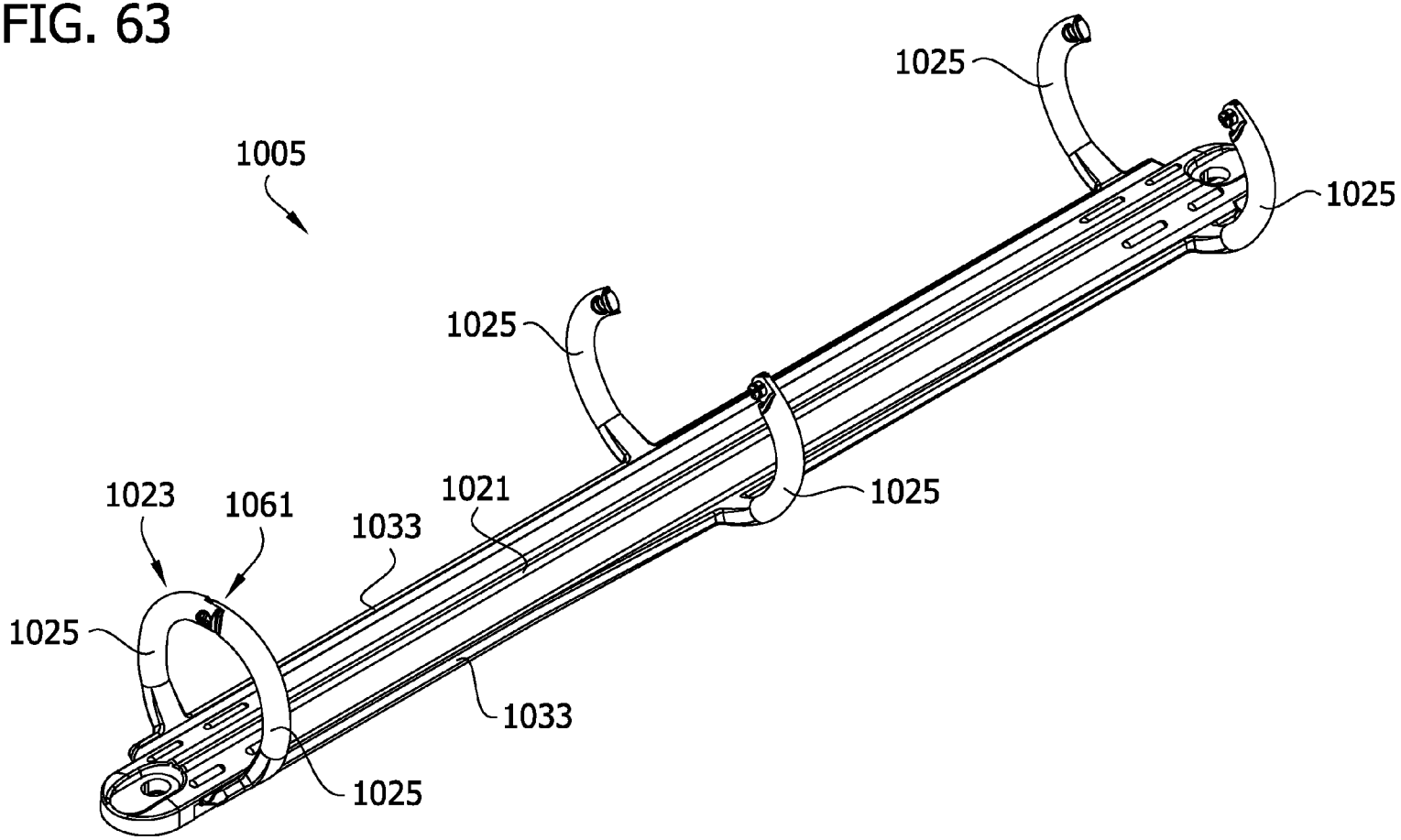
FIG. 63 is a perspective of the ring mechanism illustrated in FIGS. 58-62 showing one of the rings in a closed position while other rings are in an open position.

FIGS. 58-63 illustrate a tenth embodiment of a ring binder mechanism 1005. This ring mechanism 1005 is substantially identical to the mechanism 505 described above, except as noted. The living hinges 1033 are substantially identical to the living hinges 533 described above except that the hinges 1033 are not positioned in recesses along the side of the body 1021 and the hinges extend between adjacent rings 1023 (e.g., continuously along the entire side of the body) so multiple ring members 1025 are secured to the body by a single living hinge. For example, there is suitably a single living hinge 1033 on each side of the body 1021 that supports all of the ring members 1025 on that side of the body for pivoting movement between the open and closed positions of the rings 1023. As illustrated in FIG. 63, the living hinges 1033 suitably have sufficient flexibility to allow the ring members 1025 of one ring 1023 to be pivoted independently of the ring members of an adjacent ring having ring members connected to the same living hinge. The ring mechanism 1005 includes a retaining system 1061 substantially similar to the retaining system 561 described above.

FIGS. 64-72 illustrate an eleventh embodiment of a ring binder mechanism 1105. The ring mechanism 1105 includes an elongate body 1121 supporting a plurality of rings 1123 (e.g., three rings as illustrated in FIG. 1) for retaining loose-leaf pages. The body 1121 is suitably formed as a one-piece unitary structure made of a moldable polymeric material.

Figure 64:
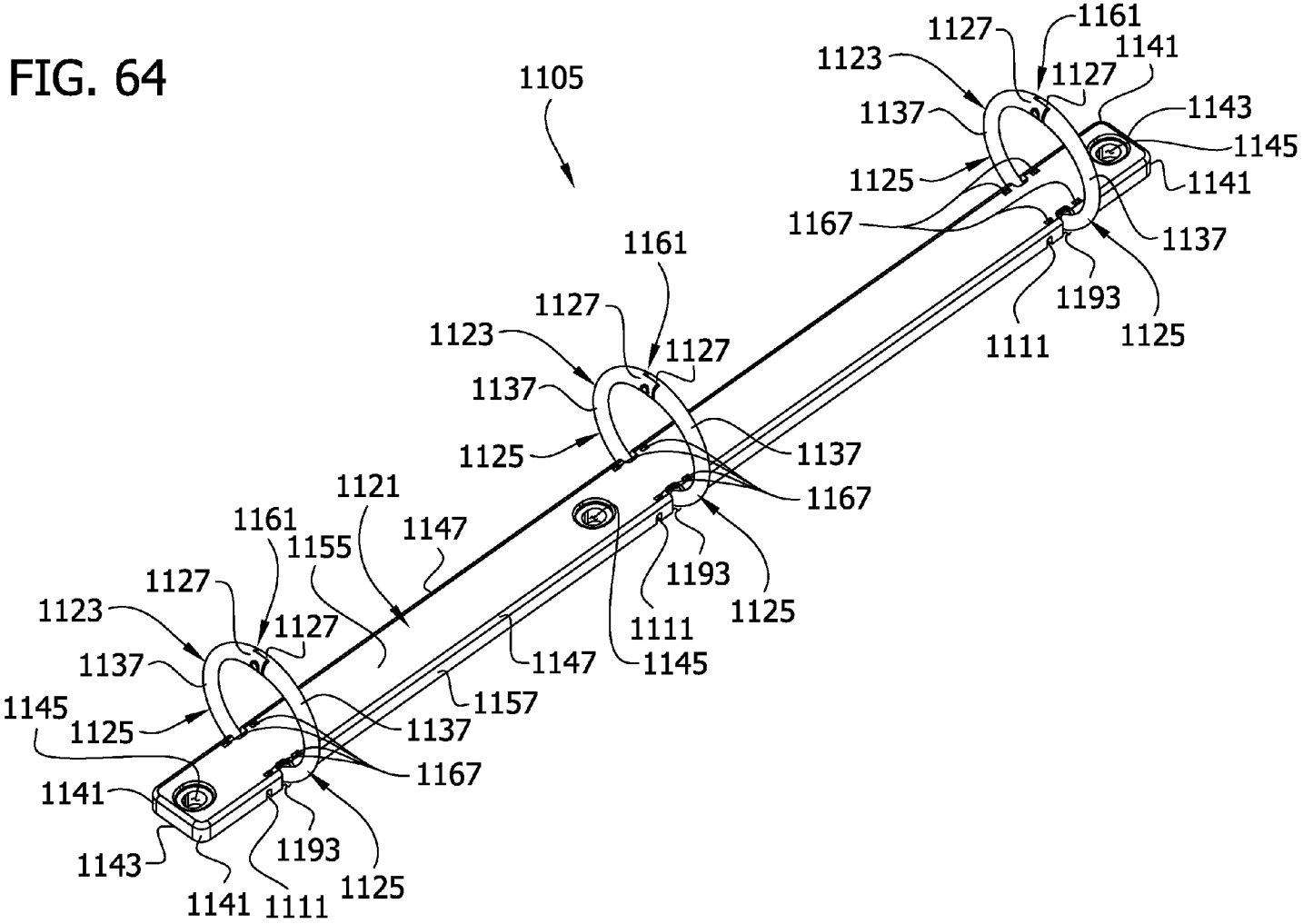
FIG. 64 is a perspective of an eleventh embodiment of a ring mechanism.
Figure 67:
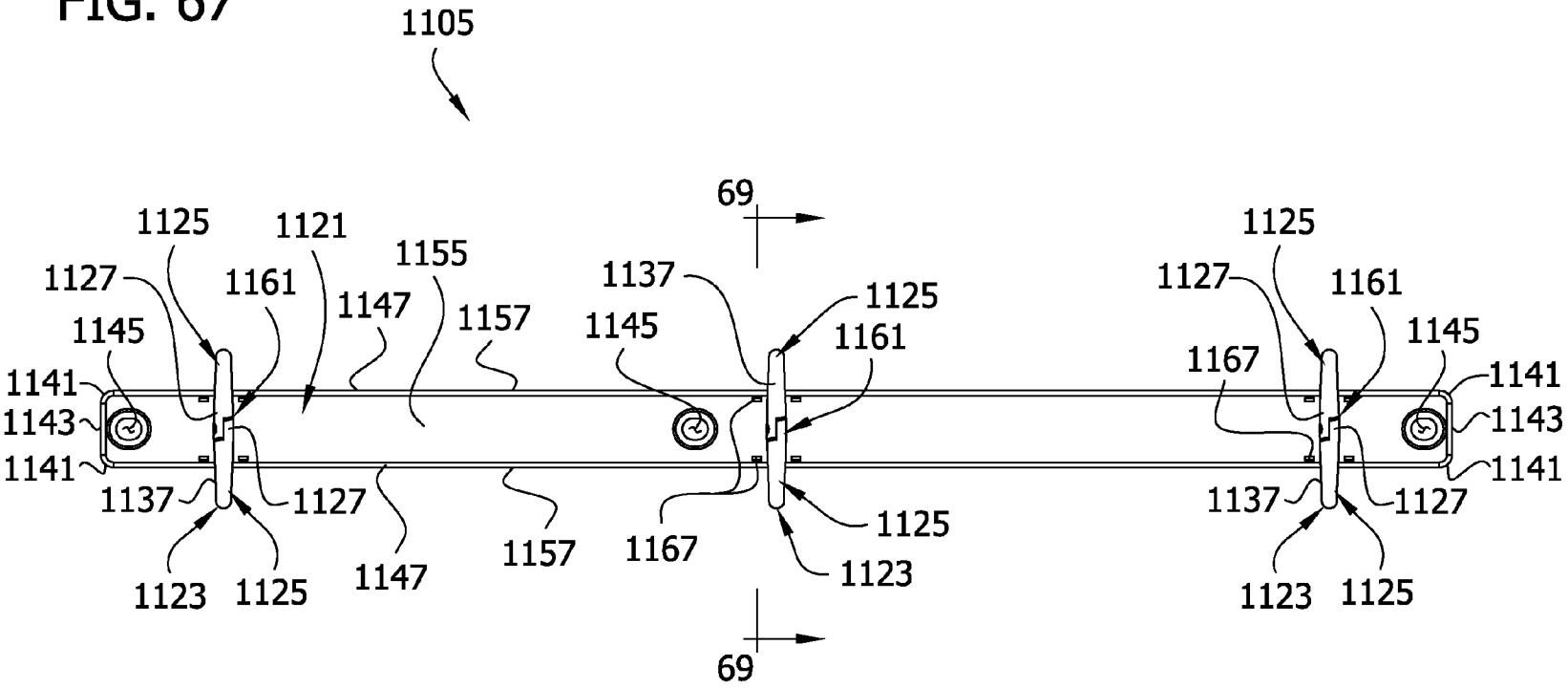
FIG. 67 is a top plan of the ring mechanism illustrated in FIGS. 64-66.
Figure 68:
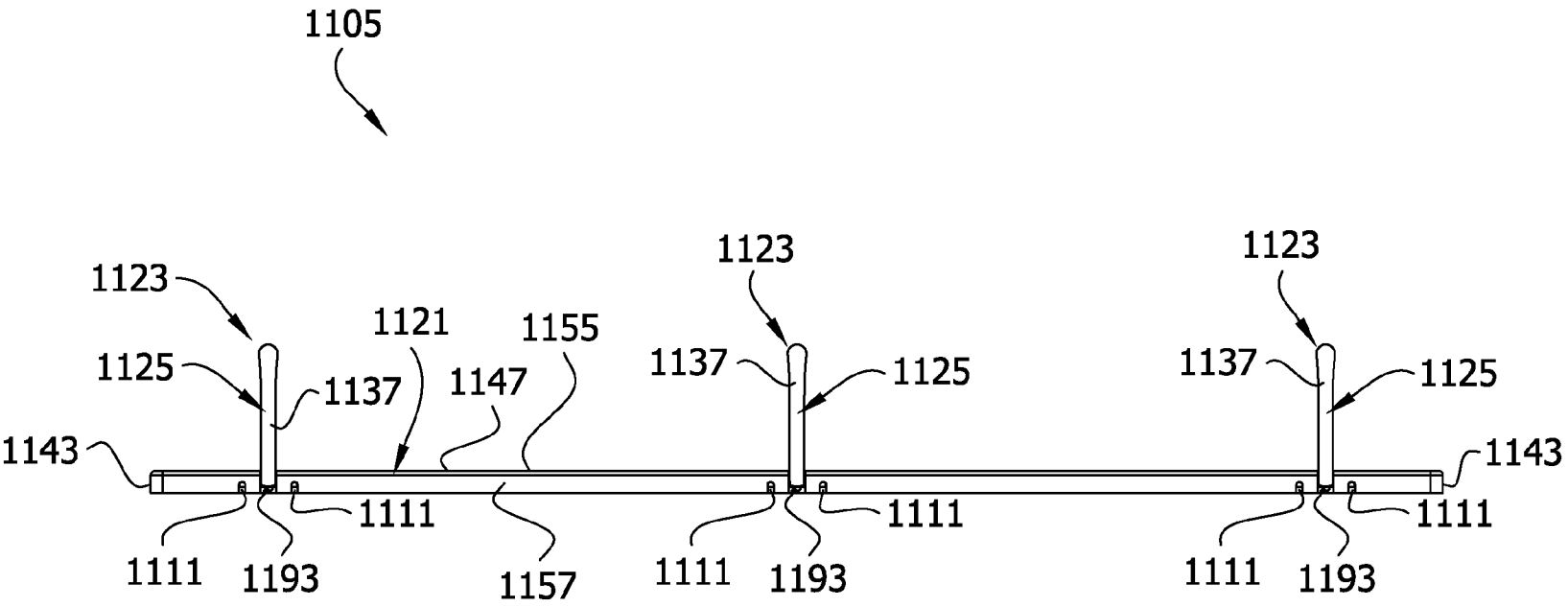
FIG. 68 is a side elevation of the ring mechanism illustrated in FIGS. 64-67.

Referring to FIGS. 64 and 67, the body 1121 has a top 1155 and sides 1157 extending down from the top. The body 1121 in the illustrated embodiment has a generally rectangular shape and rounded corners 1141 at its opposite ends 1143. The upper side edge corners 1147 of the body 1121 are also suitably chamfered or otherwise rounded/smooth so the body has no sharp features that could catch on clothing or injure people. The body 1121 has holes 1145 extending through the body at various positions along the longitudinal axis of the body between its ends 1143 for receiving rivets, prong fasteners, or other suitable fasteners (not shown) for securing the ring mechanism 1105 to the notebook cover 103 or other substrate. For example, as illustrated in FIG. 64, the body 1121 in the illustrated embodiment has a hole 1145 adjacent each end 1143 of the body 1121 and a third hole between two of the rings 1123. The holes 1145 are suitably spaced longitudinally from the rings 1123. Other ways of securing a ring mechanism body to a substrate, including those not requiring holes in the body are within the scope of the present invention.

The body 1121 is also reinforced with ribs 1175 (FIG. 65) extending from the top 1155 of the body. In particular, the body 1121 has longitudinal ribs 1177 (e.g., two longitudinal ribs) between the sides 1157 and extending generally along the central axis of the body between the rings 1123. Annular ribs 1185 extend around the holes 1145. The annular rib 1185 extending around the hole 1145 that is positioned between two of the rings 1123 is positioned between two segments of one of the longitudinal ribs 1177. The other longitudinal rib 1177 in the illustrated embodiment extends continuously from a position adjacent one of the rings 1123 to a position adjacent another of the rings. The body 1121 also includes a series of cross ribs 1179 extending between the sides 1157 of the body and generally perpendicularly to the longitudinal ribs 1177. The cross ribs 1179 suitably intersect the longitudinal ribs 1177 at various positions along the axis of the body 1121. The ribs 1175 and sides 1157 of the body 1121 provide a robust construction for the body using less material than would be required for a solid construction body having the same strength.

Figure 70:
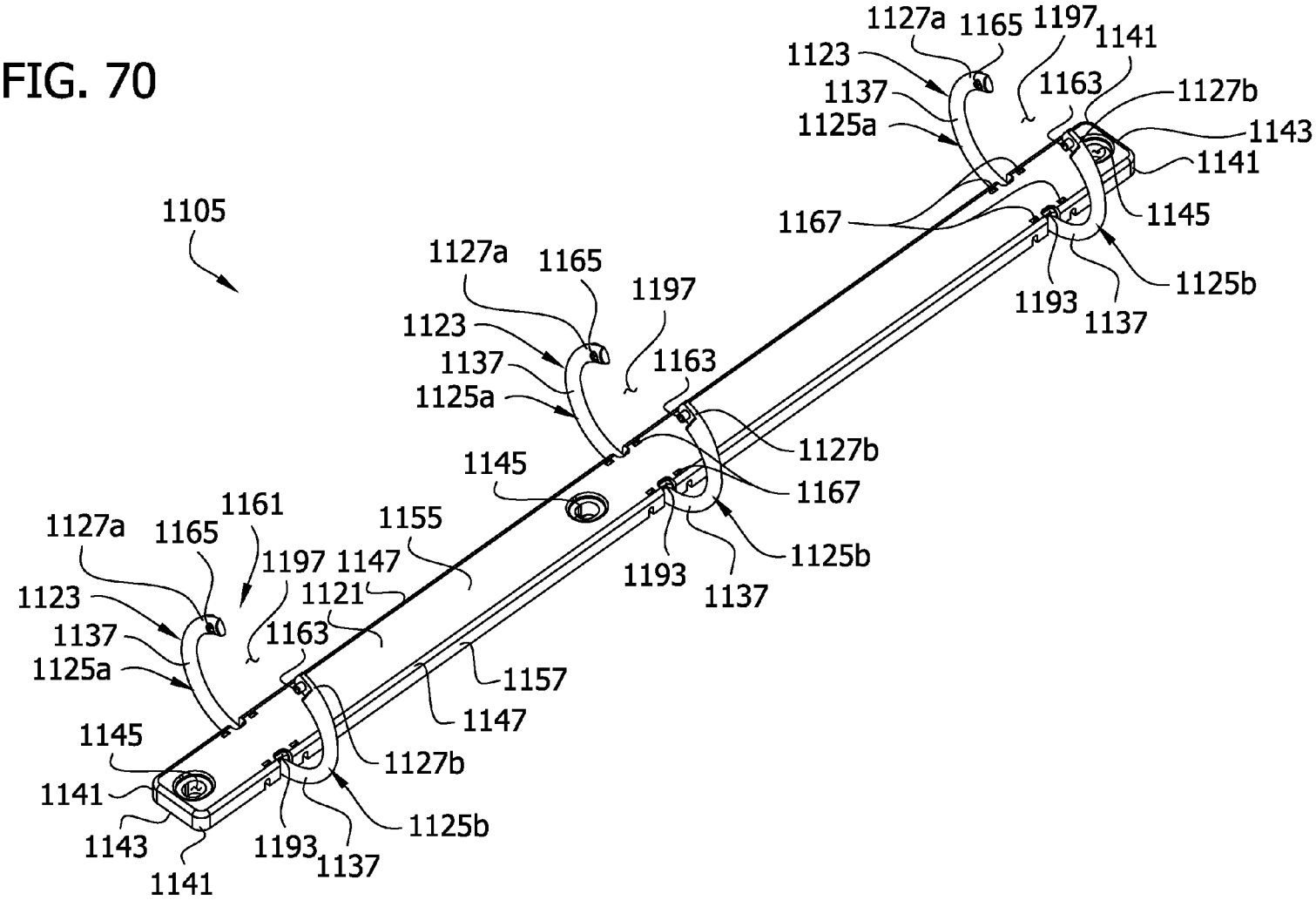
FIG. 70 is a perspective of the ring mechanism illustrated in FIGS. 64-69 showing the rings in an open position.
Figure 71:
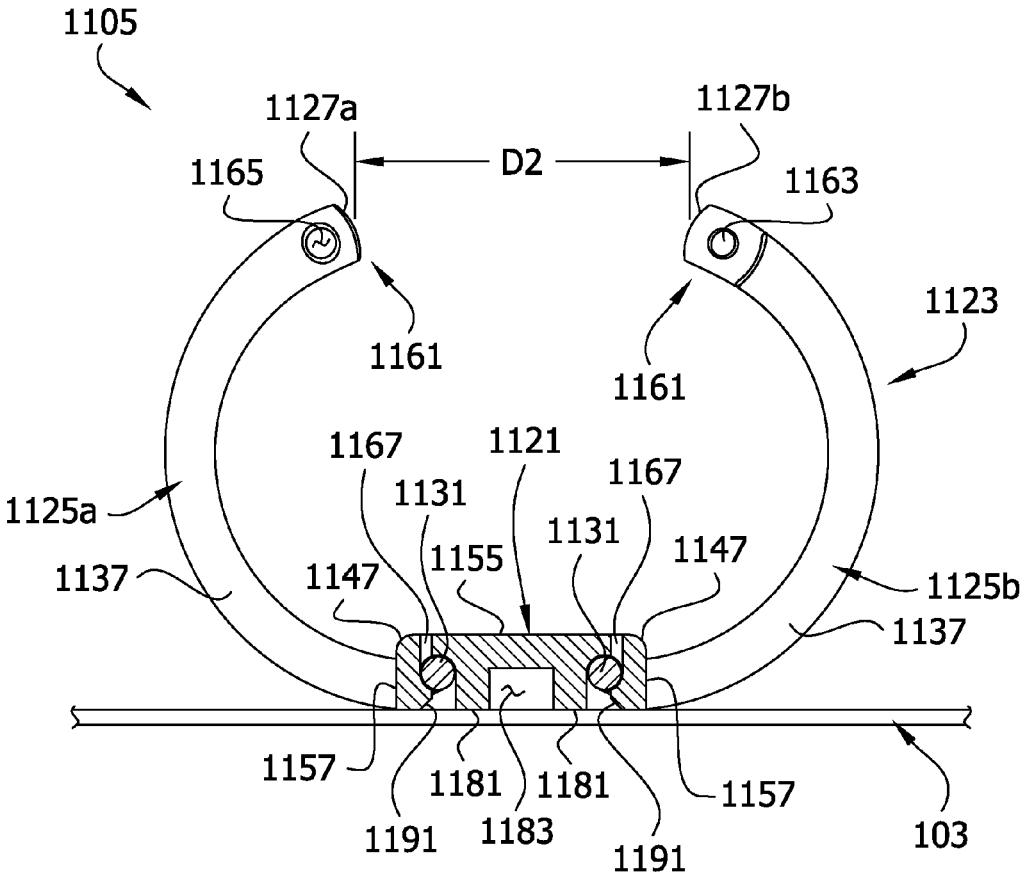
FIG. 71 is a cross section similar to FIG. 69 showing the rings in an open position.

Each of the rings 1123 includes first and second ring members 1125 extending from and supported by the elongate body 1121. For example, the ring members 1125 of each ring 1123 suitably extend from opposite sides 1157 of the body 1121, as illustrated in FIG. 64. The ring members 1125 are moveable relative to one another between a closed position (FIGS. 64-65) and an open position (FIGS. 70 and 71).

Figure 72:
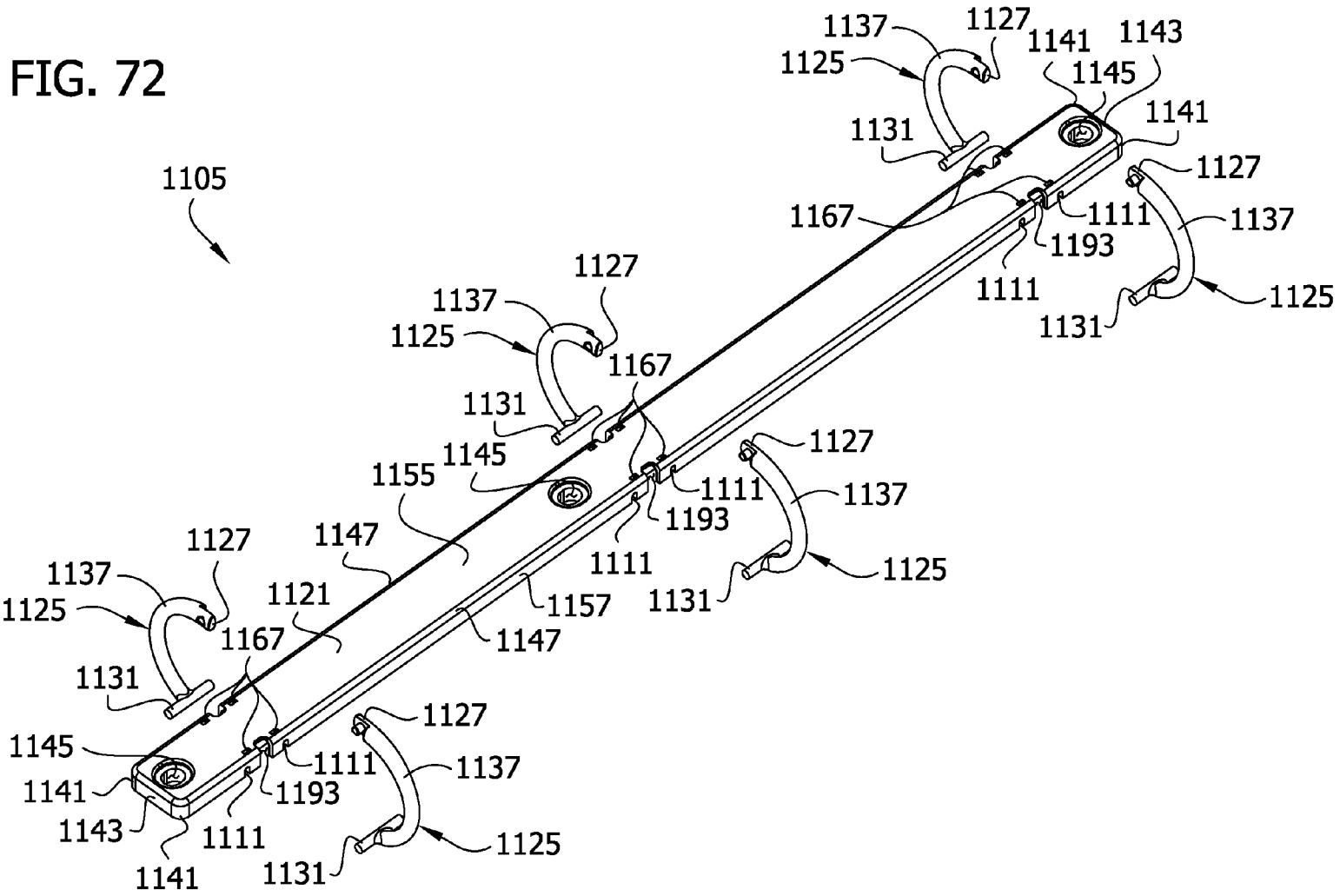
FIG. 72 is an exploded perspective of the ring mechanism illustrated in FIGS. 64-71.

At least one of the ring members is formed separately from the body. As shown in FIG. 72, for example, each of the ring members 1125 is suitably formed separately from the body 1121. Each ring member 1125 is also formed separately from each of the other ring members. Each ring member 1125 has a ring portion 1137 secured to an anchor 1131 that can be mounted for pivoting movement relative to the body 1121. Each individual ring member 1125, including the ring portion 1137 and its respective anchor 1131, is suitably formed integrally as one piece (e.g., in an injection molding process) from a moldable polymeric material. The ring members 1125 are suitably made of a material that allows resilient deformation of the ring members to close the rings 1123 using a retaining system 1161, which is suitably substantially similar to any of the retaining systems 161, 561, 661, 761, 861 described above. The ring members 1125 can be made from the same material as the body 1121 or the ring members and body can be made from different materials within the scope of the invention.

Figure 65:
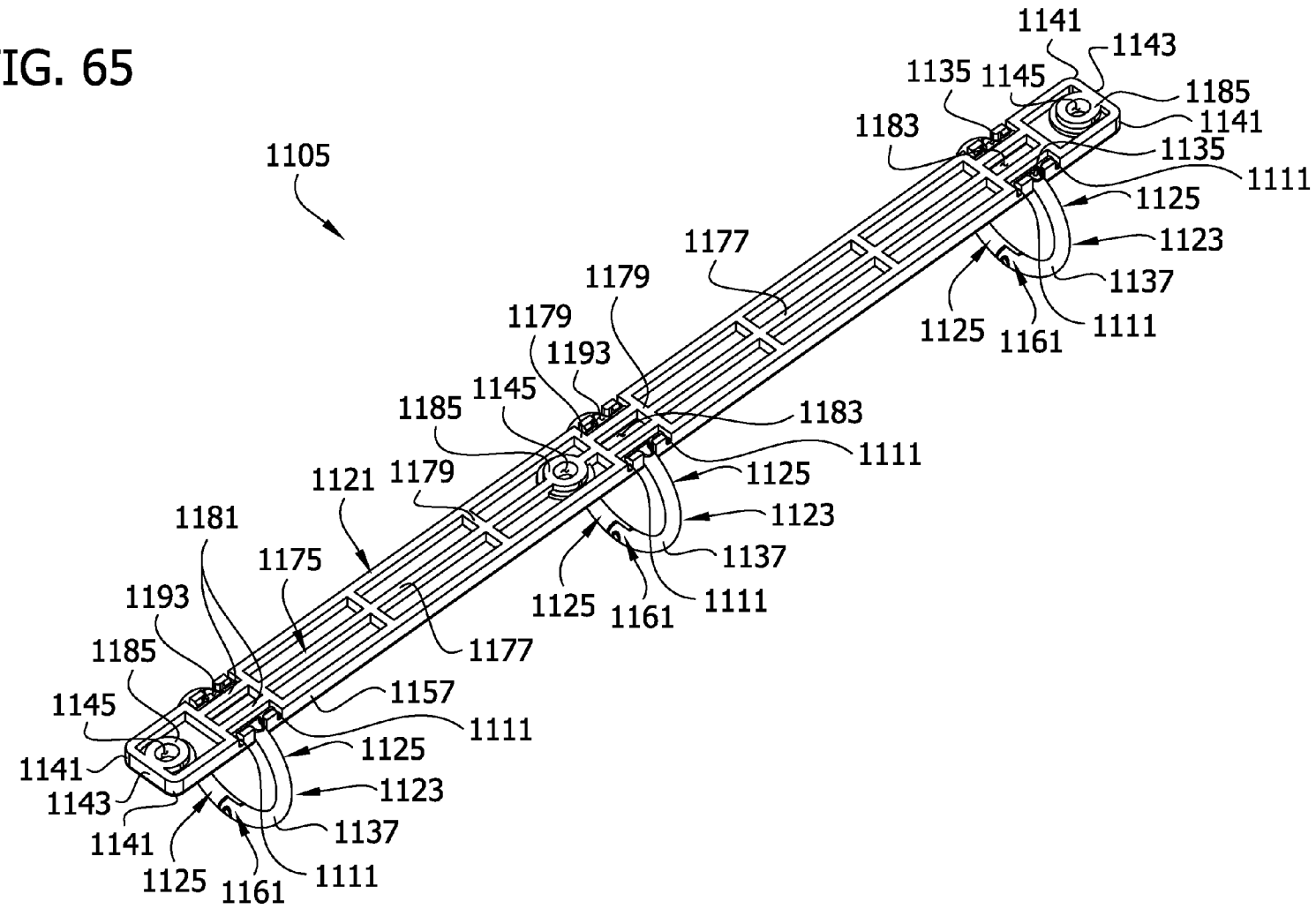
FIG. 65 is another perspective of the ring mechanism illustrated in FIG. 64 from a vantage point in which the bottom of the ring mechanism is visible.
Figure 66:
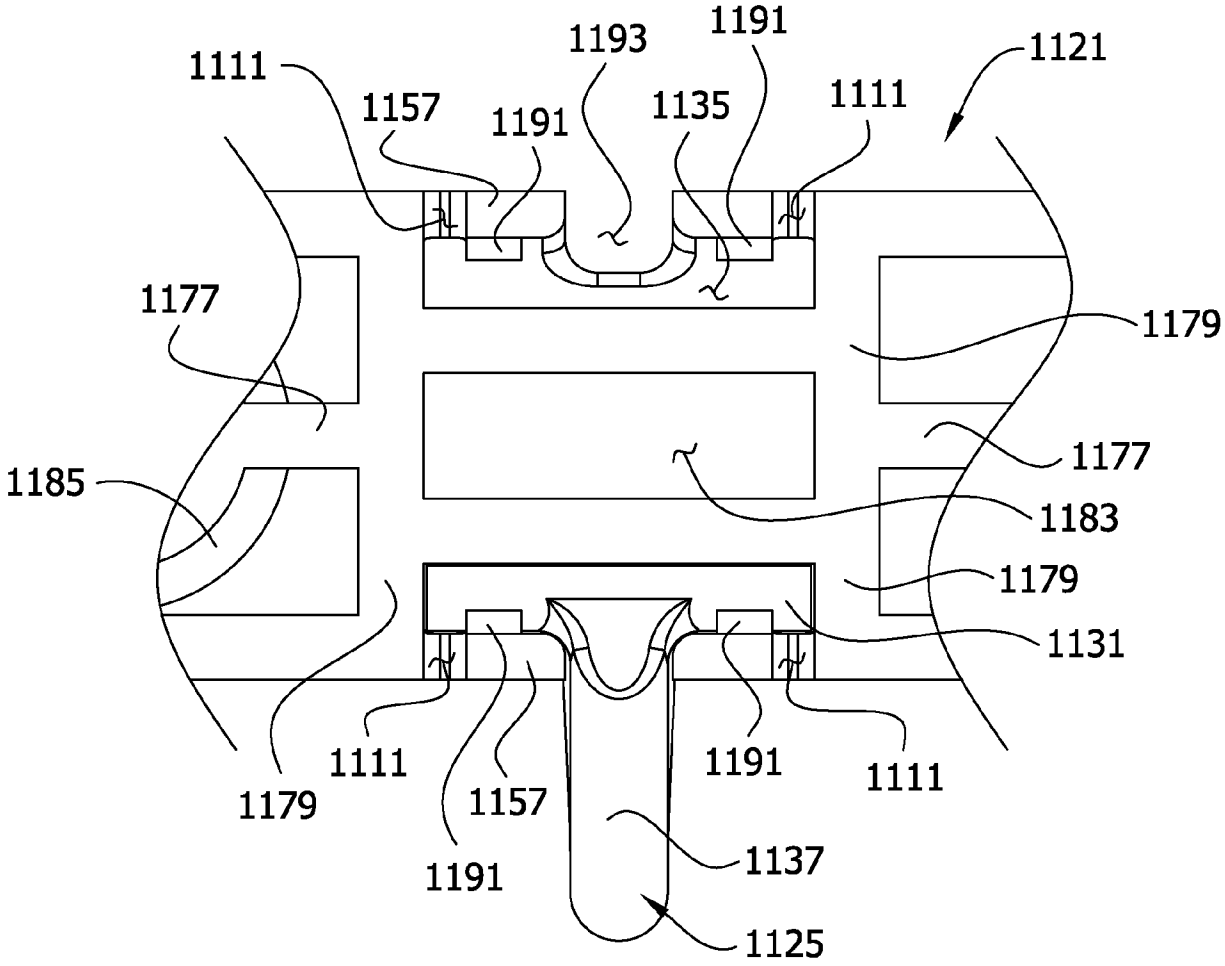
FIG. 66 is an enlarged fragmentary view of a portion of the bottom of the ring mechanism illustrated in FIGS. 64 and 65.

The body 1121 of the mechanism 1105 has ribs 1175 and sides 1157 that are configured to form receptacles 1135 for receiving and retaining the anchors 1197. The anchors 1131 and receptacles 1135 are suitably constructed so the anchors can be snapped into the receptacles during assembly of the ring mechanism 1105 to secure the ring members 1125 to the body 1121. The receptacles 1135 for each pair of ring members 1125 are suitably adjacent opposite sides 1157 of the body 1121. As illustrated in FIGS. 65 and 66, each of the receptacles 1135 is bounded by a segment of the side 1157, a longitudinally extending rib 1181 spaced laterally inward from the side, and two of the cross ribs 1179 on opposite axial sides of the ring 1123. In the embodiment illustrated in FIG. 65, the ribs 1175 are configured so there is a gap 1183 between the receptacles 1135 for the ring members 1125 of each ring 1123. It is understood, however, that the configuration of the ribs 1175 illustrated in the drawings is just one example and that there are other ways to configure the body to receive the ring member anchors 1131 within the scope of the invention.

Figure 69:
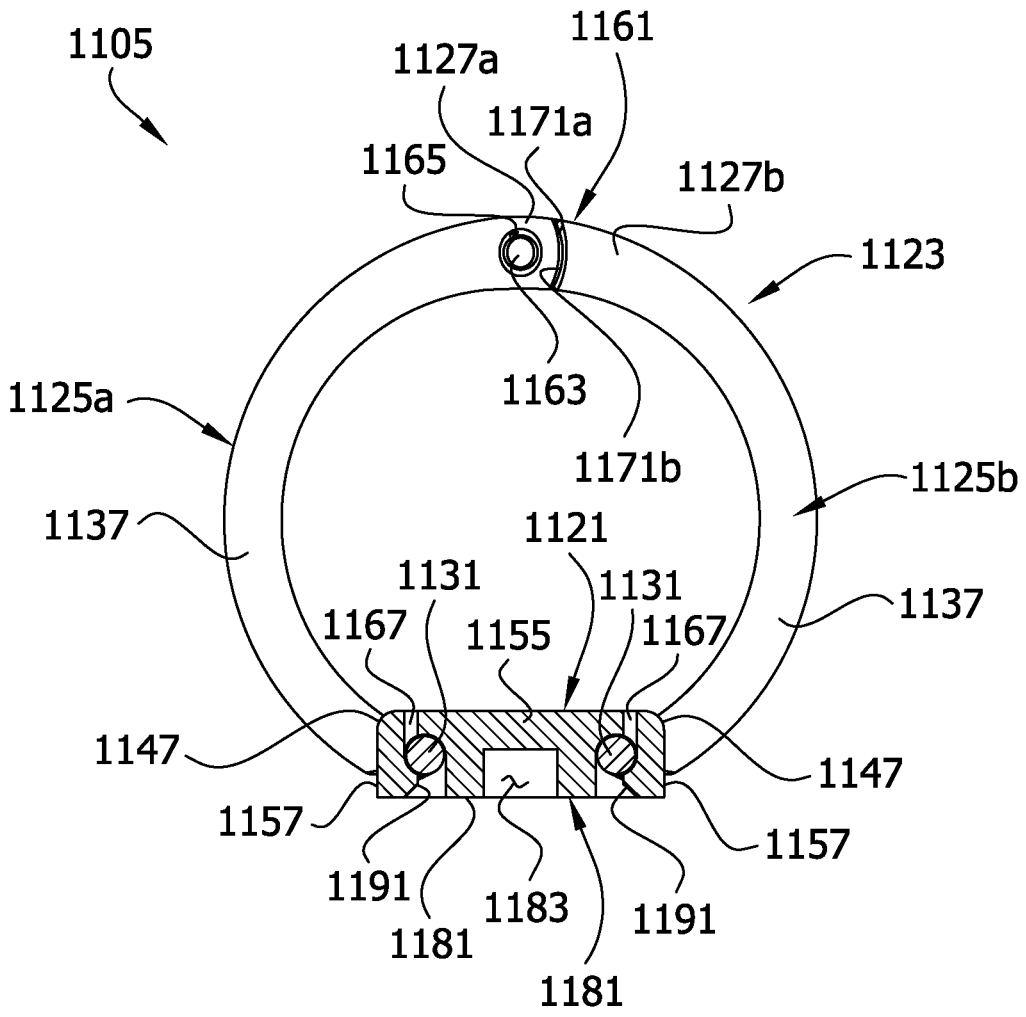
FIG. 69 is a cross section of the ring mechanism illustrated in FIGS. 64-68 taken in a plane including line 69-69 on FIG. 67.

As illustrated in FIG. 72, each of the ring member anchors 1131 is a relatively small elongate bar (e.g., a substantially cylindrical bar having a circular cross section as illustrated). The receptacles 1135 in the body 1121 are adapted to receive and retain the bars 1131 in an orientation in which the bars are generally parallel to the longitudinal axis of the body 1121. The body 1121 suitably has retainers 1191 positioned to extend laterally into each receptacle 1135 to hold the anchors 1131 in the receptacle. For example, as illustrated in FIGS. 66 and 69, the retainers 1191 extend from the sides 1157 of the body 1121 laterally inward toward the longitudinal centerline of the body. The retainers 1191 are suitably constructed so the anchors 1131 can be snapped into the receptacles 1135 during assembly of the ring mechanism 1105.

There are openings 1167 in the body 1121 extending from the retainers 1191 through the upper surface of the body. The openings 1167 are suitably positioned generally above the laterally inwardly extending retainers 1191 so there is only void space in the body above the retainers. As those familiar with injection molding techniques will appreciate, the openings 1167 allow the body 1121 to be produced in an injection molding process using a mold design that is much simpler and which lasts longer than would be the case for an identical body without the openings. For example, the openings 1167 are suitably produced by projections extending from one side of the mold to the upper surface of the retainers. These projections help fix the body 1121 result in a mold design such the parts of the mold do not undercut the retainers 1191. However, a body that does not include any such openings can be used without departing from the scope of the invention.

As illustrated in FIG. 66, notches 1111 are positioned on the sides 1157 of the body 1121 adjacent each retainer 1191 opposite the ring member 1125. The notches 1111 separate the portion of the sidewall 1157 carrying the retainer 1191 from the rest of the sidewall. This facilitates flexing of the portion of the sidewall 1157 carrying the retainer 1191 while the anchor 1131 is being snapped into the receptacle 1135.

As illustrated in FIG. 66, the ends of the anchors 1131 are suitably in abutting relation with the sides of the cross ribs 1179 defining the ends of the receptacle 1135 in which they are received. Thus, the anchors 1131 and cross ribs 1179 hold the ring portions 1137 in registration with the notches 1193 so the notches can be dimensioned to provide substantial clearance for the ring portions without resulting in a lot of rattling movement or play in the longitudinal position of the ring members 1125 relative to the body 1121. This also allows the ring portions 1137 of the ring members 1125 to move between the open and closed positions without rubbing on the sides of the notches 1193.

Although the retainers 1191 provide significant resistance to removal of the ring member anchors 1131 from the receptacles 1135 once the anchors are snapped into position, the retainers 1191 and other features of the body 1121 provide relatively little resistance to pivoting of the retained ring members 1125 relative to the body. For example, the anchors 1131 have substantially circular cross sectional shapes and the surfaces of the body 1121 adjacent the anchors, including the retainers 1191, are shaped to substantially conform to the outer cylindrical surfaces of the anchors so the body provides relatively little resistance to pivoting movement of the anchors in the receptacle 1135 (e.g., about pivot axes coincident with the axis of the anchors and substantially parallel to the long axis of the body). Accordingly, a user can easily move the ring members 1125 of each ring 1123 manually between the open and closed positions by pivoting the ring members in the receptacles 1135.

It is also desirable that the distance D2 between the ends 1127 of the ring members 1125 in the open position be small enough so a user can readily move loose-leaf pages across the gap 1197 from one ring member to the other. As illustrated in FIG. 71, opening of the ring members 1125 beyond the open position is suitably limited by engagement of the ring members with a planar surface of the cover 103 or other substrate to which the ring mechanism 1105 is secured. The distance D2 between the ends 1127 of the ring members 1125 in the open position can vary depending on the size of the rings 1123. In general, the gap D2 between the ends 1127 of the ring members 1125 is larger for larger rings and smaller for smaller rings. The distance D2 is generally between about 10 mm and about 45 mm. For example, the distance D2 between the ends 1127 of the open ring members 1125 is suitably selected from the group consisting of: (1) between about 10 mm and about 30 mm in the case of ring members having diameters of no more than about 1 inch (or having equivalent loose-leaf retaining capacity in the case of non-circular rings); (2) between about 13 mm and about 35 mm in the case of rings having diameters ranging from about 1.0 inch to about 1.5 inches (or having equivalent loose-leaf retaining capacity in the case of non-circular rings); (3) between about 16 mm and about 40 mm in the case of rings having diameters ranging from about 1.5 inches to about 2.0 inches (or having equivalent loose-leaf retaining capacity in the case of non-circular rings); and (4) between about 20 mm and about 45 mm in the case of rings having diameters greater than about 2 inches.

Figure 73:
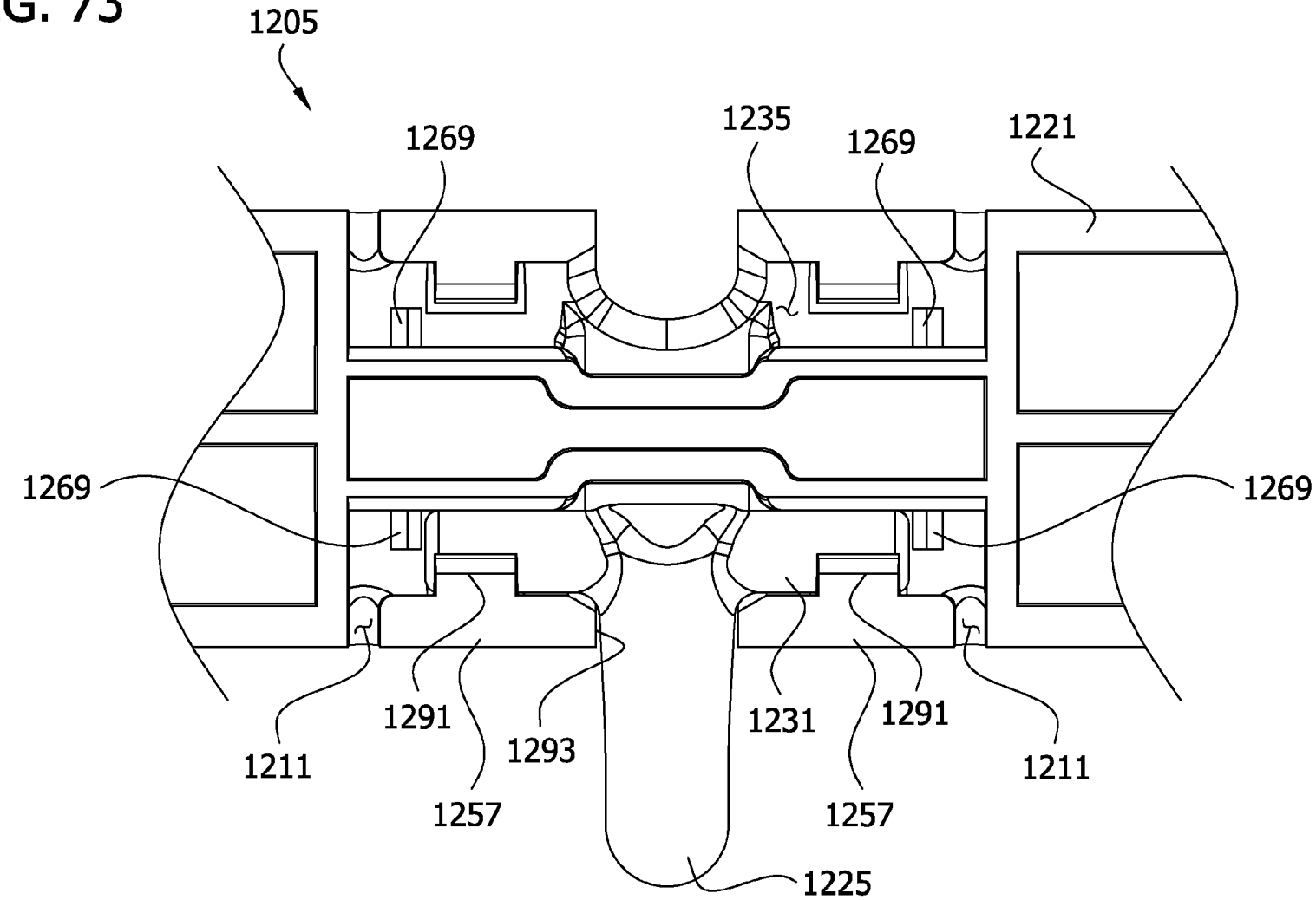
FIG. 73 is an enlarged fragmentary bottom plan of a portion of a twelfth embodiment of a ring mechanism Corresponding reference characters indicate corresponding parts throughout the drawings.

FIG. 73 illustrates another embodiment 1205 of a ring binder, which is substantially identical to the ring binder 1105 described above, except as noted. The receptacles 1235 in the body 1221 for the anchors 1231 in this embodiment have an axial length that exceeds the axial length of the anchors. The notches 1269 are spaced farther from the notches 1293 for the ring members 1225 than the corresponding notches 1111 described above. The notches 1211 still allow the portion of the sidewall 1257 carrying the retaining members 1291 to flex while the anchors 1231 are snapped into the receptacles, but these portions of the sidewall are stronger because of their increased length. The body 1221 includes stops 1269 in the receptacle that are positioned adjacent the ends of the anchors 1231 to hold the ring members 1225 in the desired axial position relative to the body 1221 and the notches 1293 formed in the sidewall 1257 for the ring members.

Because the ring members 1125 are formed separately from the body 1121, a plurality of mechanism 1105 can be shipped in a disassembled state to reduce shipping costs and assembled after they have been shipped. For example, several bodies 1121 can be shipped in one container while another container in the same or a different shipment has a plurality of ring members 1125. Alternatively, the bodies 1121 and ring members 1125 can be shipped together in the same container (e.g., with the bodies in one plastic bag or other sub-container and the ring members in another plastic bag or other sub-container). The disassembled ring mechanisms 1105 occupy a much smaller volume of space than would be required to ship the ring mechanisms in their assembled state and this can result in significant cost savings.

Another advantage of making the ring members 1125 separately from the body 1121 is that the rings 1123 can easily be made of a material having a different color from the body 1121. Moreover, some of ring members 1125 on a particular mechanism 1105 can easily be made of a material having a different color from other ring members on the same mechanism.

Also, the quality of the ring members 1125 of the mechanism 1105 has much greater impact on the overall performance of the mechanism 1105 than the body 1121. Thus, the performance of the ring mechanism 1105 is not significantly reduced if the performance standards of the body 1121 are reduced by comparison to those for the ring members (e.g., to allow a less expensive and/or more easily recyclable material, such as polypropylene, to be used to make the body).

Moreover, the same body 1121 can be used in conjunction with ring members 1125 configured to make different diameter rings 1123. For example, in one embodiment of a method of manufacturing ring mechanisms, a plurality of bodies 1121 are produced in the same mold of an injection molding machine or in a plurality of identical molds of one or more injection molding machines. One or more of the bodies 1121 are assembled with ring members 1125 having a first configuration. One or more others of the bodies 1121 are assembled with ring members 1125 having a second configuration different from the first configuration (e.g., larger in diameter, circular rings vs. D-rings, etc.). The ability to use the bodies 1121 interchangeably with different types of ring members 1125 allows manufacture of different types of ring mechanisms using only a single mold and/or single mold design for the body. This reduces the costs of designing and producing molds to make multiple different types of ring mechanisms.

Although each of the ring members forming each ring the embodiments illustrated in FIGS. 64-73 is formed separately, it is understood that one of the ring members for each ring can be formed integrally with the body within the scope of the invention. For instance, one ring member for each ring can suitably be an upright segment formed integrally with the body and fixed to the body, while the other ring member is formed separately from the body and snapped into the body as described above for the embodiments illustrated in FIGS. 64-73.

When introducing elements of the present invention of the preferred embodiments thereof, the articles "a", "an", "the", and "said" are intended to mean that there are one or more of the elements. The terms "comprising", "including", and "having" are intended to be inclusive and mean that there may be additional elements other than the listed elements.

In view of the foregoing, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A ring binder for use in holding loose-leaf pages, the ring binder comprising:

an elongate body having a width, a length greater than the width and an axis extending along the length of the elongate body;

rings for retaining loose-leaf pages, each ring including first and second ring members extending from and supported by the elongate body, the first and second ring members being moveable relative to one another between a closed position in which the first and second ring members together form a substantially continuous, closed loop for allowing loose leaf pages retained by the ring to be moved along the ring from one ring member to the other and an open position in which the first and second ring members form a discontinuous, open loop for adding or removing loose-leaf pages from the ring; and a retaining system operable to selectively and releasably hold the first and second ring members in the closed position, the retaining system comprising first and second interlocking formations adjacent ends of the first and second ring members, respectively, the first and second interlocking formations being selectively moveable relative to one another between a retaining position in which the retaining system holds the first and second ring members in the closed position and a non-retaining position in which the retaining system does not hold the first and second ring members in the closed position, wherein the interlocking formation of the first ring member includes at least one projection having a free end, the free end of the projection having at least one void and being adapted to be resiliently compressed by the interlocking formation of the second ring as the interlocking formations are moved from the non-retaining position to the retaining position, wherein the at least one projection extends from the first ring member to the free end in a direction along the axis of the elongate body.

2. A ring binder as set forth in claim 1 wherein the void has a first volume in the non-retaining position and a second volume smaller than the first volume when the projection is compressed by the interlocking formation of the second ring member.

3. A ring binder as set forth in claim 1 wherein the projection has an attached end opposite the free end the void extends from the free end through the projection beyond the attached end of the projection.

4. A ring binder mechanism as set forth in claim 3 wherein a portion of the void within the projection has a smaller volume when the projection is compressed by the interlocking formation of the second ring member than when the projection is not compressed by the interlocking formation.

5. A ring binder mechanism as set forth in claim 3 wherein the void extends all the way through the first ring member.

6. A ring binder as set forth in claim 1 wherein the projection is compressed by the interlocking formation of the second ring member when the interlocking formations are in the retaining position.

7. A ring binder as set forth in claim 2 wherein the void has a third volume when the interlocking formations are in the retaining position, the third volume being larger than the second volume.

8. A ring binder as set forth in claim 7 wherein the projection is substantially uncompressed when the interlocking formations are in the retaining position.

9. A ring binder as set forth in claim 1 wherein the second interlocking formation comprises an opening for receiving the at least a portion of the projection.

10. A ring binder as set forth in claim 9 wherein the opening has an axis, the opening being sized to resiliently compress the at least one projection of the first interlocking formation radially inward with respect to the axis as the interlocking formations are moved from the non-retaining position to the retaining position.

11. A ring binder as set forth in claim 1 wherein the first and second interlocking formations are moveable between the retaining position and the non-retaining position by movement of the first locking formation axially of the elongate body relative to the second locking formation.

12. A ring binder as set forth in claim 1 wherein the projection comprises a plurality of fingers spaced from one another and the void extends between the fingers.

13. A ring binder as set forth in claim 9 wherein the projection has four fingers and the void is generally plus-shaped.

14. A ring binder as set forth in claim 1 wherein the projection comprises a peripheral wall extending to the end of the projection, the void being circumscribed by the wall.

15. A ring binder as set forth in claim 14 wherein the peripheral wall tapers outward as it extends toward the free end of the projection when the ring members are in the non-retaining position.

16. A ring binder as set forth in claim 11 wherein the second interlocking formation comprises an opening for receiving the projection, the opening having straight sides when the ring members are in the non-retaining position.

17. A ring binder as set forth in claim 1 the rings have a substantially constant circular cross sectional shape when they are in the retaining position along a segment of the ring extending from a first location on the first ring member to a second location on the second ring member, the first and second locations being on opposite sides of the interlocking formations.

18. A ring binder as set forth in claim 1 wherein the rings and body are formed together as a one-piece unitary structure made of a moldable polymeric material.

19. A ring binder as set forth in claim 18 wherein the one-piece unitary structure includes a living hinge connecting one or more ring members to the body.

20. A ring binder as set forth in claim 18 wherein the one-piece unitary structure includes a living hinge for each ring member, the living hinges connecting the ring members to the body.

21. A ring binder as set forth in claim 1 in combination with a cover, the ring binder being mounted on the cover, the cover being hinged for movement to selectively cover and expose loose-leaf pages retained on the ring binder.

* * * * *